US008336931B2

(12) United States Patent
Cotton et al.

(10) Patent No.: US 8,336,931 B2
(45) Date of Patent: Dec. 25, 2012

(54) T-HANDLE ACTUATOR AND LATCH

(75) Inventors: Oren Lee Cotton, Anacortes, WA (US); Brian P. Vogeding, Newark, DE (US)

(73) Assignee: Southco, Inc., Concordville, PA (US)

( * ) Notice: Subject to any disclaimer, the term of this patent is extended or adjusted under 35 U.S.C. 154(b) by 907 days.

(21) Appl. No.: 12/122,701

(22) Filed: May 18, 2008

(65) Prior Publication Data

US 2009/0284026 A1 Nov. 19, 2009

(51) Int. Cl.
*E05C 19/00* (2006.01)
*E05C 3/06* (2006.01)

(52) U.S. Cl. . 292/252; 292/194; 292/200; 292/DIG. 27; 292/DIG. 31

(58) Field of Classification Search ..... 292/200, 292/252, 57–69, DIG. 27, DIG. 31; 70/114, 70/116, 139, 360, 361
See application file for complete search history.

(56) References Cited

U.S. PATENT DOCUMENTS 661,253 A 11/1900 Zimmerman
D51,961 S 4/1918 Healey
1,563,489 A 12/1925 Hooppaw et al.
1,592,452 A 7/1926 Ferris et al.
1,611,999 A 12/1926 Cummins
1,899,996 A * 3/1933 Sullivan ..... 70/216
1,899,997 A * 3/1933 Sullivan ..... 70/222
1,918,411 A * 7/1933 Lowe ..... 70/223
1,970,409 A 8/1934 Wiedemann
D94,405 S 1/1935 Carlson
D94,406 S 1/1935 Carlson
D94,408 S 1/1935 Carlson
2,017,530 A * 10/1935 De Orlow ..... 70/223
2,019,534 A * 11/1935 Vander Henst ..... 70/221
2,255,402 A 9/1941 Vile
2,373,083 A 4/1945 Brewster
D190,391 S * 5/1961 Cordova ..... D8/382
3,046,827 A 7/1962 Myers
3,101,641 A 8/1963 Walker et al.
3,117,484 A 1/1964 Myers
3,170,362 A 2/1965 Mewse
D204,461 S 4/1966 Voker et al.
3,243,837 A 4/1966 Smith
3,438,227 A 4/1969 Wolniak
3,498,653 A 3/1970 McCreery
3,532,013 A 10/1970 Haznar
3,534,650 A 10/1970 Kubokawa
3,596,554 A 8/1971 Low et al.
D255,047 S 5/1980 Muller et al.
4,289,000 A * 9/1981 Nielsen, Jr. ..... 70/34
4,343,500 A * 8/1982 Steiner ..... 292/175
4,556,244 A 12/1985 Bisbing
4,641,865 A 2/1987 Pastva
(Continued)

OTHER PUBLICATIONS

Pages 150-160 from Southco 2005 catalog.

*Primary Examiner* — Carlos Lugo
(74) *Attorney, Agent, or Firm* — Paul & Paul

(57) ABSTRACT

A T-handle actuator has one or more retractable ball bearings for selectively engaging a socket to operate a latch mechanism. The ball bearings are allowed to retract using a push-button for removal of the actuator from the socket. A latch mechanism is operated by rotationally moving a drive plug. The drive plug can be a socket that can be engaged by the T-handle actuator.

34 Claims, 55 Drawing Sheets

U.S. PATENT DOCUMENTS 4,679,835 A 7/1987 Weinerman et al.
4,689,976 A 9/1987 Larsen
4,706,478 A * 11/1987 Swan et al. ..... 70/28
4,753,626 A 6/1988 Hazebrook et al.
4,781,085 A 11/1988 Fox, III
4,878,367 A 11/1989 Bisbing
4,988,248 A 1/1991 Flux
5,038,588 A 8/1991 Hall
5,184,979 A 2/1993 Hazebrook et al.
D342,307 S 12/1993 Bartholf et al.
5,394,594 A * 3/1995 Duran ..... 24/453
5,575,443 A 11/1996 Honeycutt
5,586,459 A 12/1996 Bullock et al.
5,813,296 A 9/1998 Hoff et al.
5,882,053 A 3/1999 Bekins et al.
6,003,414 A 12/1999 Hsieh
6,006,631 A 12/1999 Miner et al.
6,018,969 A 2/2000 Haseley et al.
D441,633 S 5/2001 Jenks
D454,045 S 3/2002 Rinner et al.
6,386,789 B1 5/2002 Chausse et al.
6,418,761 B1 * 7/2002 Wytcherley et al. ..... 70/208
D469,331 S 1/2003 Hansen
D469,679 S 2/2003 Nykoluk
6,523,441 B2 2/2003 Lee
6,684,670 B1 * 2/2004 Agbay et al. ..... 70/164
D538,131 S 3/2007 Paige et al.
D572,999 S 7/2008 Gulley
D574,213 S 8/2008 Linares
D581,243 S 11/2008 Gulley
7,452,010 B2 11/2008 Cotton
D596,920 S 7/2009 Cotton et al.
7,736,109 B2 * 6/2010 Schmier, II ..... 411/348
7,854,053 B2 * 12/2010 Schmier, II ..... 29/441.1
2006/0220394 A1 * 10/2006 Halder ..... 292/252

* cited by examiner

T-HANDLE ACTUATOR AND LATCH

BACKGROUND OF THE INVENTION

1. Field of Invention

The present invention relates to the field of latch assemblies and actuators for latch assemblies.

2. Brief Description of the Related Art

Latch assemblies are relied on in many applications for securing items, such as panels, doors, and doorframes together. For example, containers, cabinets, closets, drawers, compartments and the like may be secured with a latch. Furthermore, in many applications a removable key or actuator is used to operate the latch in order to restrict access to the space secured by the latch. Various latches for panel closures have been employed where one of the panels such as a swinging door, drawer or the like is to be fastened or secured to a stationary panel, doorframe, cabinet, or compartment body. Although many latch assemblies are known in the prior art, none are seen to teach or suggest the unique features of the present invention or to achieve the advantages of the present invention as will be apparent from the detailed description and drawings below.

SUMMARY OF THE INVENTION

The present invention is directed to a removable actuator for operating a latch and latching systems for securing two members together that use the actuator. The removable T-handle latch actuator of the present invention includes a T-shaped handle, a pushbutton, and one or more ball bearings. Holding in the pushbutton allows the ball bearing to retract into the T-handle actuator. The latch of the present invention includes a drive plug, which can be a socket for receiving one end of the T-handle actuator, a shaft that at least rotates in response to some rotation of the socket, and a pawl or latch bolt secured to the shaft to as to move with the shaft as a unit. The pushbutton is held in to allow the T-handle actuator to be inserted into the socket. The pushbutton is then released to bring the ball bearings into engagement with cavities in the inner surface of the socket. When the end of the T-handle is inserted into the socket and the pushbutton is released, the ball bearings of the T-handle actuator project outward to engage the cavities in the inner surface of the socket such that the socket can be turned by turning the T-handle actuator. Thus, the T-handle actuator can be used to operate the latch by rotating the pawl between latched and unlatched positions. Pushing in the pushbutton allows the ball bearings to retract into the t-handle actuator, thus allowing the T-handle actuator to be removed from the socket.

It is an object of the present invention to provide a T-handle actuator that has retractable ball bearing for engagement with and operation of a latch mechanism.

It is another object of the present invention to provide a simplified latch mechanism that does not require an expensive housing.

These and other objects of the present invention will be come apparent from the attached drawings and detailed description.

BRIEF DESCRIPTION OF THE DRAWINGS

The same reference numerals refer to identical parts in the various drawings.

DETAILED DESCRIPTION OF THE INVENTION

Figure 1:
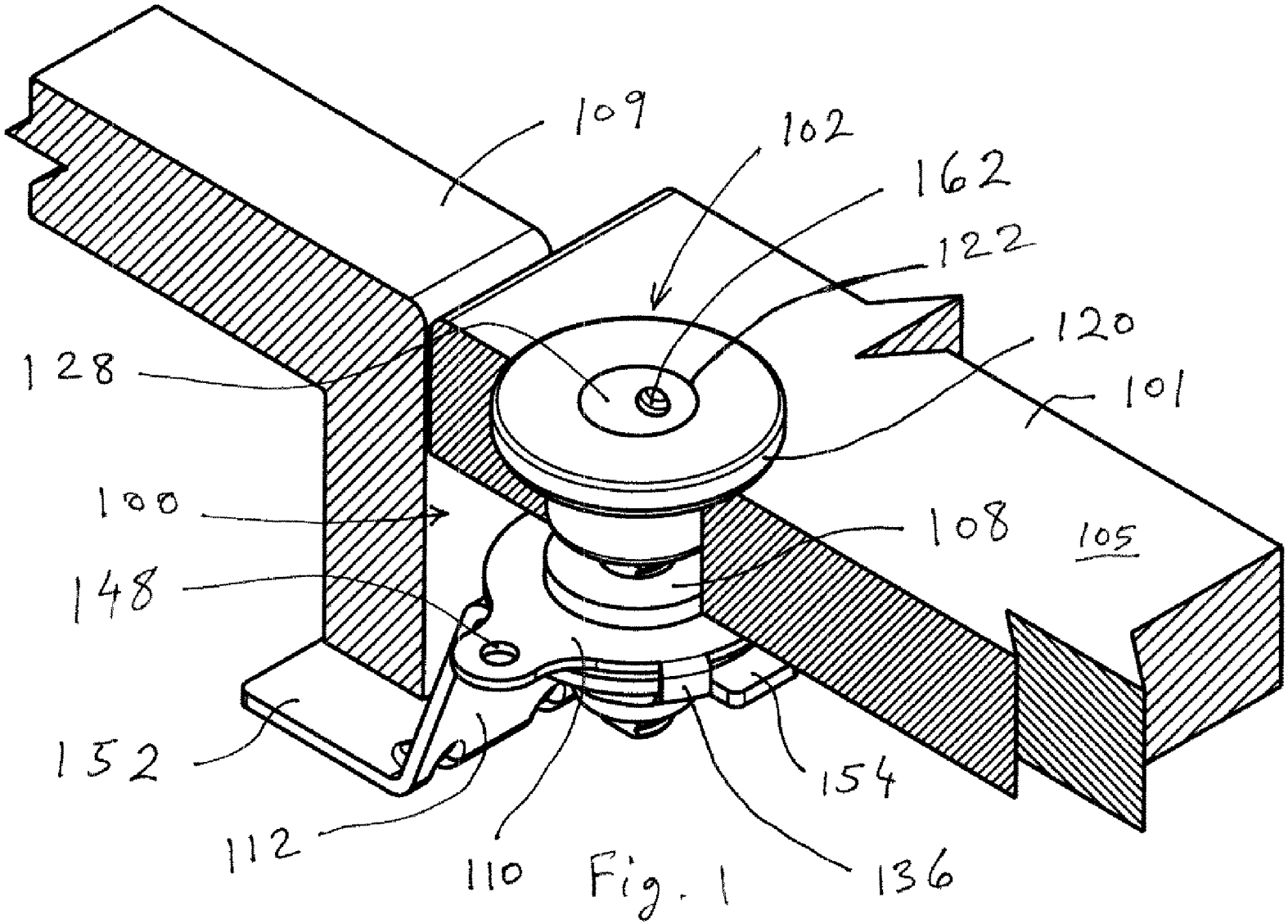
FIG. 1 is an environmental view of the first embodiment of a latch assembly according to the present invention shown in the latched configuration.
Figure 2:
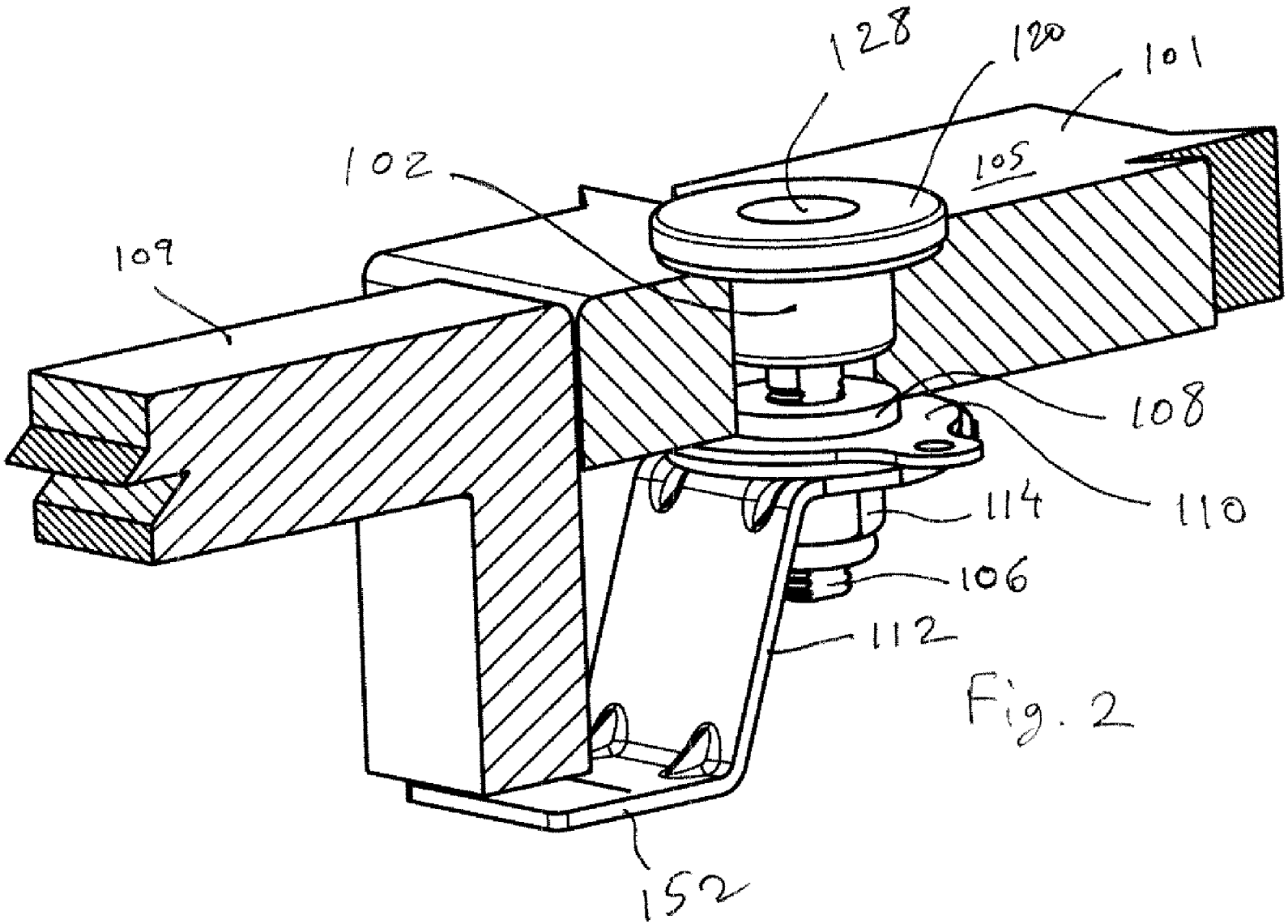
FIG. 2 is another environmental view of the latch assembly of FIG. 1 shown in the latched configuration.
Figure 3:
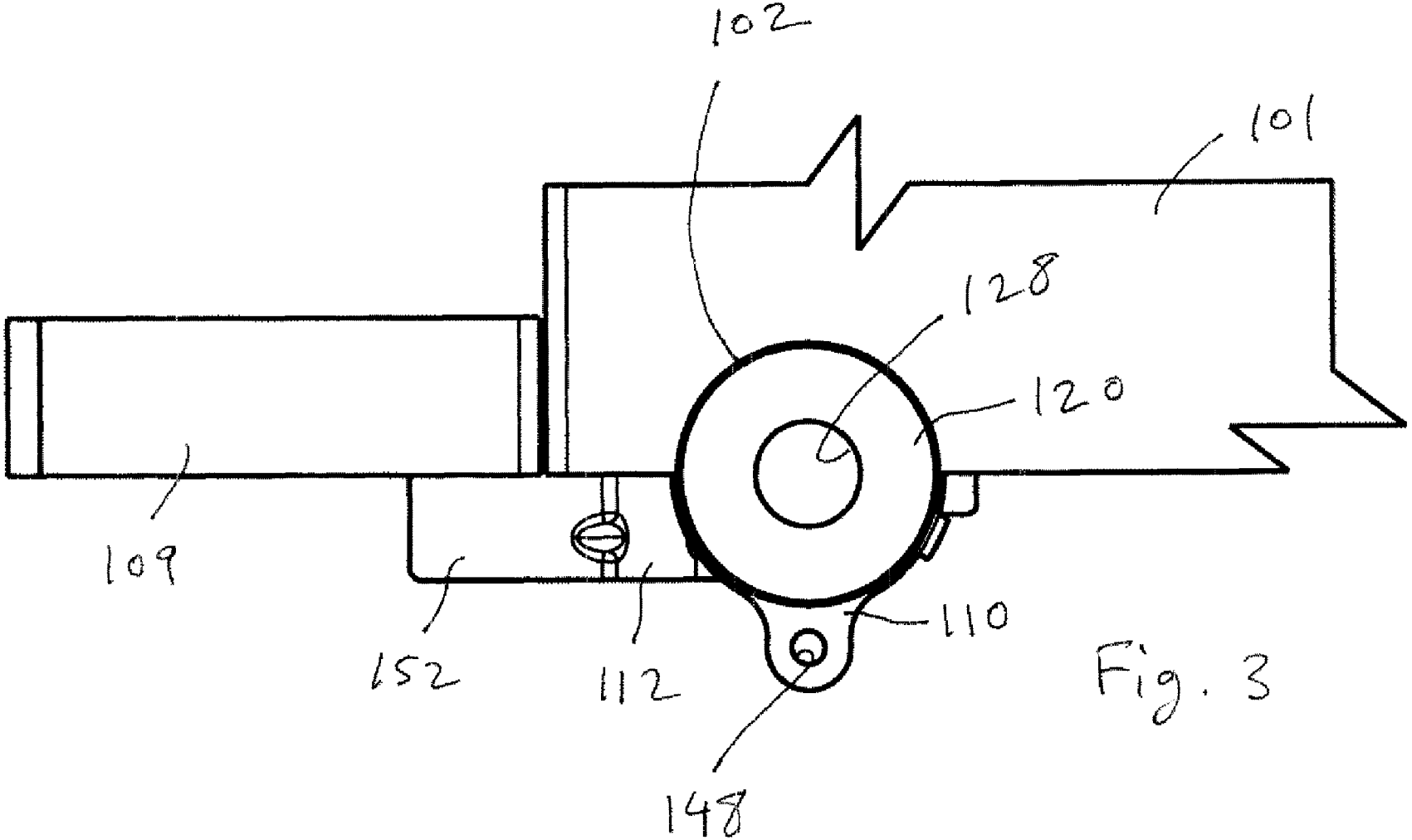
FIG. 3 is yet another environmental view of the latch assembly of FIG. 1 shown in the latched configuration.
Figure 4:
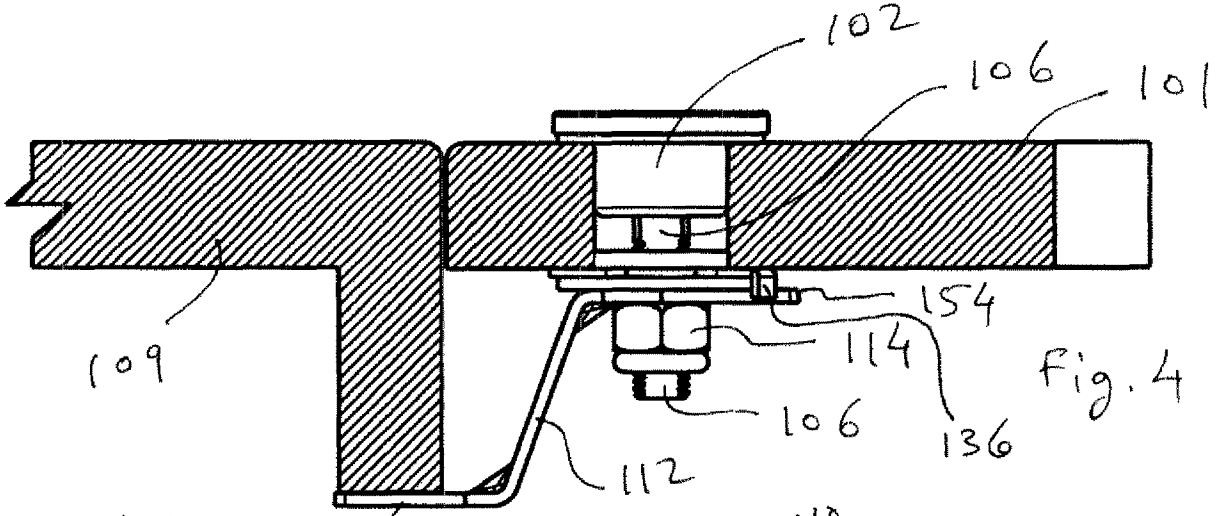
FIG. 4 is another environmental view of the latch assembly of FIG. 1 shown in the latched configuration.
Figure 5:
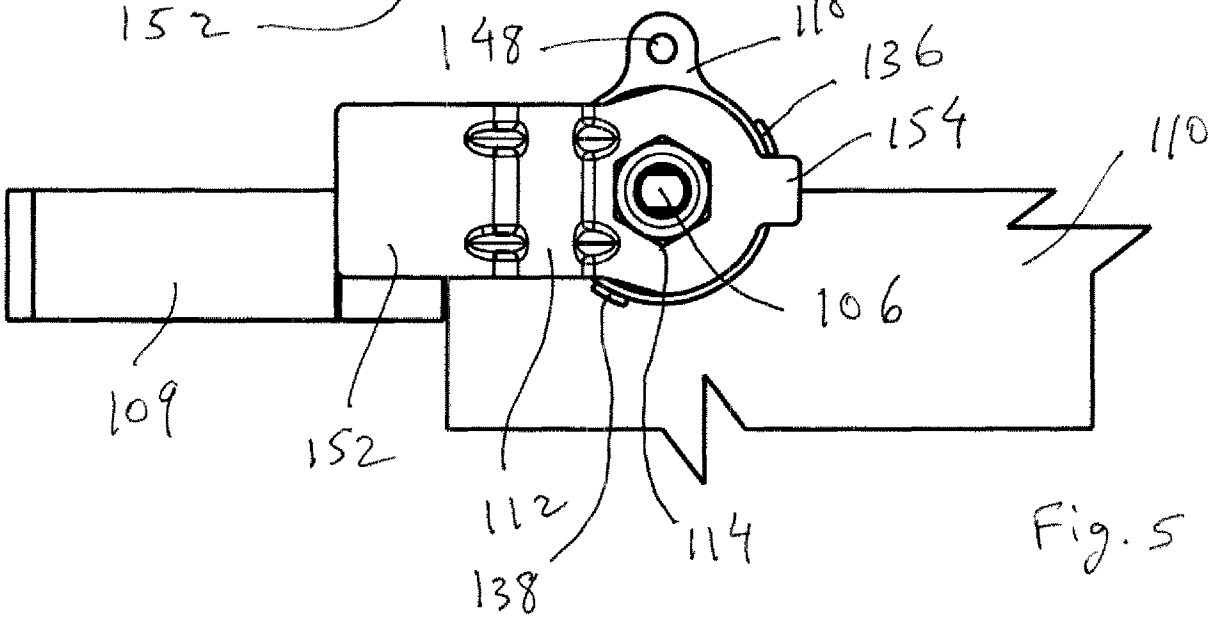
FIG. 5 is another environmental view of the latch assembly of FIG. 1 shown in the latched configuration.
Figure 6:
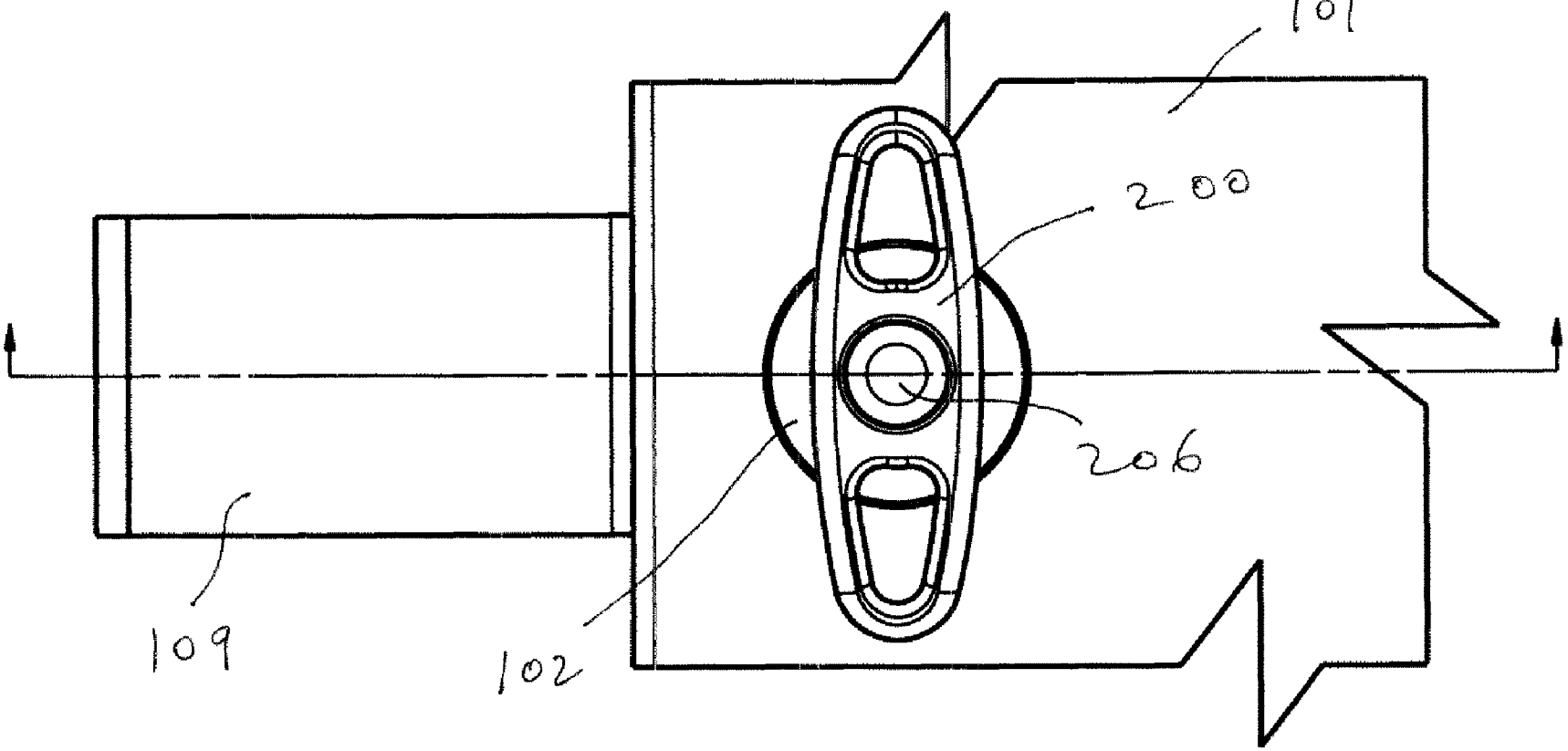
FIG. 6 is an environmental view of the first embodiment of a latch assembly and T-handle actuator according to the present invention shown in the latched configuration.
Figure 7:
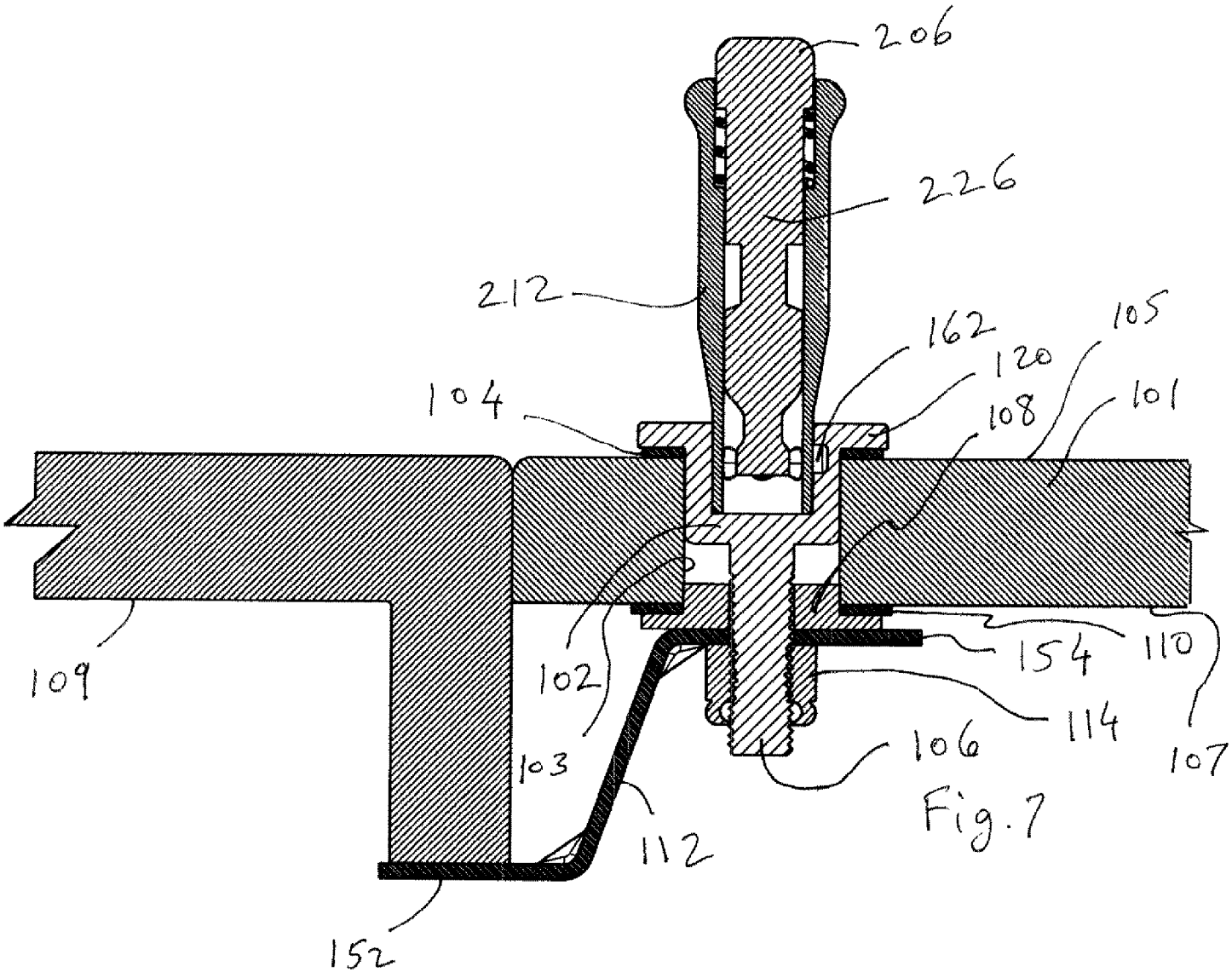
FIG. 7 is a cross sectional environmental view of the first embodiment of a latch assembly and T-handle actuator according to the present invention shown in the latched configuration.
Figure 8:
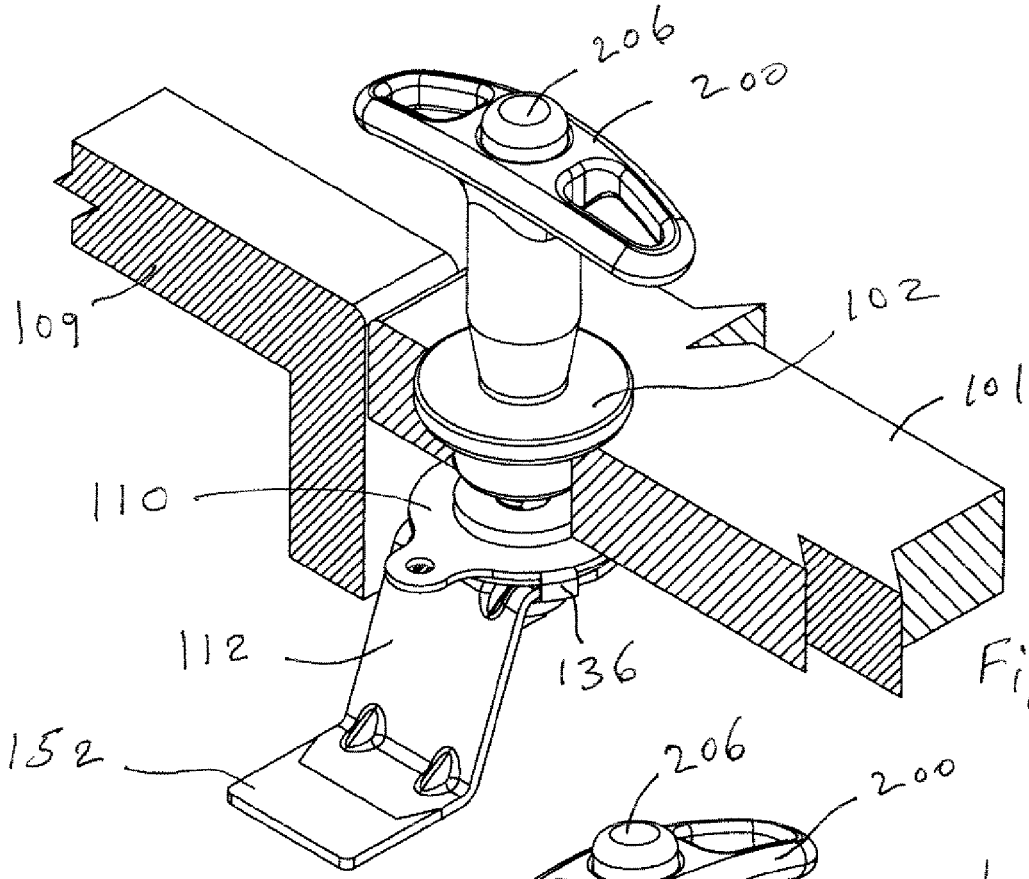
FIGS. 8-12 are environmental views of the first embodiment of a latch assembly and T-handle actuator according to the present invention shown in the unlatched configuration.
Figure 9:
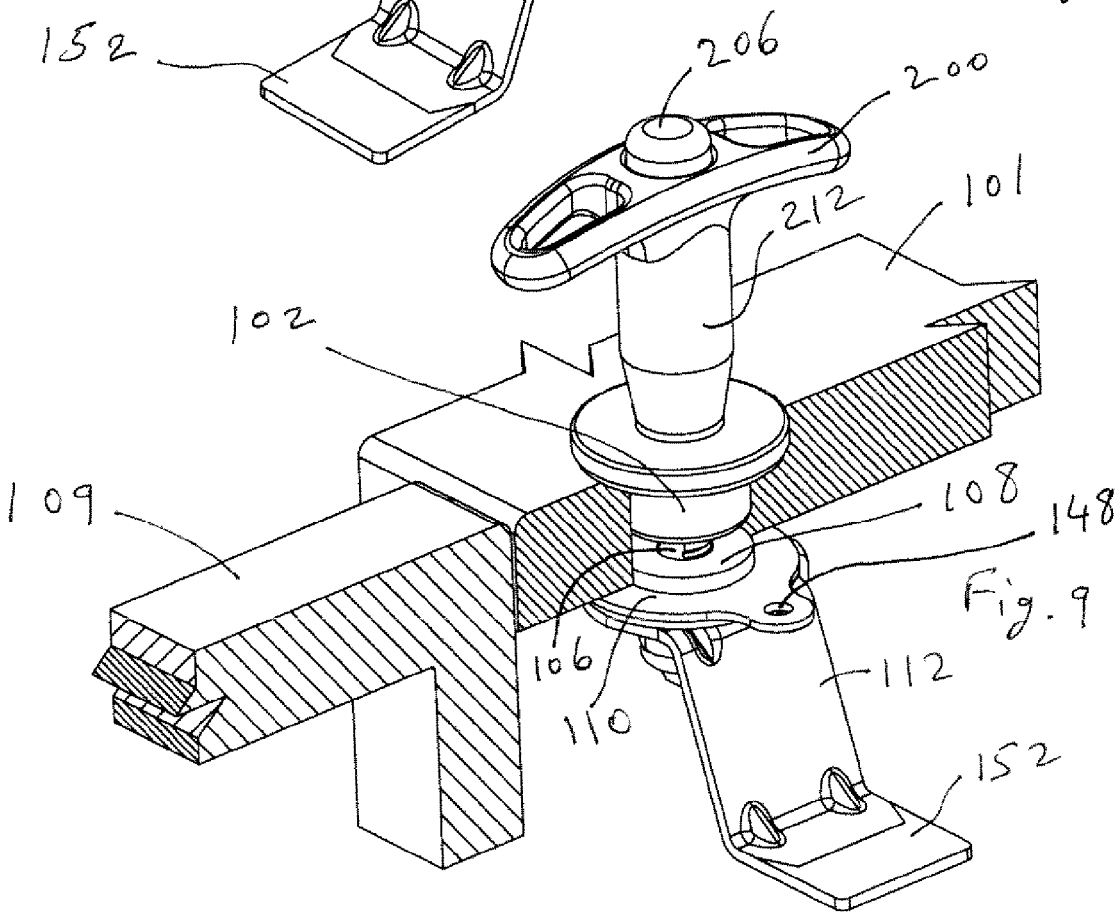
Figure 10:
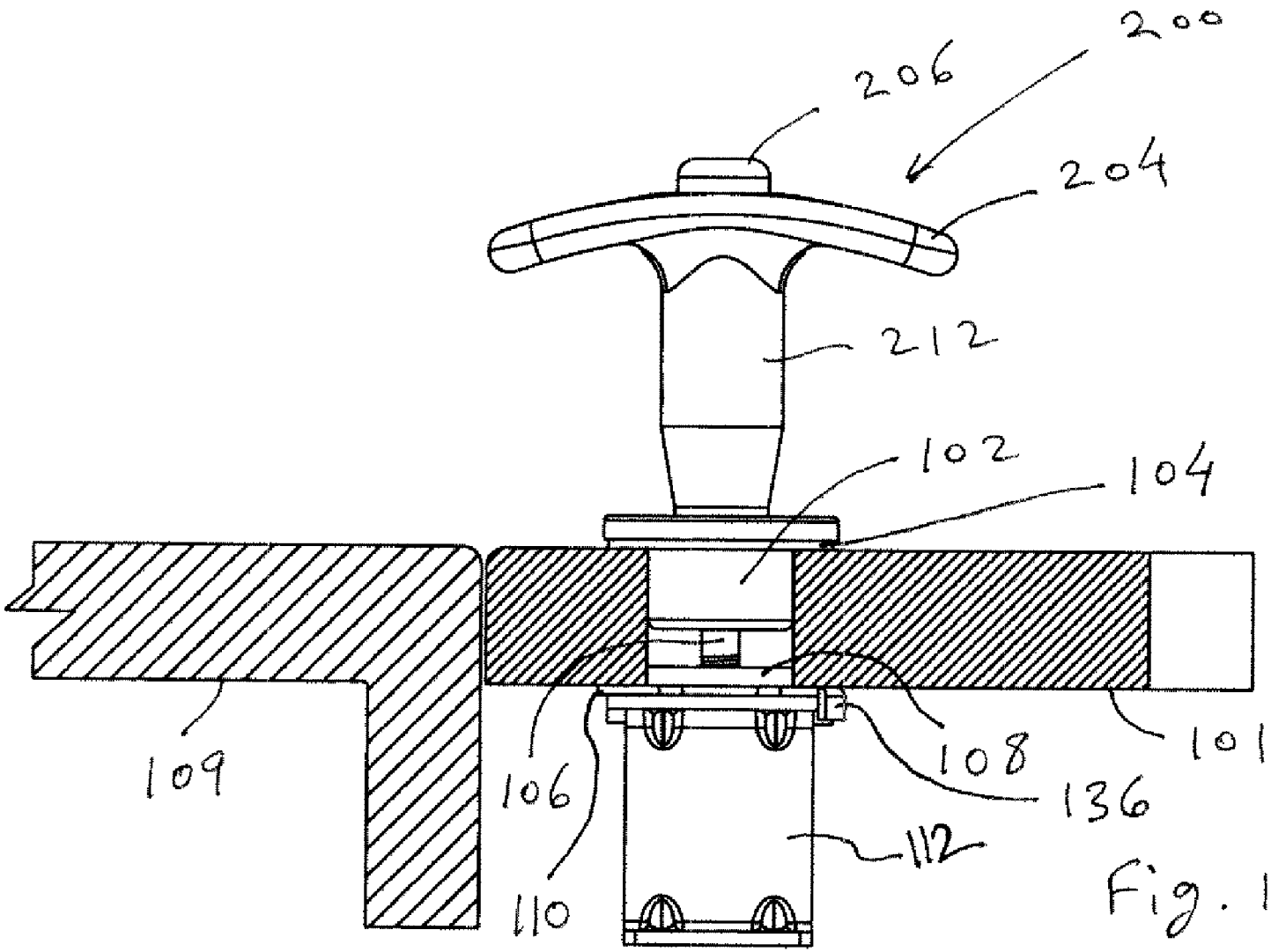
Figure 11:
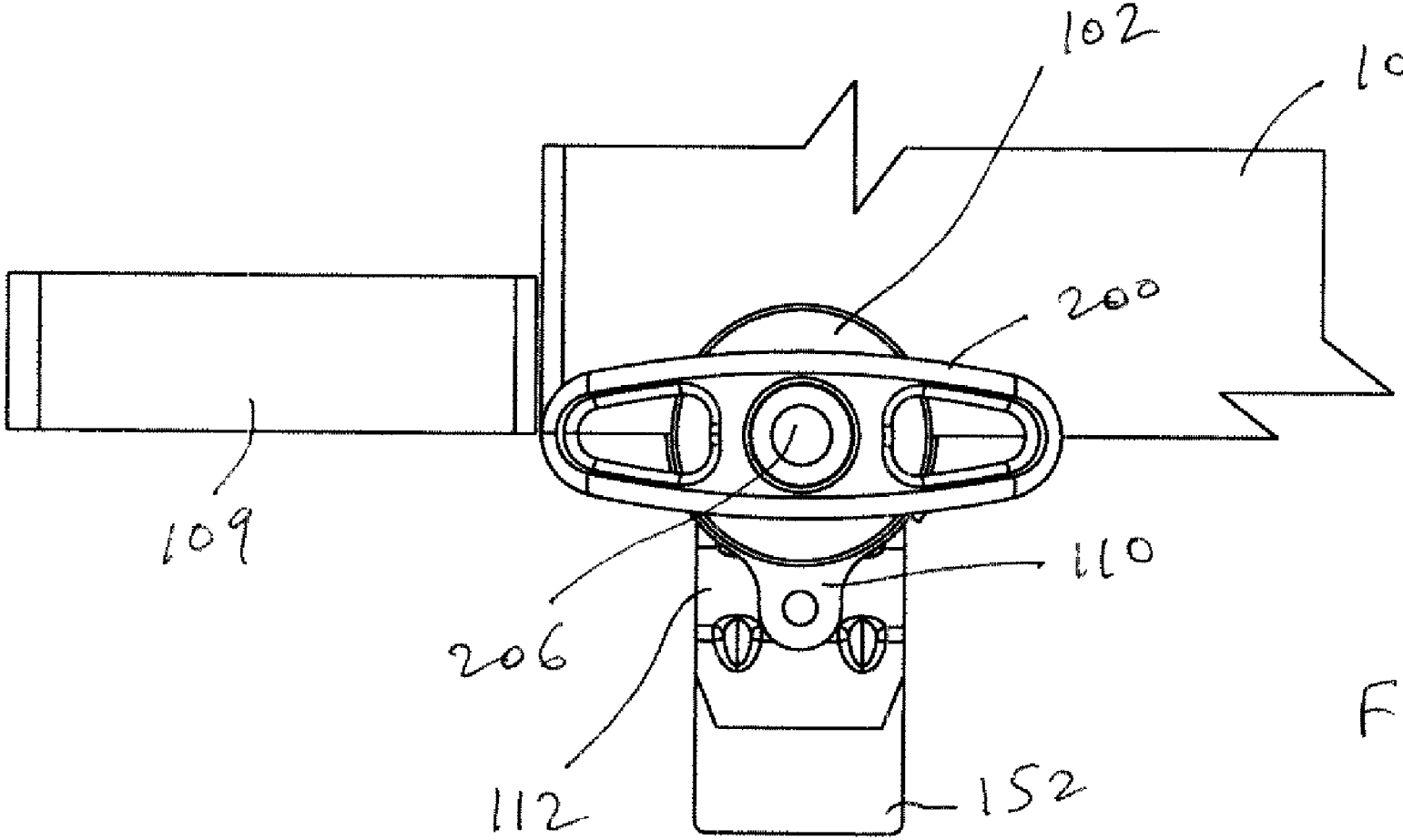
Figure 12:
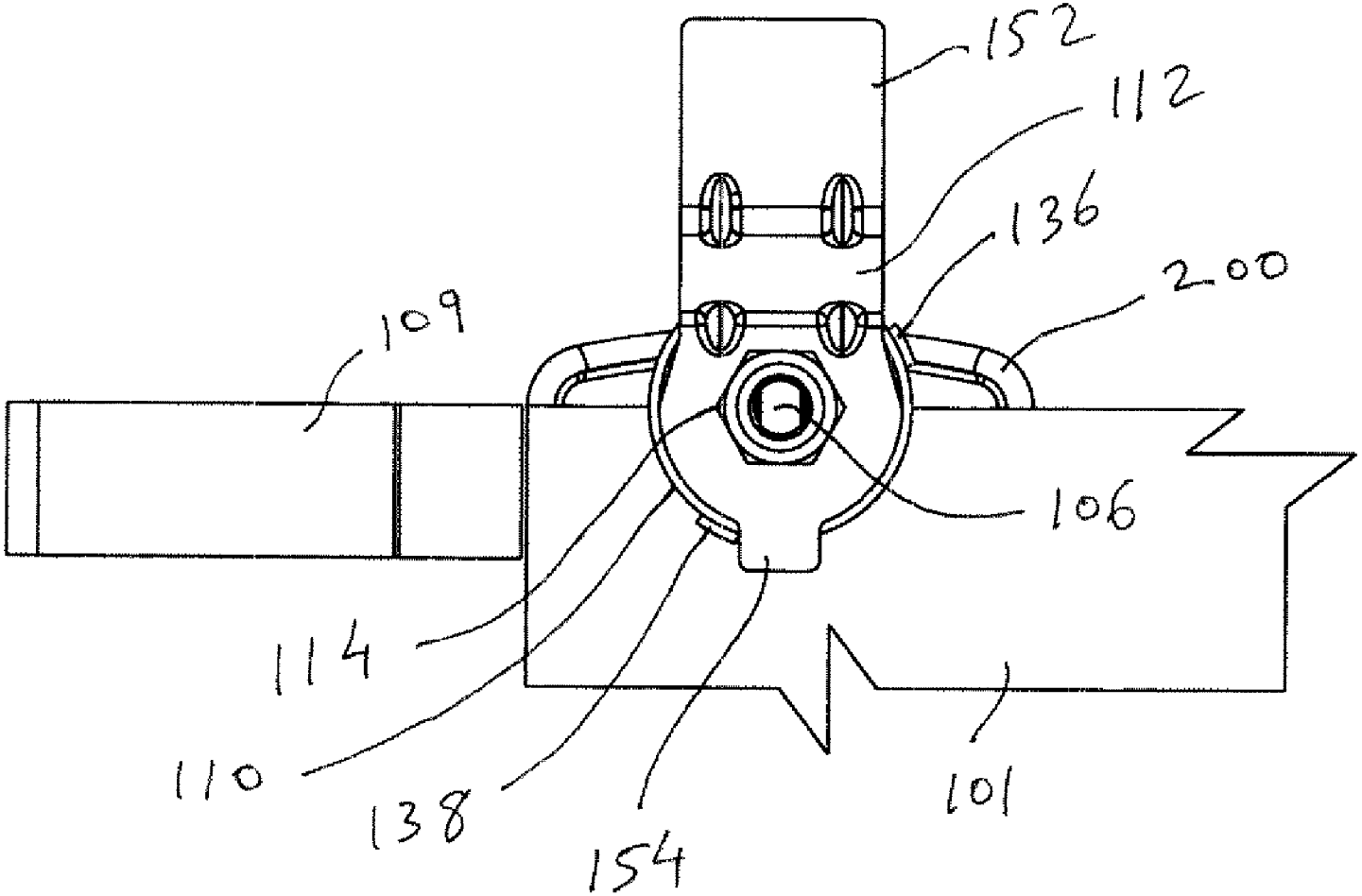
Figure 14:
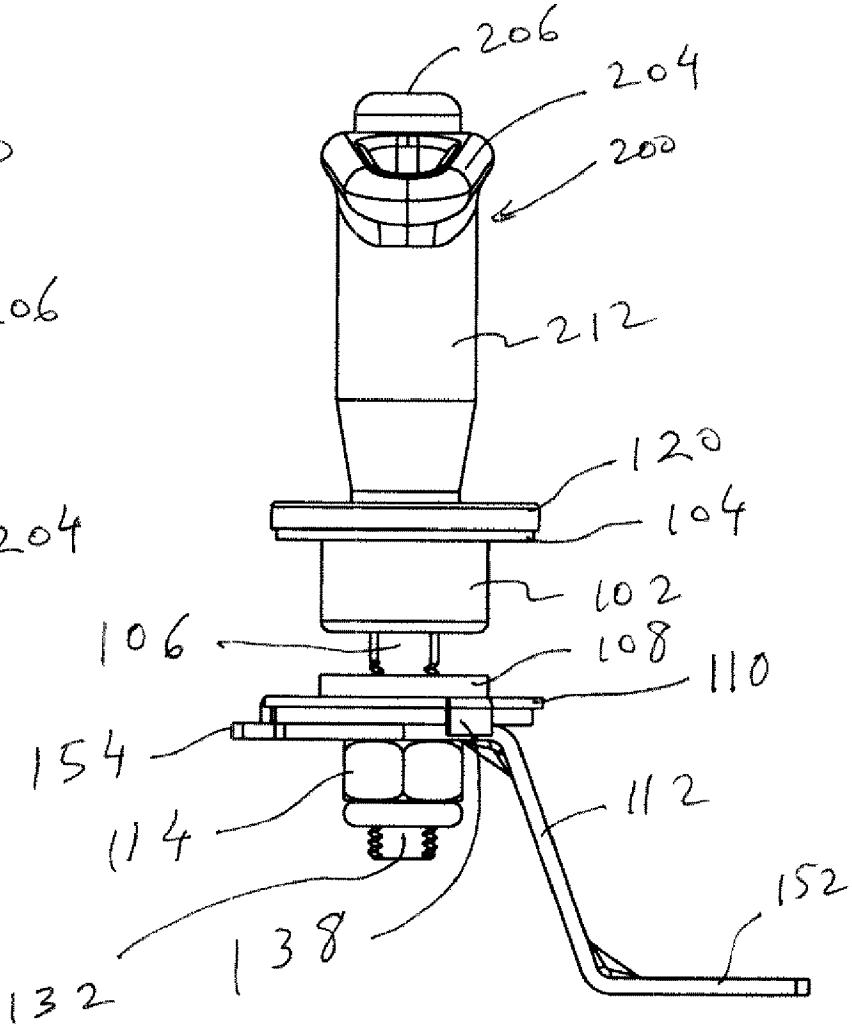
FIGS. 13-18 are various views of the first embodiment of a latch assembly and T-handle actuator according to the present invention showing the T-handle actuator inserted onto the socket of the latch assembly.
Figure 13:
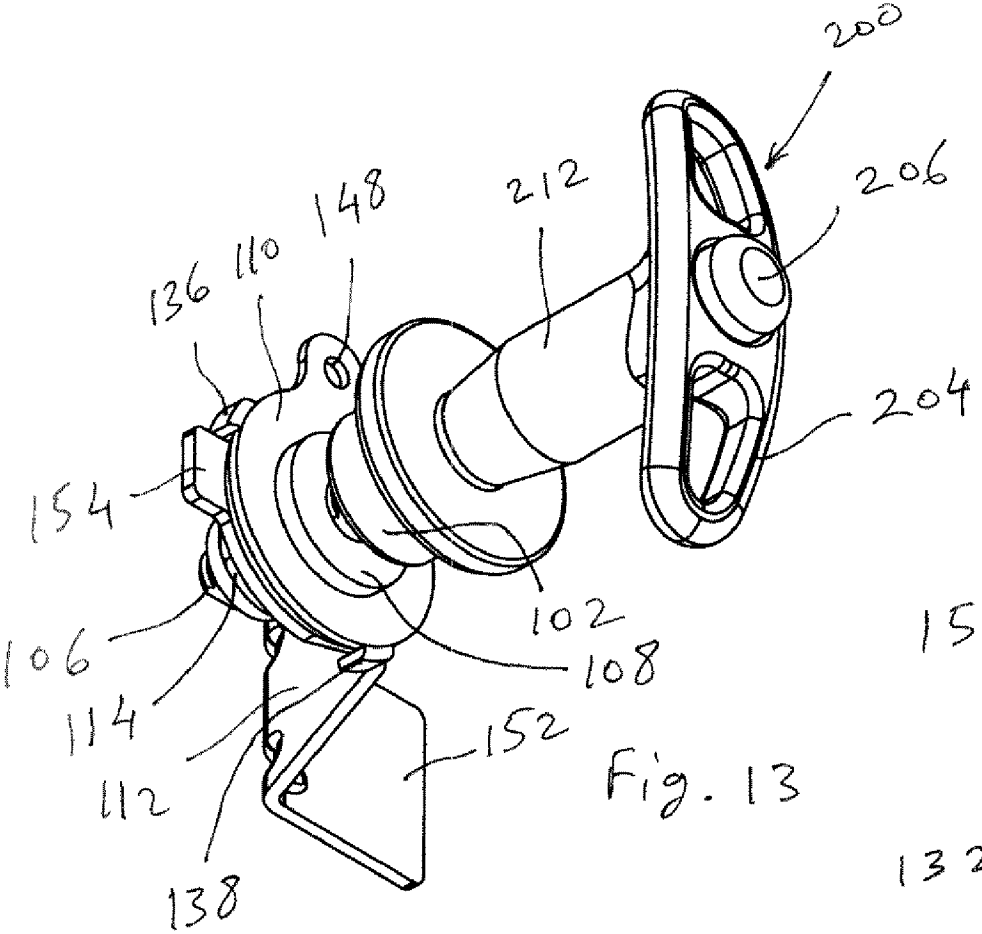
Figure 15:
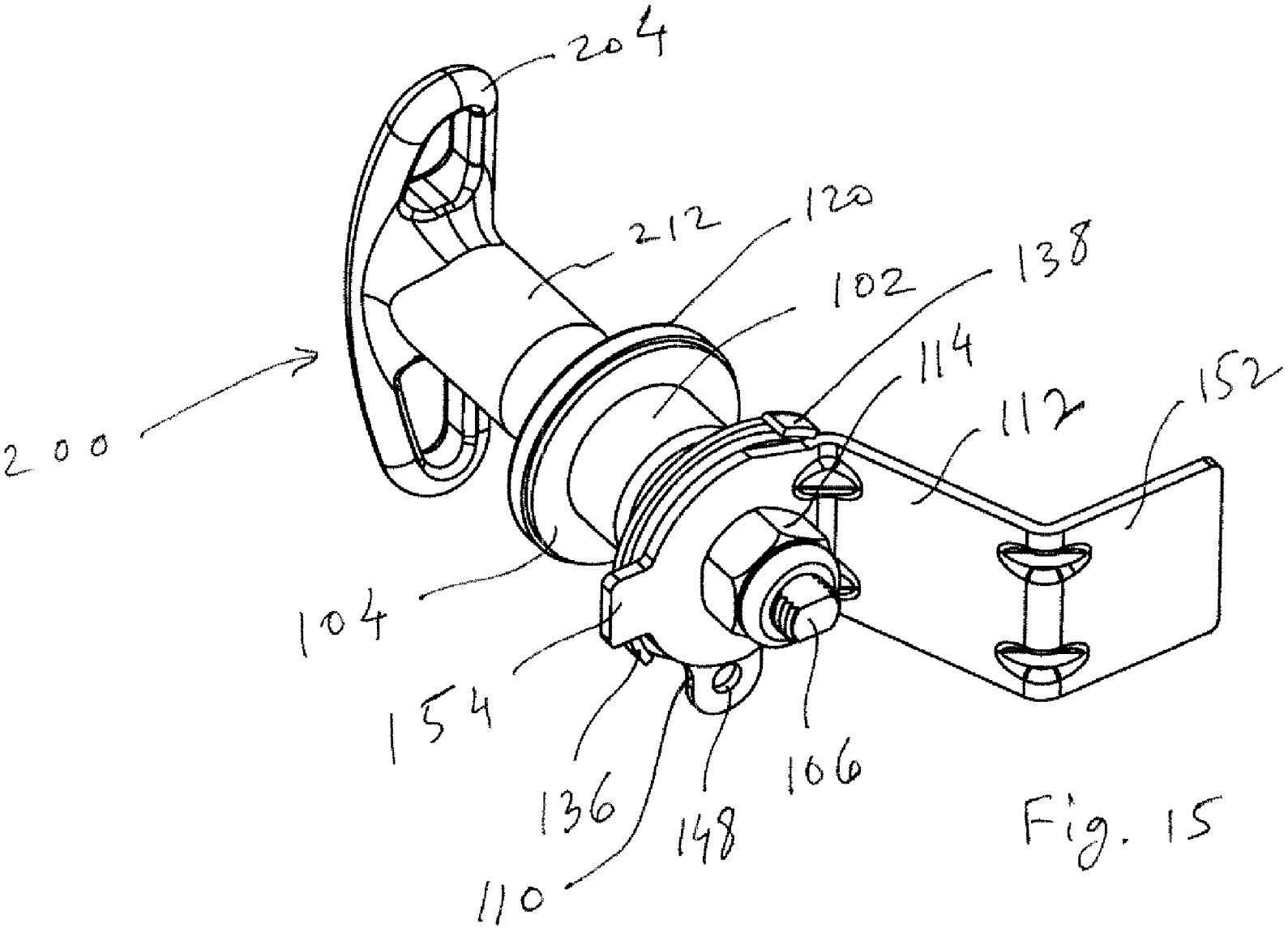
Figure 16:
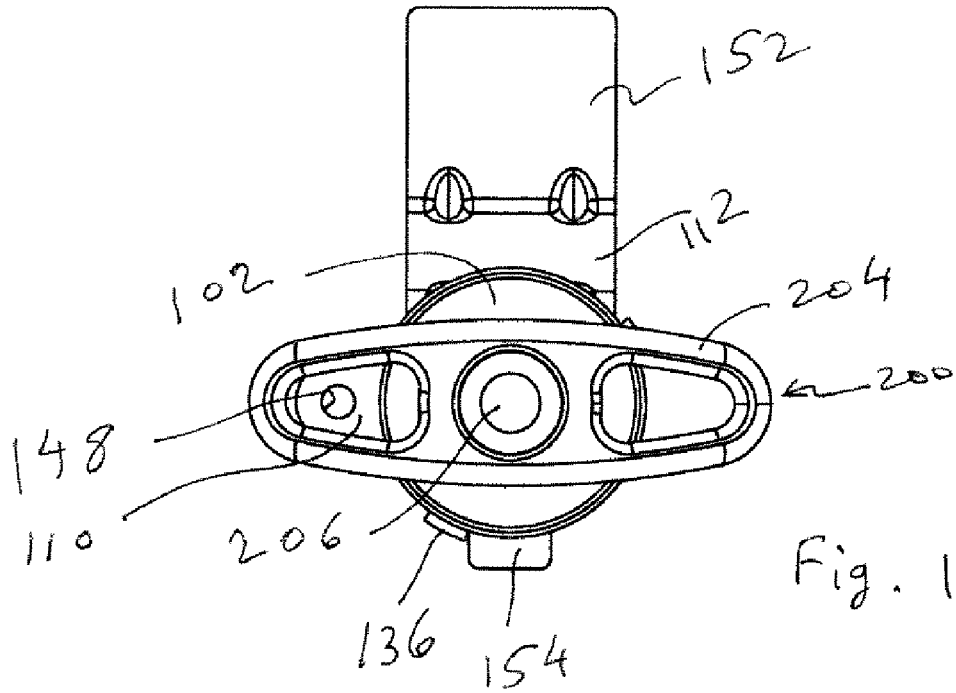
Figure 17:
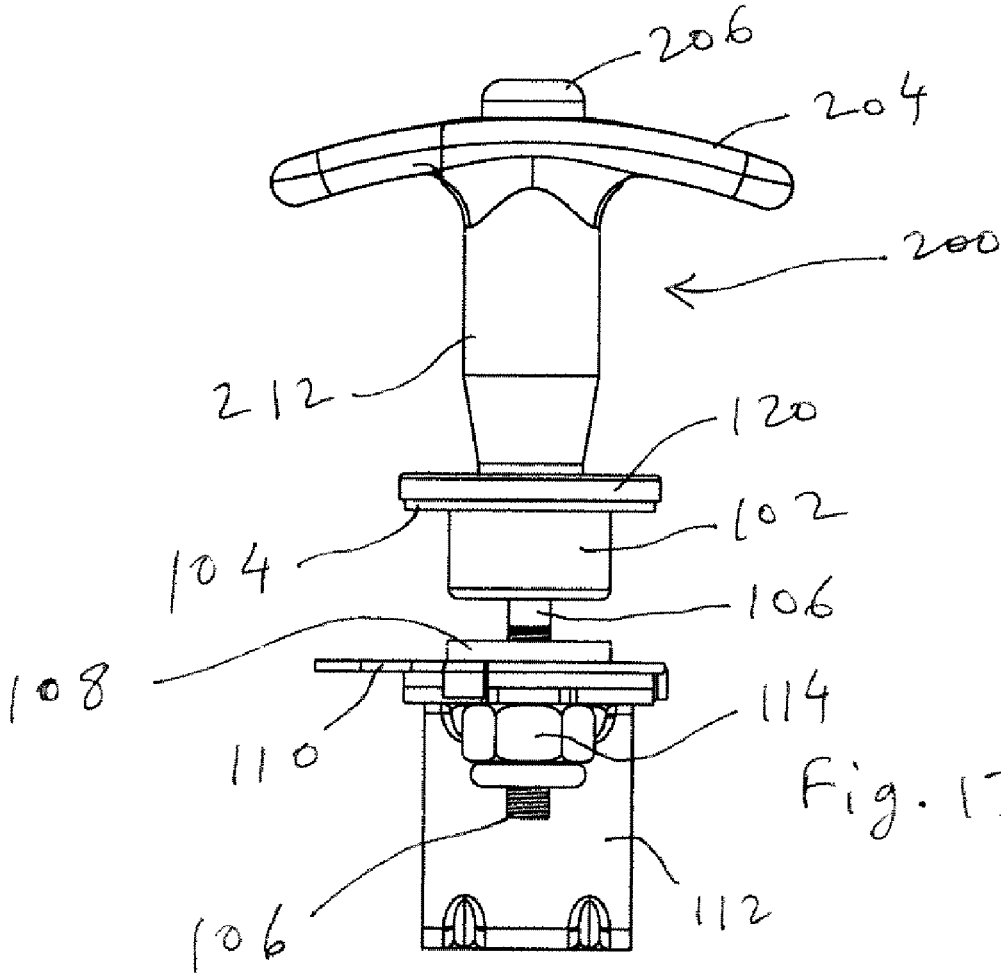
Figure 18:
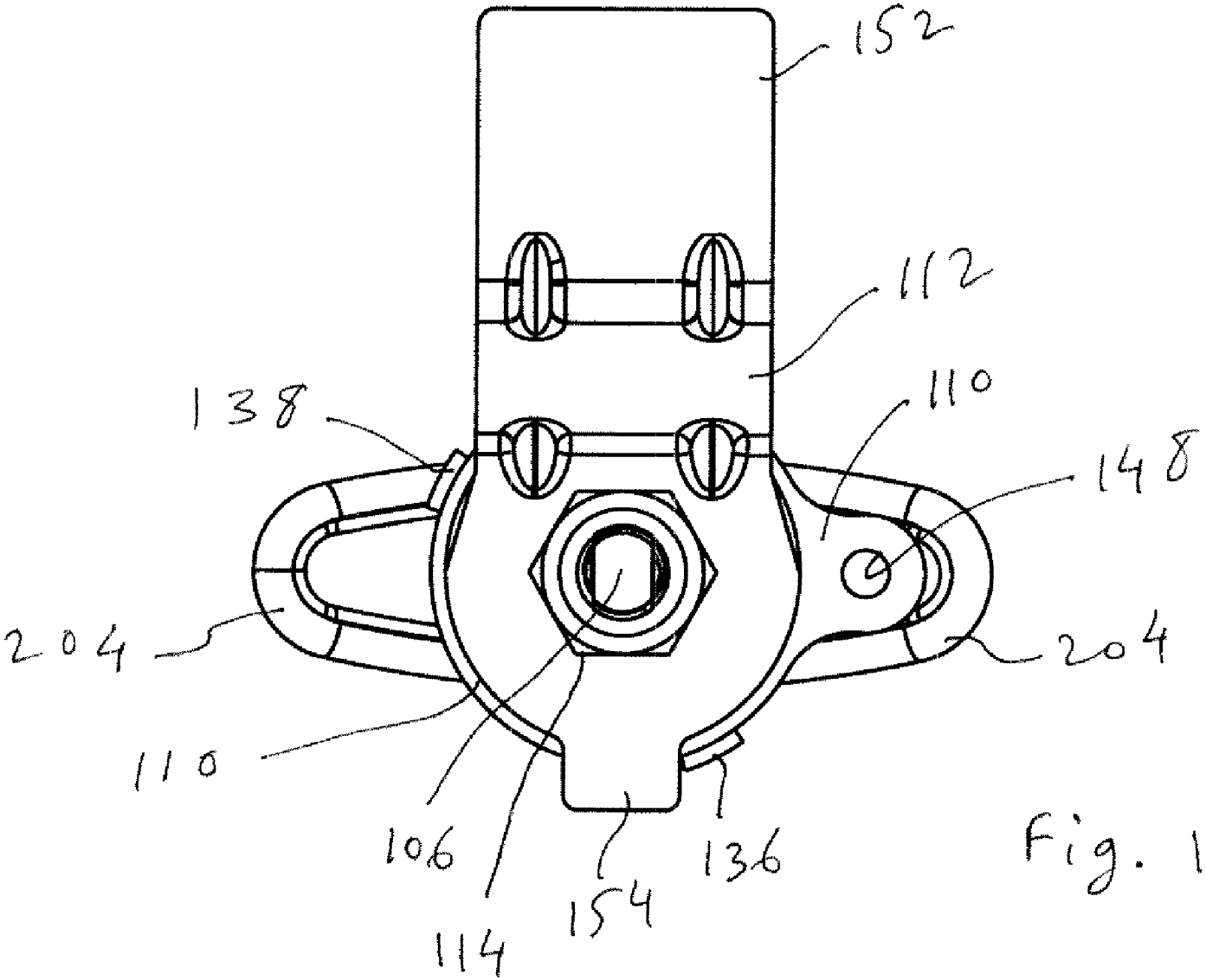
Figure 19:
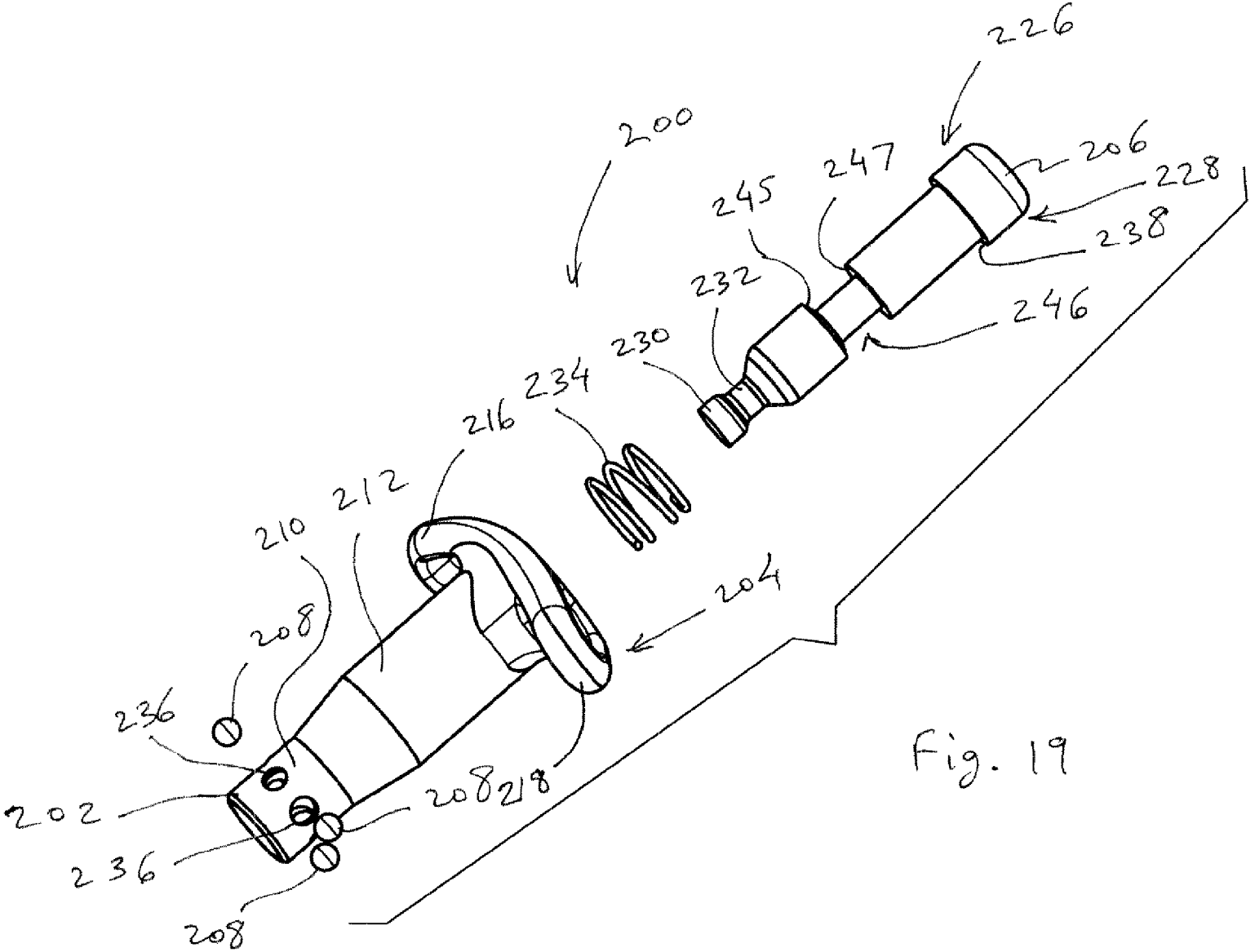
FIG. 19 is an exploded view of the first embodiment of a T-handle actuator according to the present invention.
Figure 20:
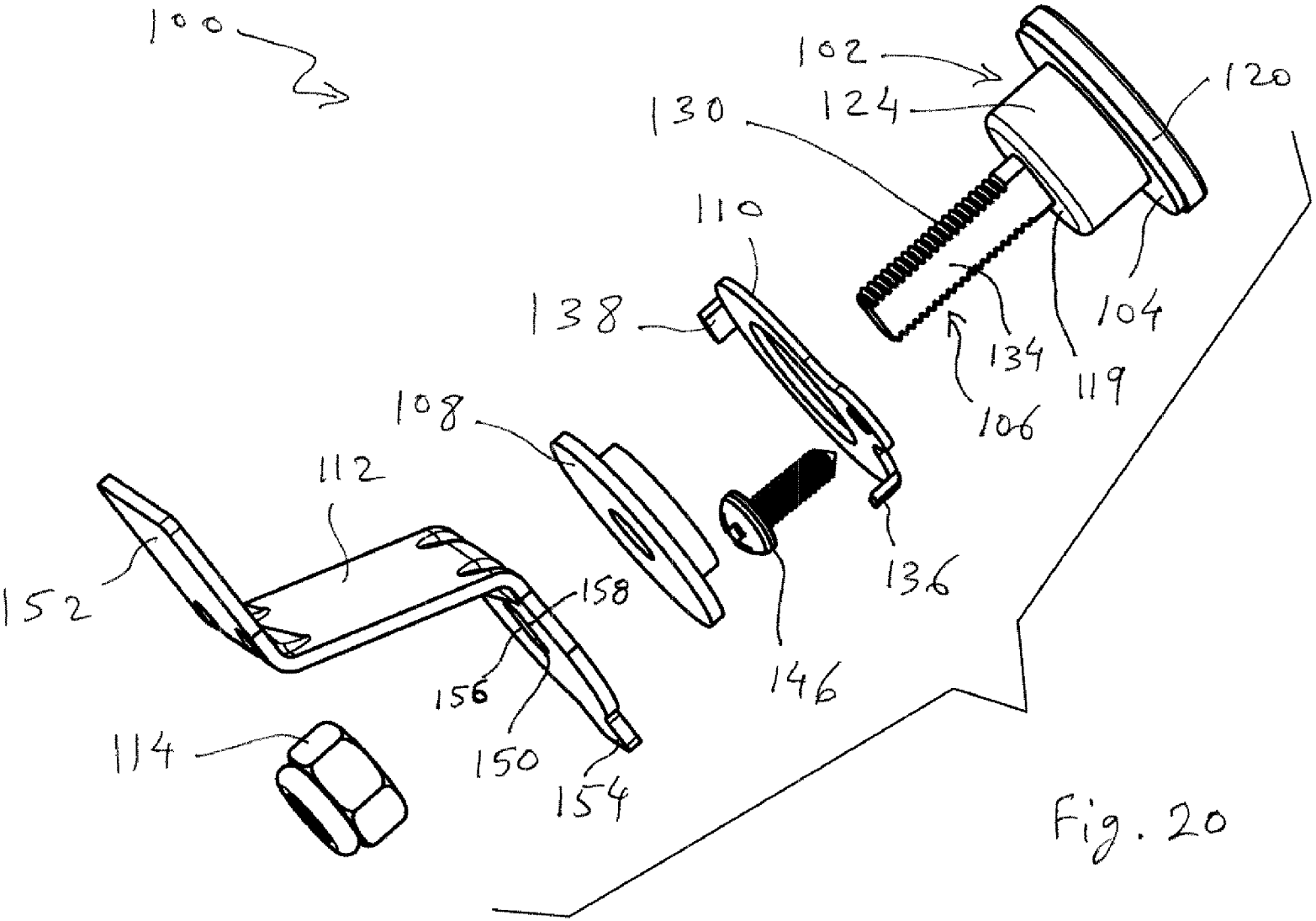
FIG. 20 is an exploded view of the first embodiment of a latch assembly according to the present invention.
Figure 21:
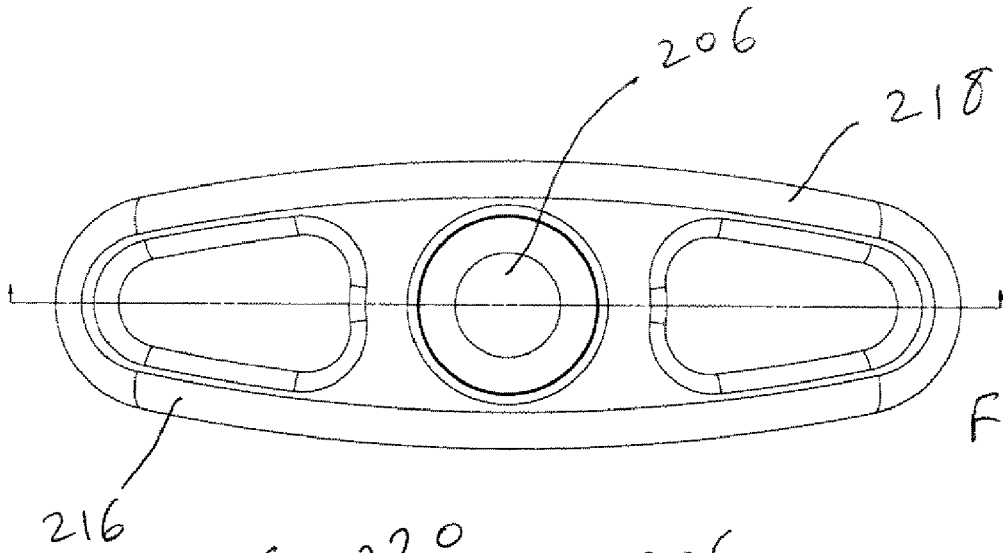
FIG. 21 is a top view of the first embodiment of a T-handle actuator according to the present invention shown with the pushbutton retracted.
Figure 22:
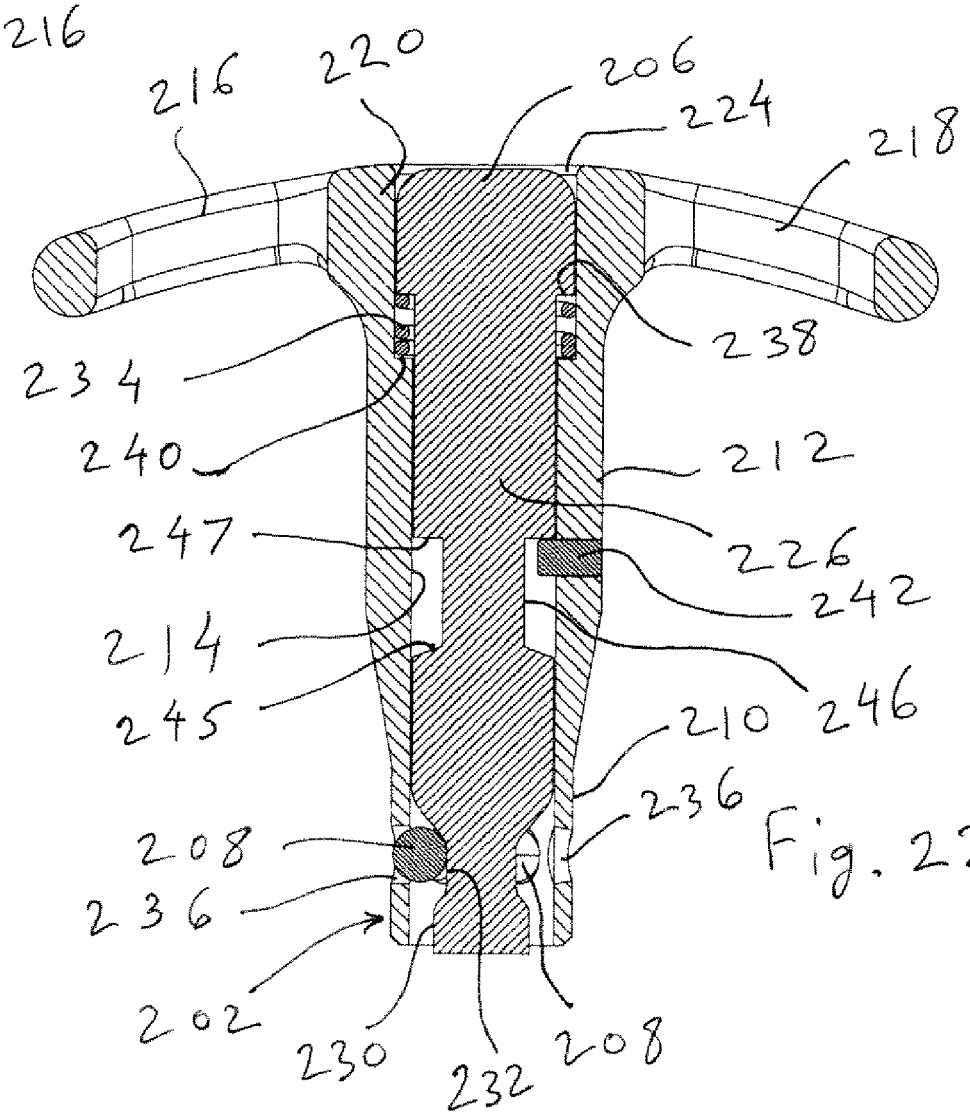
FIG. 22 is a cross sectional view of the first embodiment of a T-handle actuator according to the present invention shown with the pushbutton retracted.
Figure 23:
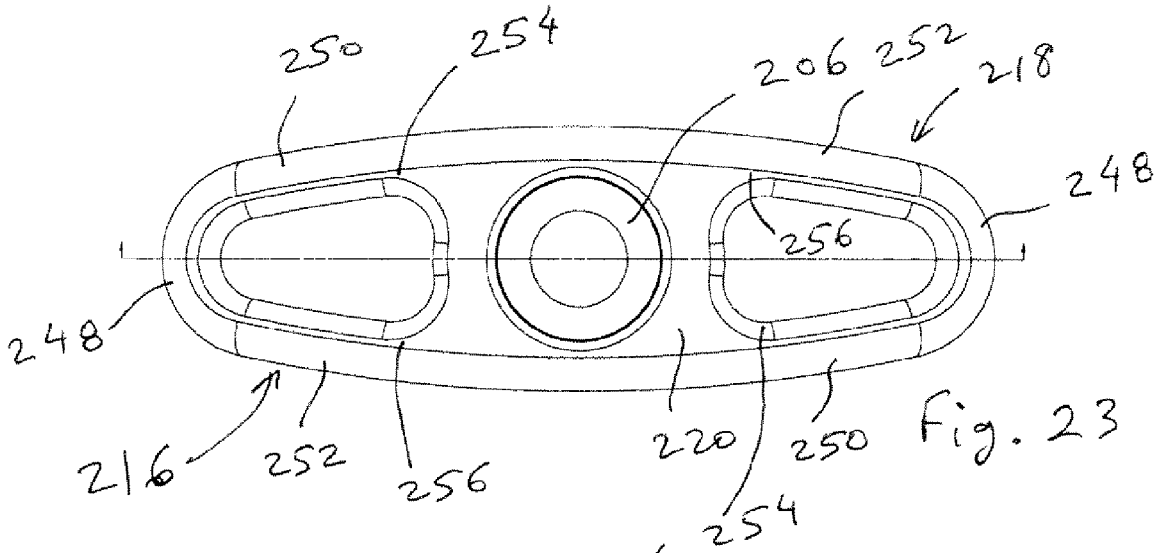
FIG. 23 is a top view of the first embodiment of a T-handle actuator according to the present invention shown with the pushbutton in the extended position.
Figure 24:
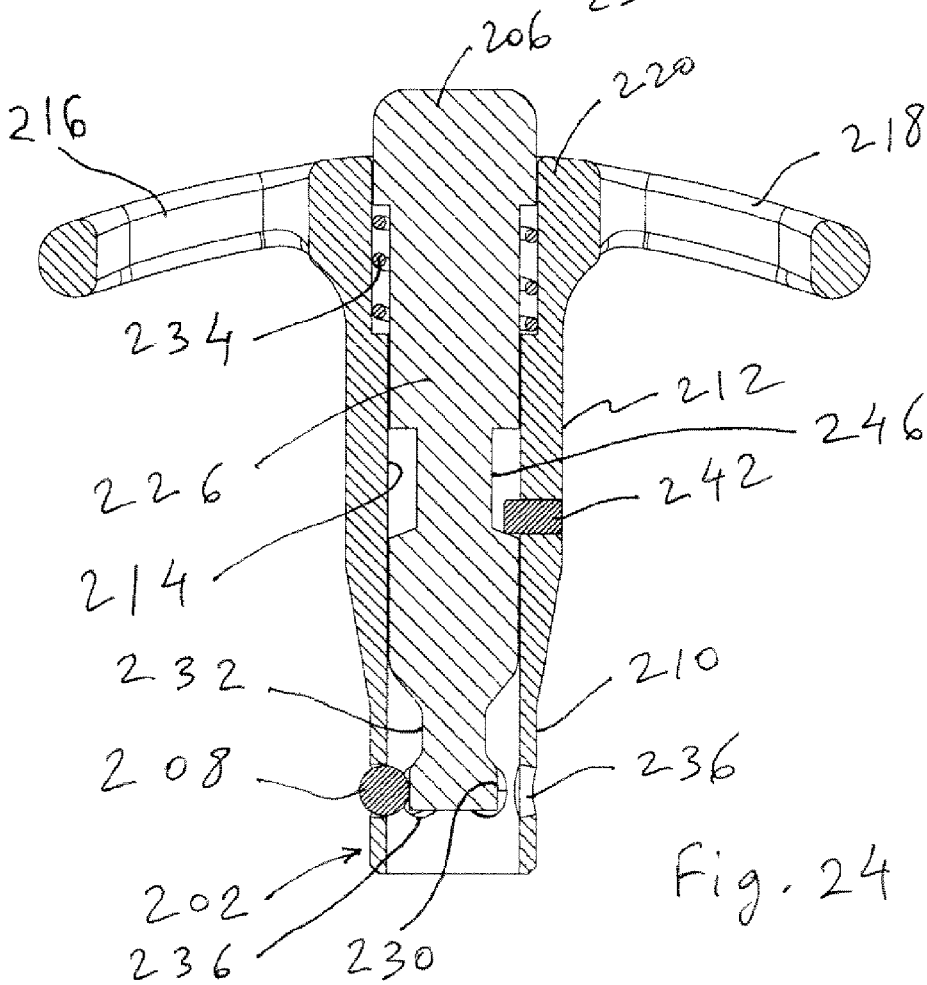
FIG. 24 is a cross sectional view of the first embodiment of a T-handle actuator according to the present invention shown with the pushbutton in the extended position.
Figure 26:
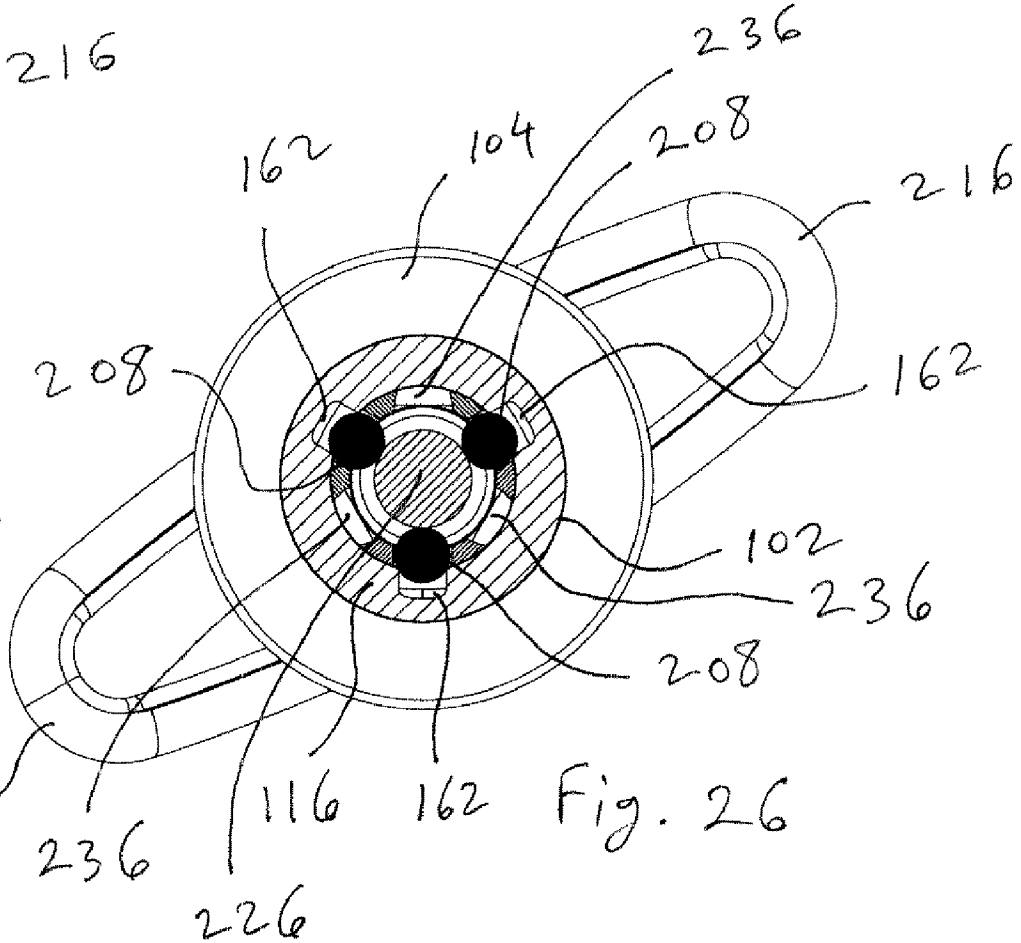
FIG. 26 is a cross sectional view of the first embodiment of a latch assembly and T-handle actuator according to the present invention showing the ball bearings of the T-handle actuator engaging the lateral cavities of the socket of the latch assembly.
Figure 25:
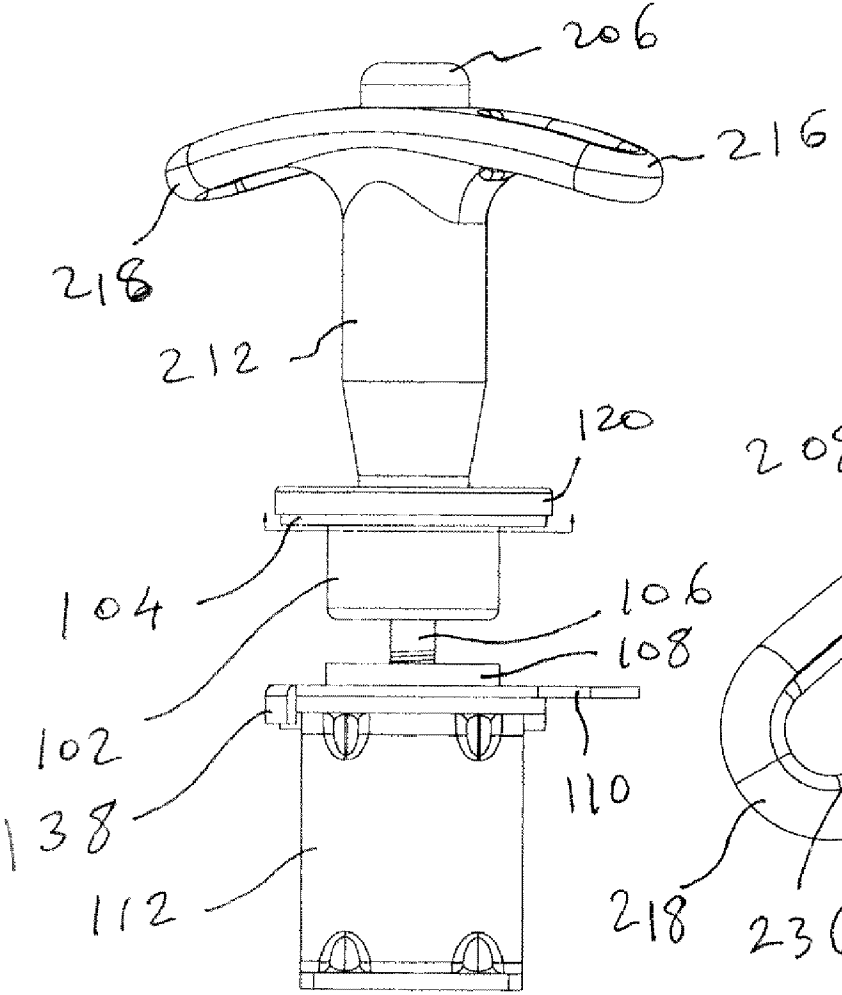
FIG. 25 is a view of the first embodiment of a latch assembly and T-handle actuator according to the present invention showing the T-handle actuator inserted onto the socket of the latch assembly an its pushbutton extended.
Figure 28:
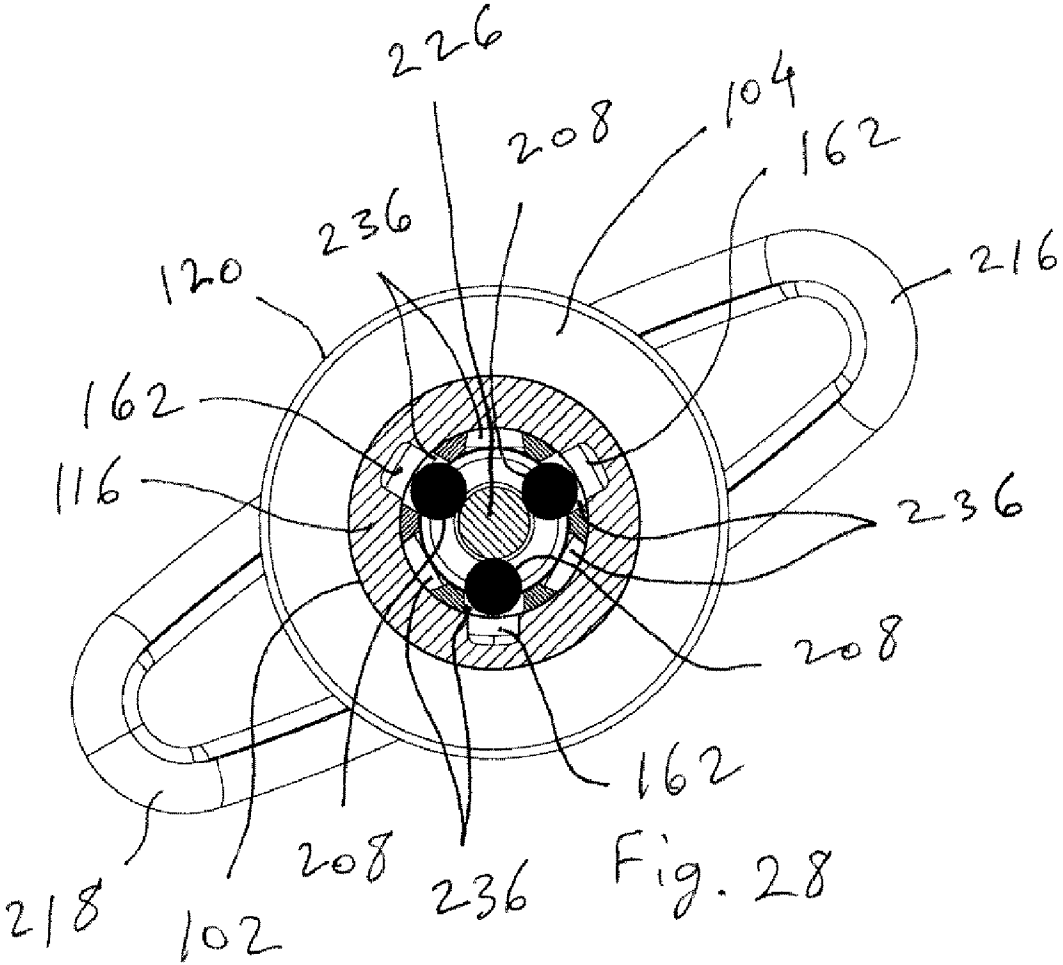
FIG. 28 is a cross sectional view of the first embodiment of a latch assembly and T-handle actuator according to the present invention showing the ball bearings of the T-handle actuator disengaged from the lateral cavities of the socket of the latch assembly.
Figure 27:
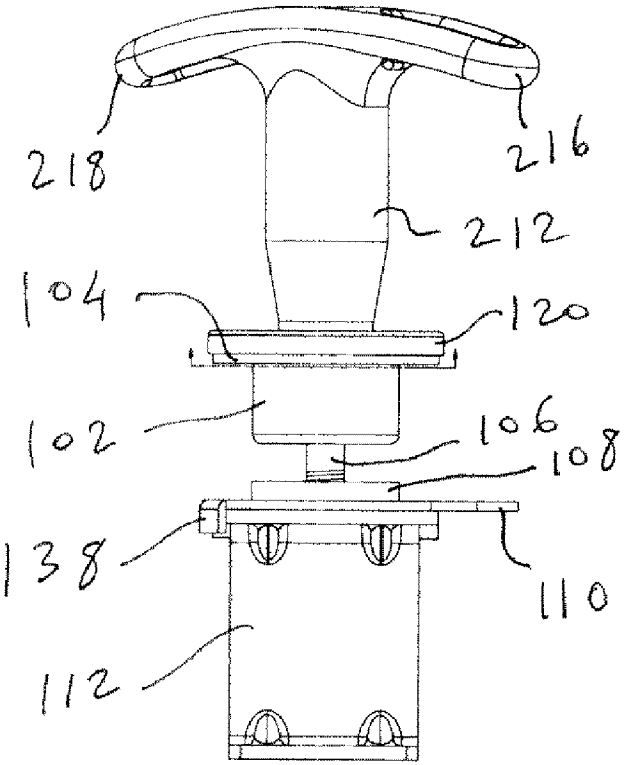
FIG. 27 is a view of the first embodiment of a latch assembly and T-handle actuator according to the present invention showing the T-handle actuator inserted onto the socket of the latch assembly an its pushbutton retracted.
Figure 29:
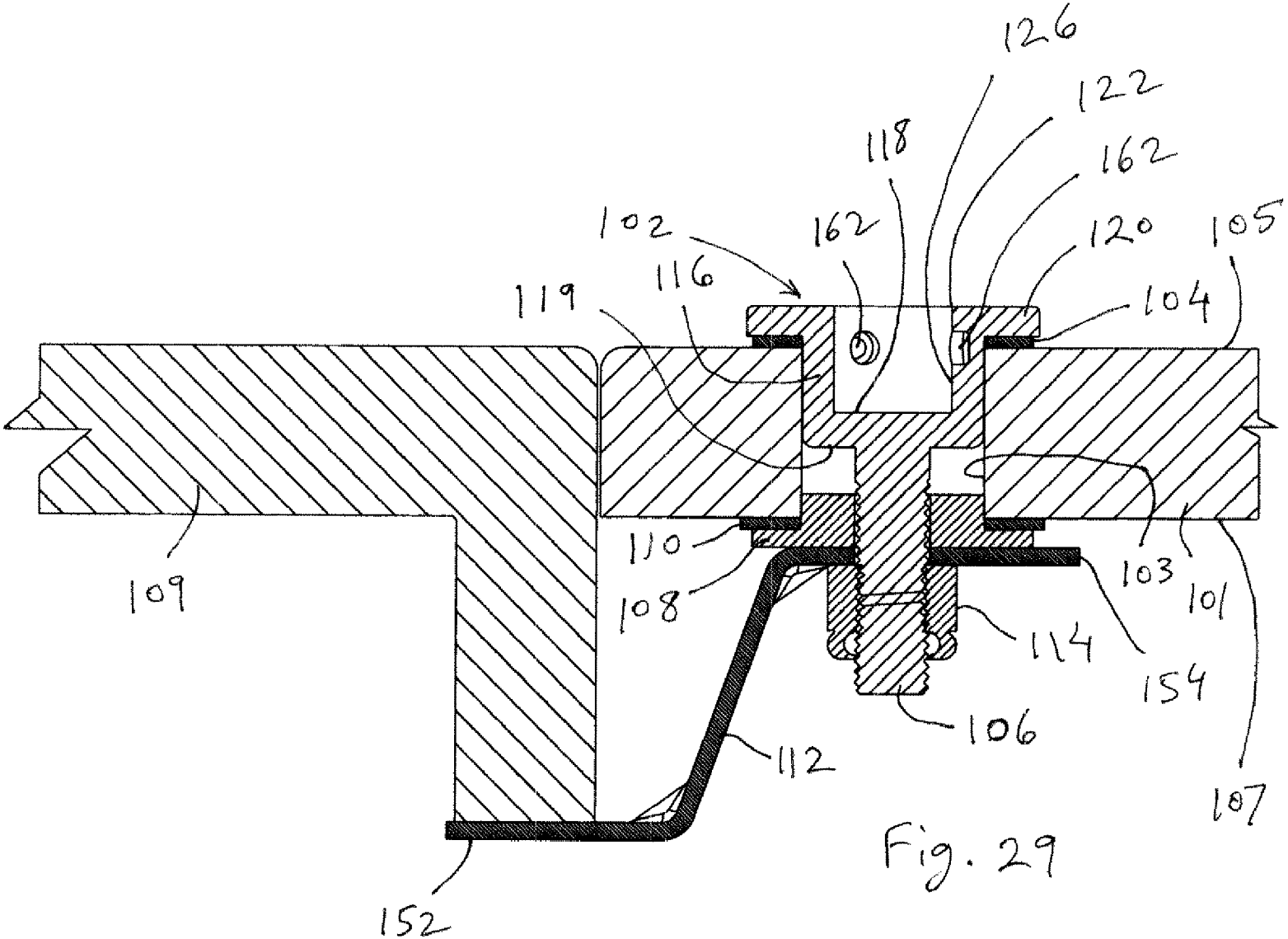
FIG. 29 is a cross sectional environmental view of the first embodiment of a latch assembly according to the present invention shown in the latched configuration.
Figure 30:
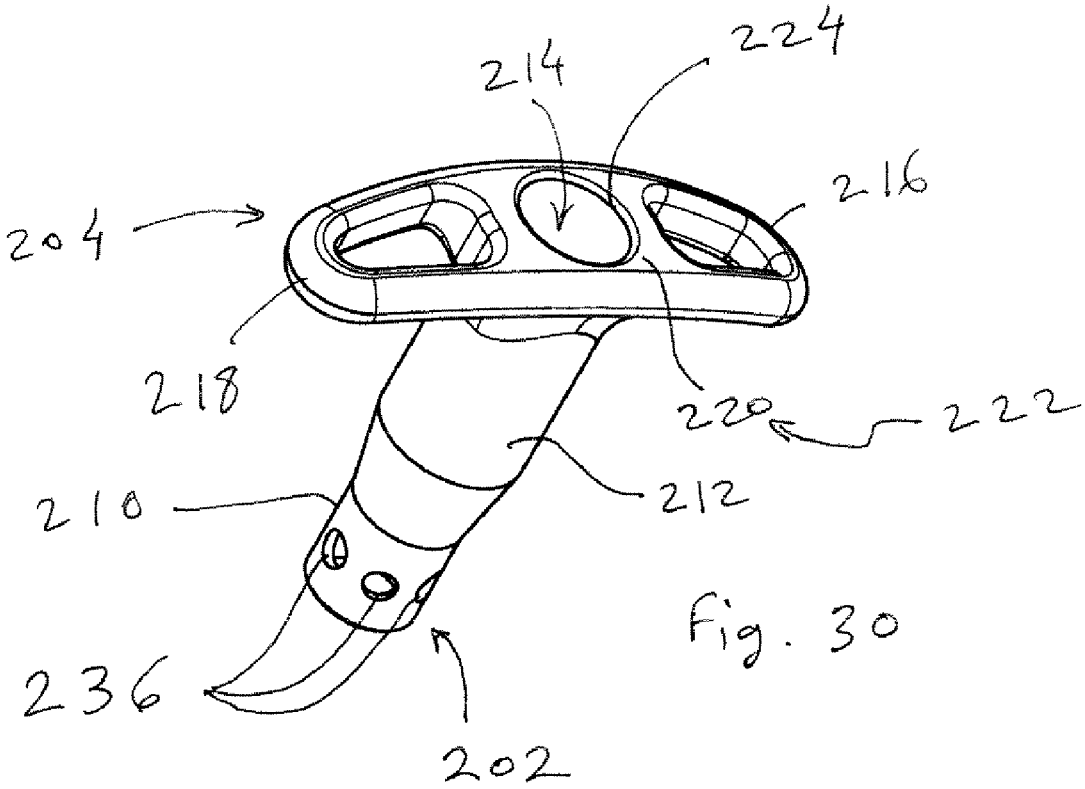
FIGS. 30-33 are views of the sleeve and arms of the first embodiment of a T-handle actuator according to the present invention.
Figure 32:
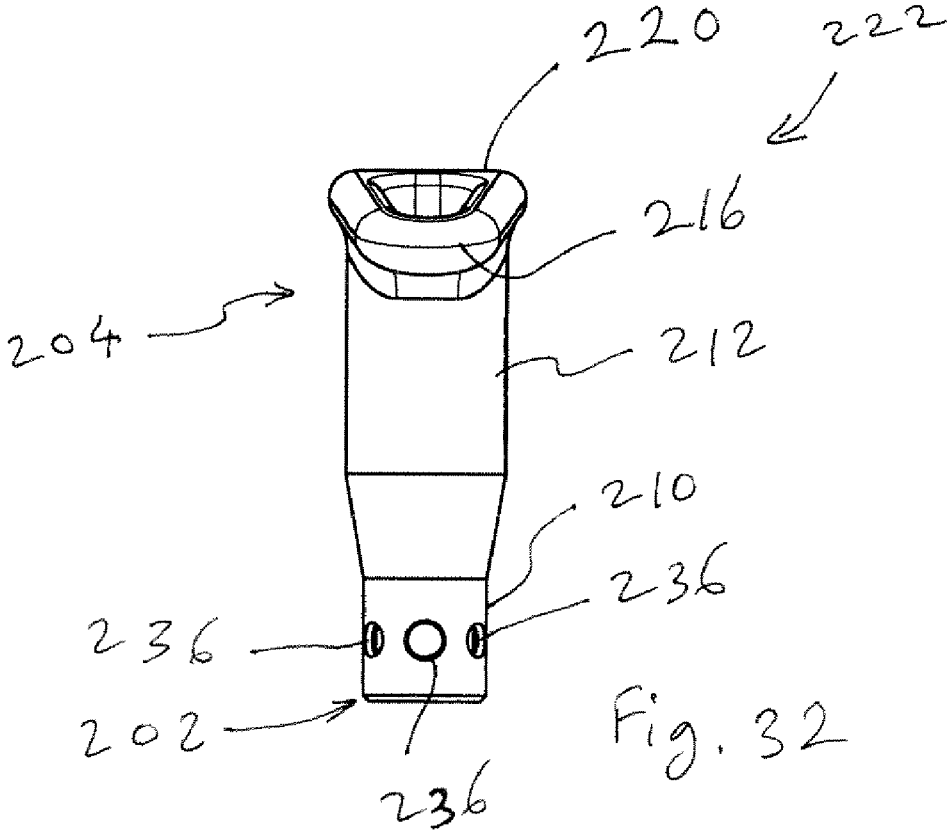
Figure 31:
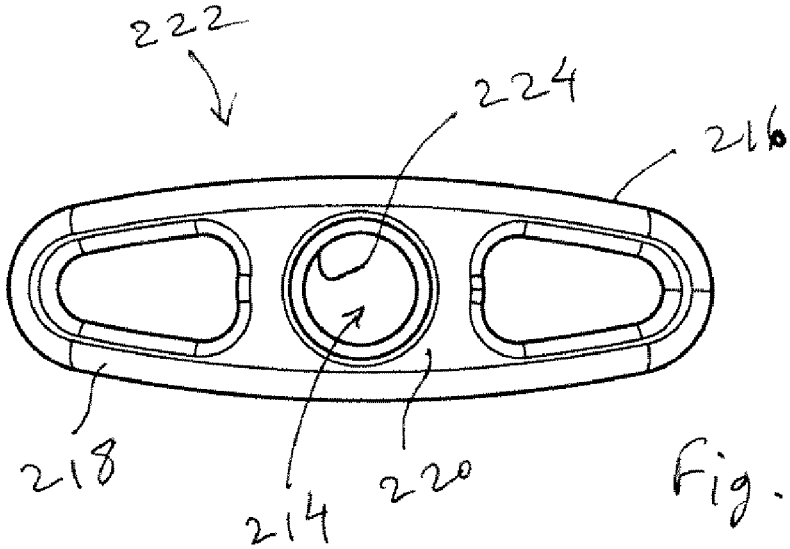
Figure 33:
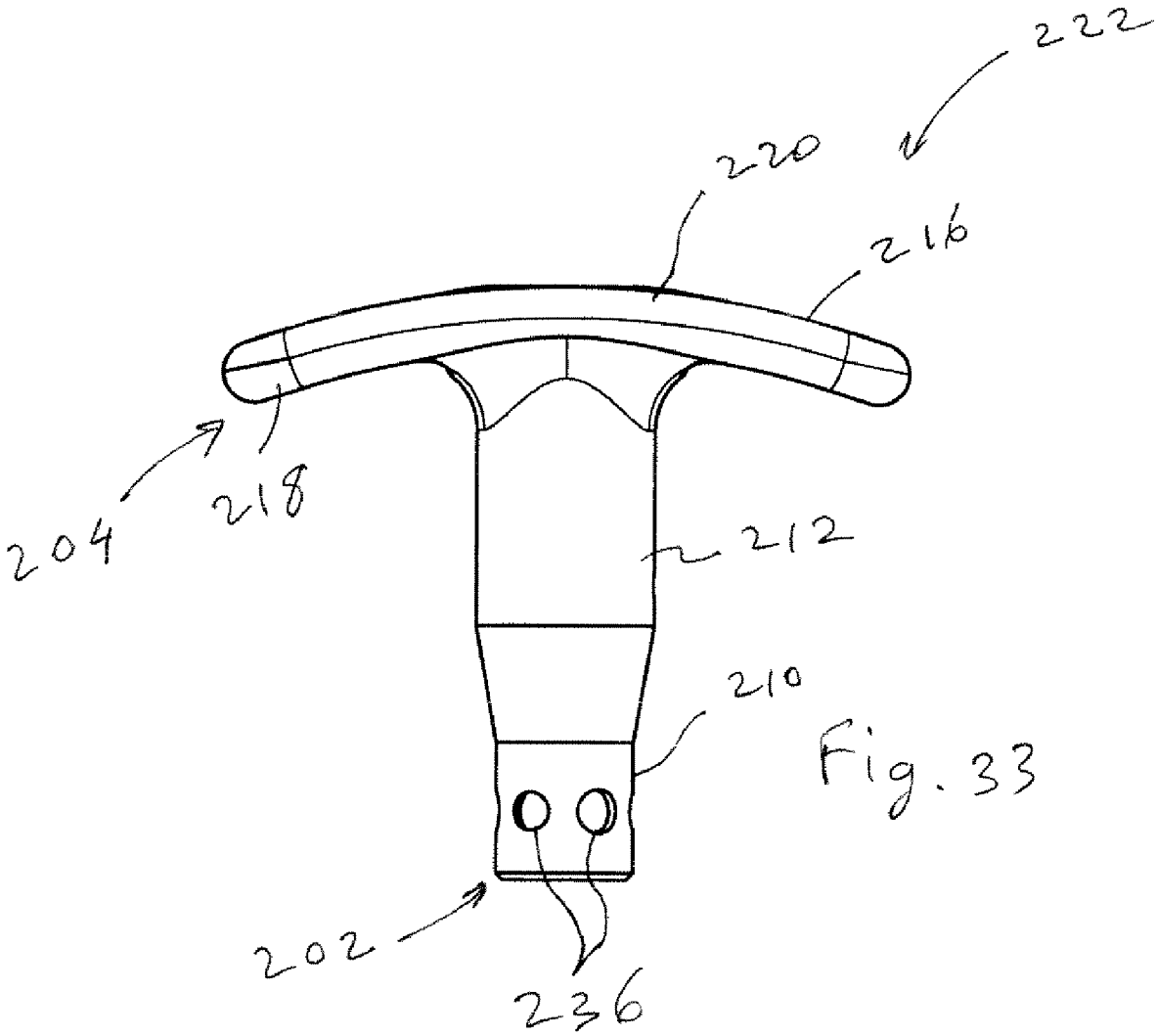
Figure 34:
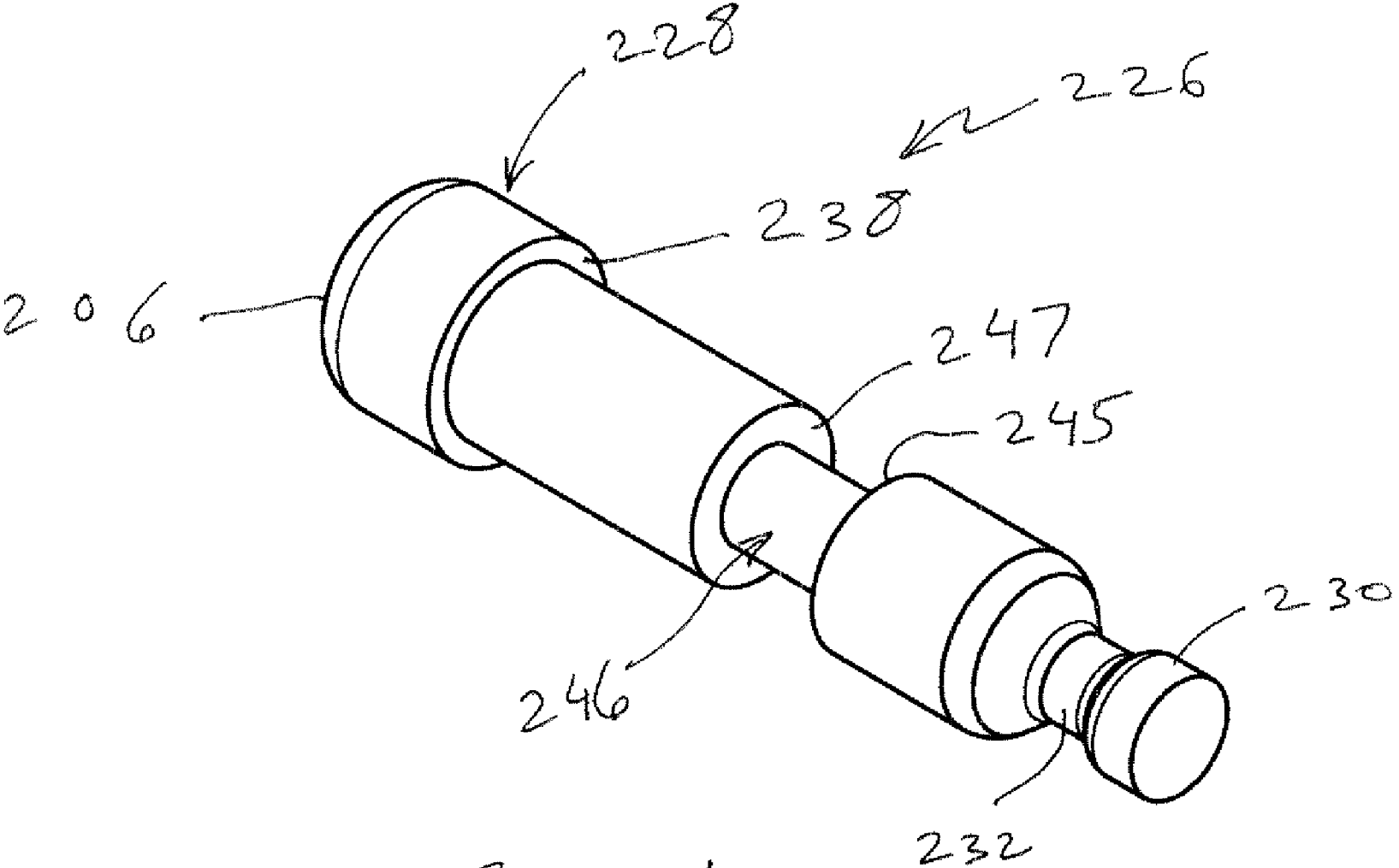
FIG. 34 is a perspective view of the plunger of the first embodiment of a T-handle actuator according to the present invention.
Figure 36:
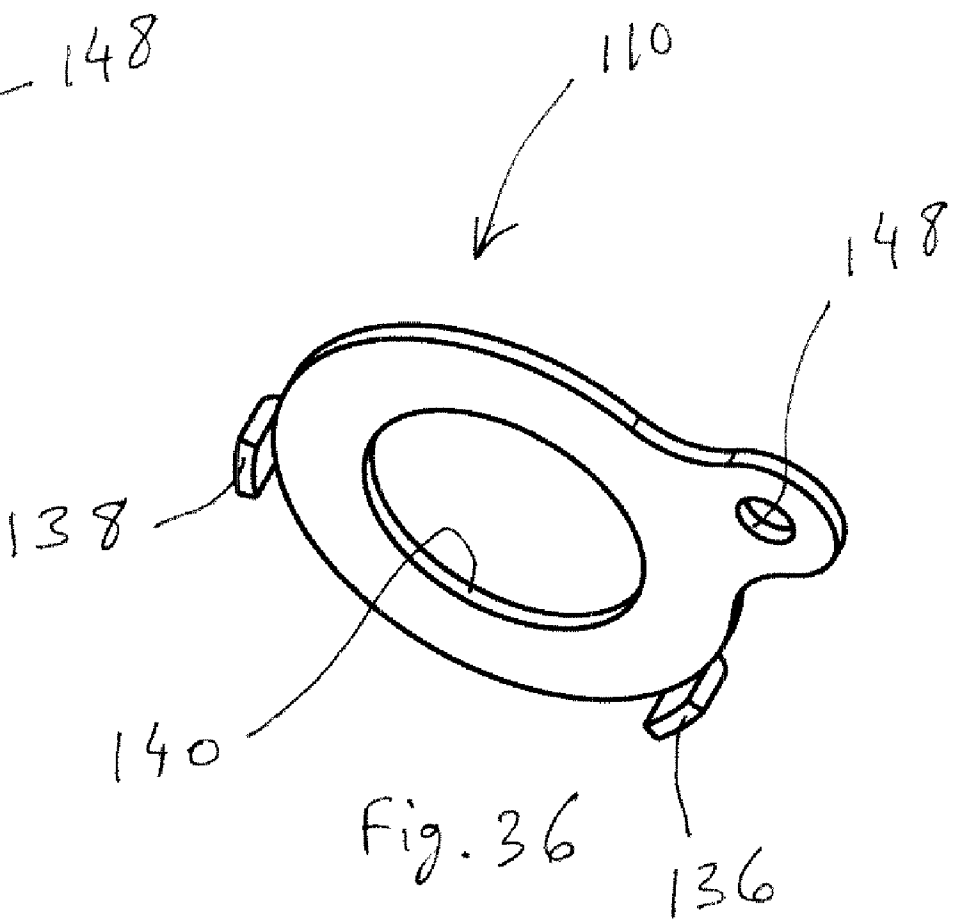
FIGS. 35-36 are views of the guide washer of the first embodiment of a latch assembly according to the present invention.
Figure 35:
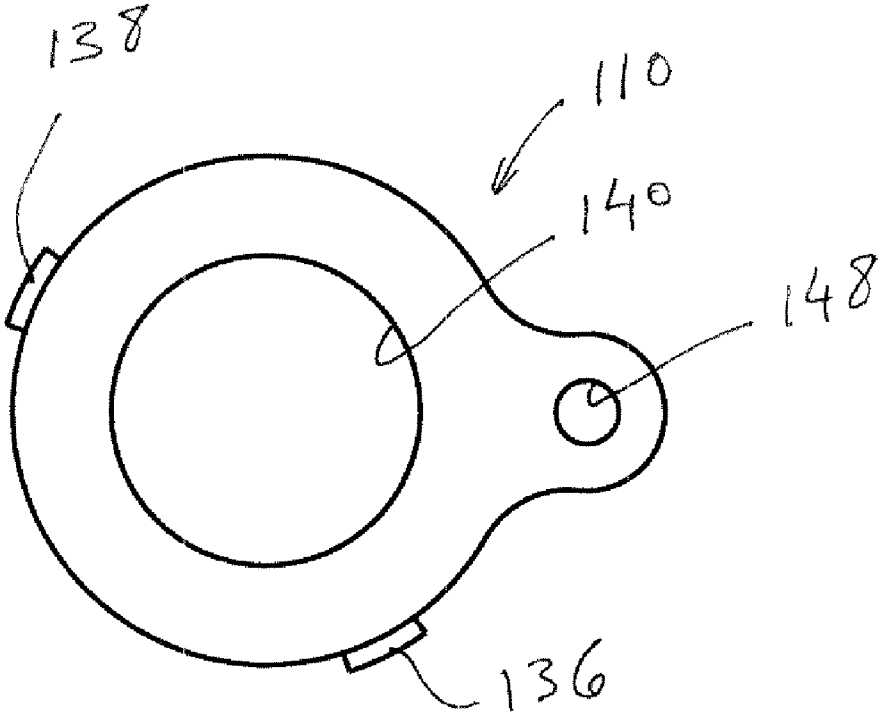
Figure 37:
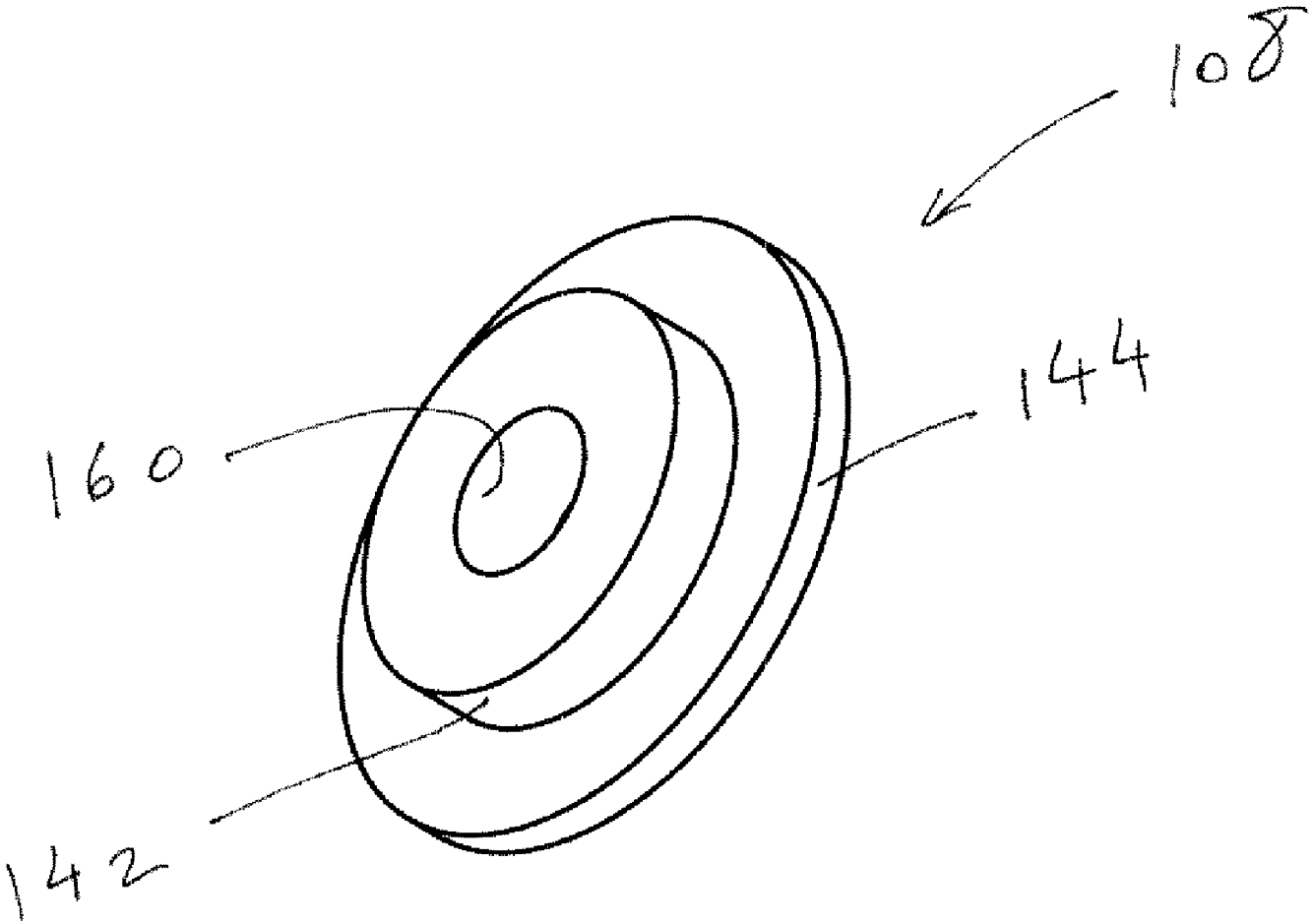
FIG. 37 is a perspective view of the spacer bushing of the first embodiment of a latch assembly according to the present invention.
Figure 39:
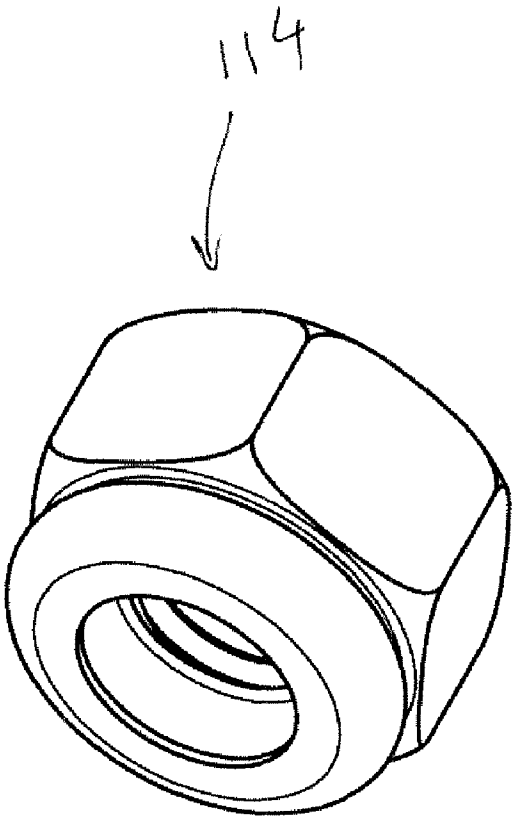
FIGS. 38-39 are views of the nut for securing the pawl of the first embodiment of a latch assembly according to the present invention.
Figure 38:
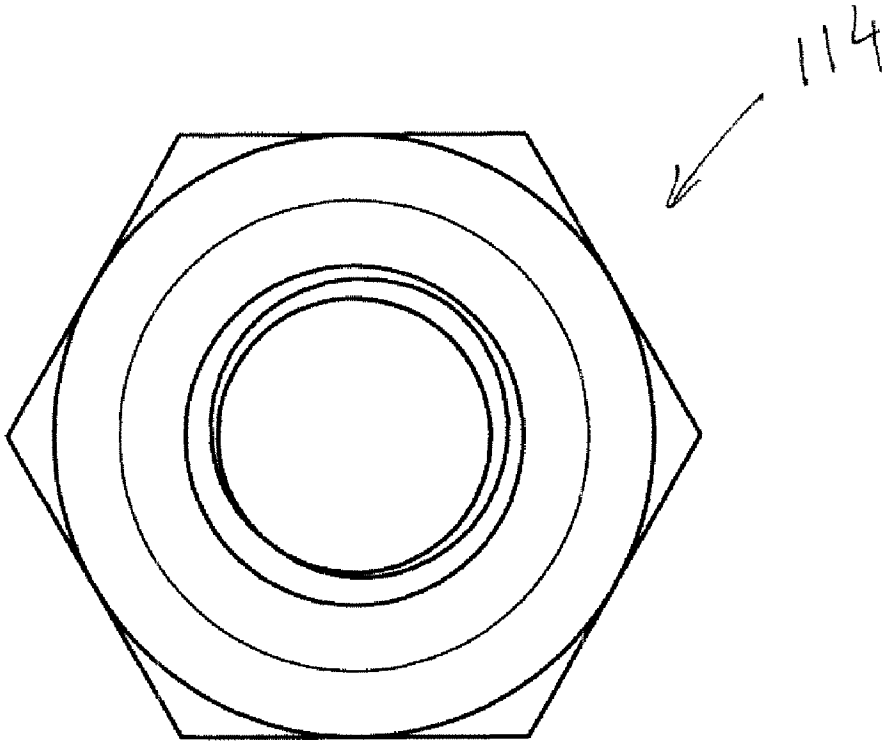
Figure 41:
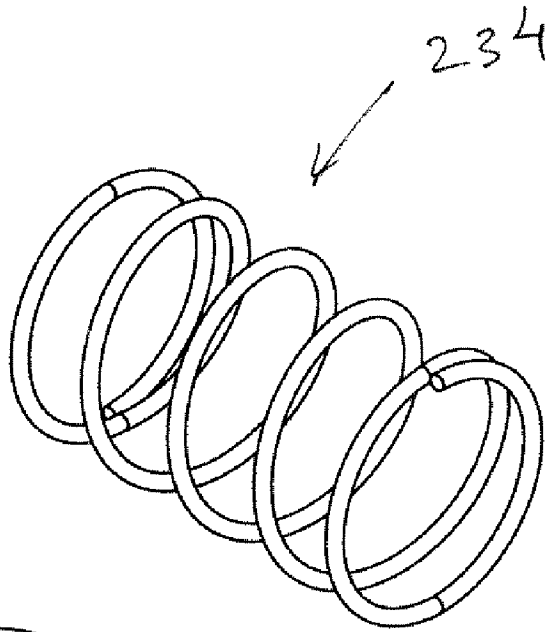
FIGS. 40-42 are views of the spring of the first embodiment of a T-handle actuator according to the present invention.
Figure 42:
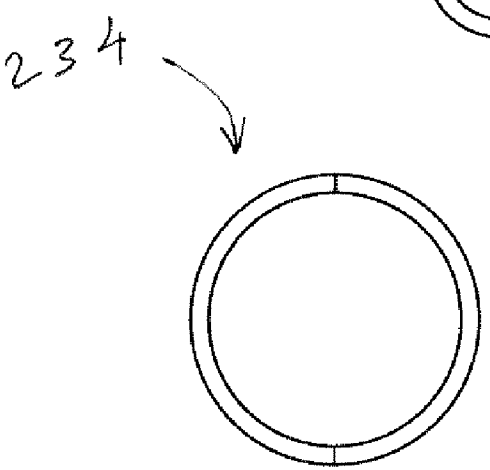
Figure 40:
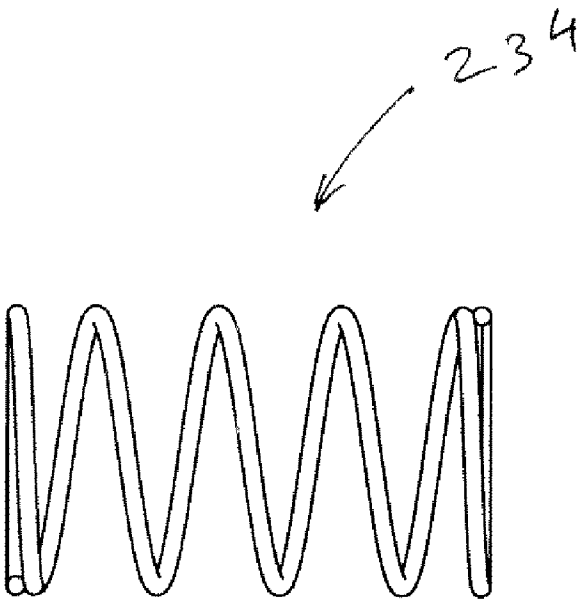

Referring to FIGS. 1-42, the first embodiment of a latch 100 in accordance with the present invention can be seen. The latch 100 includes a drive plug 102, a spacer washer 104, a shaft 106, a spacer bushing 108, a guide washer 110, a pawl 112, and a nut 114. The drive plug 102 can have a hexagonal, square or other non-circular projection that can be engaged and turned by a matching socket type tool. Alternatively, the drive plug 102 can be a hexagonal, square, or any other non-circular socket or hole that can be engaged and turned by a matching male tool such as an Allen wrench or the like. As yet another alternative, the drive plug 102 can include a key-operated lock cylinder that can be turned with an appropriate key. As still another alternative, the drive plug 102 can be provided with a knob or handle for manual turning. Preferably, the drive plug 102 has a cylindrical outer surface 124 extending between a bottom surface 119 and a top flange 120.

The shaft 106 extends from the bottom surface 119 of the drive plug 102 and has a longitudinal axis. The shaft 106 is attached to the drive plug 102 such that the drive plug 102 and the shaft 106 rotate together as a unit about the longitudinal axis of the shaft 106. The shaft 106 has at least a portion with a non-circular cross section.

The pawl 112 is capable of engaging the second closure member 109, which is a doorframe in the illustrated example, to secure the first closure member, in this example the door 101, in the closed position once the latch mechanism 100 is fully assembled and installed to the first closure member 101. The pawl 112 has a hole 150, a latching portion 152, and a motion control tab 154. The latching portion 152 and the motion control tab 154 are located on opposite sides of the hole 150. The shaft 106 extends through the hole 150 of the pawl 112. The hole 150 of the pawl is non-circular and has a size and shape that allows the pawl to be positioned adjustably along the shaft 106, while essentially preventing relative rotation between the pawl 112 and the shaft 106 about the longitudinal axis of the shaft 106.

The guide washer 110 has a center hole 140 and an off-center hole 148. The guide washer 110 also has a pair of axial projections 136 and 138 extending at least in part parallel to the longitudinal axis of the shaft 106. The center hole 140 of the guide washer 110 is large enough so that the shaft 106 can rotate relative to the guide washer 110 without any interference from the portions of the guide washer 110 that define the center hole 140. The latch mechanism 100 includes a fastener 146 capable of engaging the off-center hole 148 of the guide washer 110 and the first closure member 101 to prevent rotation of the guide washer 110 relative to the first closure member 101 in the fully assembled latch mechanism when installed to the first closure member 101. The nut 114 engages the shaft 106 to secure the pawl 112 to the shaft 106.

The latch mechanism 100 is for use with a first closure member 101 having an opening 103 for the installation of the latch mechanism 100. The latch mechanism 100 is capable of selectively securing the first closure member 101 in a closed position relative to a second closure member 109. The drive plug 102 is adapted for engagement by an actuator, key, or tool so as to allow a user to turn the drive plug 102 to operate the latch mechanism 100. The pawl is rotated between a latched position and an unlatched position in response to the rotation of the drive plug 102 between its latched position and its unlatched position. The motion control tab 154 cooperates with the axial projections 136 and 138 of the guide washer 110 to define the limits of the rotational motion of the pawl 112.

In the illustrated example, the drive plug 102 is a socket 102 that is specially designed for engagement and turning by the actuator 200 as is described below. The socket 102 has a cylindrical side wall 116, a bottom 118, and a top flange 120. The socket 102 is essentially in the form of a cup with an open top 122. The top flange 120 is annular and surrounds the open top 122. The cylindrical side wall 116 extends between the top flange 120 and the bottom 118. The cylindrical side wall 116 has an outer surface 124 and an inner surface 126. The cylindrical side wall 116 and the bottom 118 together define the main cavity 128 of the socket 102. The socket 102 has a longitudinal axis that is the same as the longitudinal axis of the cylindrical side wall 116 and the longitudinal axis of the main cavity 128. The main cavity 128 is sized to receive the second end portion 202 of the T-handle actuator 200.

The shaft 106 is attached to the socket 102 and extends from the bottom 118 in a direction away from the main cavity 128 and away from the top flange 120. In the illustrated example, the shaft 106 and the socket 102 are of one-piece construction. The shaft 106 has a threaded portion 130. The threads of the threaded portion 130 are interrupted by two flat surfaces 132 and 134 on either side of the threaded portion 130 of the shaft 106. The flat surfaces or sides 132 and 134 at least in part give the shaft 106 a non-circular cross section.

The latch mechanism 100 is mounted to a first closure member, for example the door 101, that has a cylindrical hole or opening 103 bored through it. The door 101 has an exterior surface 105 and an interior surface 107. The spacer washer 104 is positioned around the opening 103 on the exterior surface of the door 101 such that the spacer washer 104 is in contact with the exterior 105 of the door 101. The shaft 106 and the portion of the socket 102 including most of the cylindrical side wall 116 and the bottom 118 are then inserted through the spacer washer 104 into the opening 103 such that the top flange 120 is on the exterior side of the door 101 and in contact with the spacer washer 104. Accordingly, the spacer washer 104 is positioned between the top flange 120 and the exterior 105 of the door 101. At least a portion of the shaft 106, including at least a portion of the threaded portion 130, is positioned on the interior side of the door 101.

The guide washer 110 is positioned around the opening 103 on the interior surface of the door 101 such that the guide washer 110 is in contact with the interior 107 of the door 101. The axial projections 136 and 138 of the guide washer 110 extend away from the interior surface of the door 101 and the socket 102. The shaft 106 extends through the center hole 140 of the guide washer 110. The guide washer 110 is positioned around the opening 103 on the interior surface of the door 101 such that the axial projections 136 and 138 of the guide washer 110 are positioned to stop the rotation of the pawl 112 at the latched and unlatched positions, respectively. A fastener 146, in this example a self-tapping screw, is inserted into the off-center hole 148 of the guide washer 110 and driven into the door 101 from the interior side and tightened to fix the guide washer 110 in place around the opening 103 and to prevent any relative rotation between the guide washer 110 and the door 101.

A portion of the barrel portion 142 of the spacer bushing 108 is inserted through the center hole 140 of the guide washer 110 and into the opening 103 such that the annular flange 144 of the spacer bushing 108 is on the interior side of the door 101 and in contact with the guide washer 110.

The pawl 112 is capable of engaging the second closure member 109, which is a doorframe in the illustrated example, to secure the first closure member, in this example the door 101, in the closed position once the latch mechanism 100 is fully assembled and installed to the first closure member 101. The pawl 112 has a hole 150, a latching portion 152, and a motion control tab 154. The latching portion 152 and the motion control tab 154 are located on opposite sides of the hole 150. The shaft 106 extends through the hole 150 of the pawl 112. The hole 150 of the pawl is non-circular and has a size and shape that allows the pawl to be positioned adjustably along the shaft 106, while essentially preventing relative rotation between the pawl 112 and the shaft 106 about the longitudinal axis of the shaft 106 through the engagement of the straight sides 156 and 158 of the hole 150 with the flat sides 132 and 134 of the shaft 106. Accordingly, the pawl 112 is coupled to the shaft 106 such that the pawl 112 rotates in response to the rotation of the shaft 106.

Sufficient clearance is provided between the hole 150 of the pawl 112 and the cross sectional perimeter of the shaft 106 at any point along the threaded portion 130, so that the pawl 112 can be moved rectilinearly along the threaded portion 130 of the shaft 106 in a direction parallel to the longitudinal axis of the shaft 106 in order to adjust the position of the pawl 112 on the shaft 106 to accommodate doors of various thicknesses. This clearance may allow some rotational play between the pawl 112 and the shaft 106 about the longitudinal axis of the shaft 106. However, this play, if there is any, is inconsequential to the operation of the latch mechanism and relatively small compared to the degree of rotation required for moving the pawl 112 between the latched position and the unlatched position. The language, "preventing relative rotation," or "essentially preventing relative rotation," as used in this application is intended to encompass those instances where there may be some minor amount of motion such as that which is incidental to the non-zero finite clearances between parts.

The pawl 112 can be coupled to the shaft 106, such that the pawl 112 rotates in response to the rotation of the shaft 106, in ways that do not require direct contact between the pawl 112 and the shaft 106. For example, a sleeve (not shown), perhaps of a polymeric or plastic material, having an outer perimeter matching the straight sides 156 and 158 of the hole 150 and an inner bore matching the flat sides 132 and 134 of the shaft 106 can be positioned between the hole 150 and the shaft 106 to rotationally couple the pawl 112 to the shaft 106, such that the pawl 112 rotates in response to the rotation of the shaft 106. The aforementioned sleeve may be part of the spacer bushing 108.

With the threaded portion 130 of the shaft 106 extending through the hole 150 of the pawl 112, the portion of the pawl 112 surrounding the hole 150 is positioned in contact with the annular flange 144 of the spacer bushing 108 while the pawl 112 is itself in a position corresponding to its latched position, its unlatched position, or a position intermediate the latched and unlatched positions. The threaded portion 130 of the shaft 106 should extend sufficiently beyond the hole 150 of the pawl 112, in the direction away from the socket 102, to allow the proper engagement of the nut 114 to the threaded portion 130 of the shaft 106. The nut 114 is tightened down on the pawl 112 to secure the parts of the latch 100 together and to secure the latch 100 to the door 101.

The latch mechanism 100 can be used to selectively secure the door 101 in the closed position, illustrated in FIGS. 1-7, relative to the doorframe 109. A user can turn the socket 102 between a latched position, illustrated in FIGS. 1-7, and an unlatched position, illustrated in FIGS. 8-12, using the actuator 200.

Referring to FIGS. 1-7, the pawl 112 can be seen in the latched position behind the doorframe 109. In this position the pawl 112, in particular the latching portion 152 of the pawl 112, would engage the doorframe 109 and prevent the door 101 from being opened if an attempt was made to do so. To open the door 101, a user turns the socket 102 using the actuator 200 from the latched position to the unlatched position thereby rotating the pawl 112 from the latched position to the unlatched position, shown in FIGS. 8-12, where the latching portion 152 of the pawl 112 no longer overlaps any part of the doorframe 109. The door 101 can now be opened because the pawl 112 can no longer engage the doorframe 109. As the pawl 112 reaches the unlatched position, the tab 154 of the pawl 112 contacts the axial projection 138, which stops further rotation of the pawl 112.

To once again secure the door 101 in the closed position, the user rotates the socket 102 from the unlatched position to the latched position with the door 101 closed using the actuator 200. As the socket 102 is rotated from the unlatched position to the latched position, the pawl 112 is rotated from the unlatched position of FIGS. 8-12 to the latched position of FIGS. 1-7 where the latching portion 152 of the pawl 112 moves behind the doorframe 109, thus securing the door 101 in the closed position. As the pawl 112 reaches the latched position, the tab 154 of the pawl 112 contacts the axial projection 136, which stops further rotation of the pawl 112.

The spacer bushing 108 has a barrel portion 142 sized to fit in the opening 103 in the door 101 and an annular flange 144 that fits between the guide washer 110 and the pawl 112. The spacer bushing 108 also has a bore 160 extending through the spacer bushing 108, and the shaft 106 extends through the bore 160 of the spacer bushing 108. The spacer bushing 108 is made of relatively softer material, for example polymeric material, plastics, composites, or soft metals, to prevent excessive wear between the guide washer 110 and the pawl 112.

The spacer washer 104 is positioned under the top flange 120 of the socket 102 and fits around the outer surface 124 of the socket 102. The spacer washer 104 fits between the top flange 120 of the socket 102 and the exterior surface 105 of the door 101 to allow the socket 102 to rotate relative to the door 101 without damaging the exterior surface 105 of the door once the latch mechanism 100 is fully assembled and installed to the door 101. The spacer washer 104 is also preferably made of softer material such as those listed for the spacer bushing 108.

Referring to FIGS. 6-19, 21-28, 30-34, and 40-42, a latch actuator 200 for use with the latch mechanism 100 can be seen. The latch mechanism 100 has a socket 102 that is moved rotationally to operate the latch mechanism 100, as has already been described. The socket 102 has a main cavity 128 that has a wall 116. The wall 116 has at least one lateral cavity 162 in it. The opening of each lateral cavity 162 faces toward the interior of the main cavity 128. In other words, the opening of each lateral cavity 162 faces toward the longitudinal axis of the socket 102. In the illustrated example, the socket 102 is provided with three lateral cavities 162 distributed evenly, at about 120° intervals center-to-center, about the longitudinal axis of the socket 102 at the same distance from the bottom 118 of the socket 102.

The actuator 200 includes a T-shaped handle portion 204, a distal end or second end portion 202, a pushbutton 206, and at least one ball bearing 208. In the illustrated example, the actuator 200 is provided with three ball bearings 208 in positions corresponding to the positions of the lateral cavities 162 when the distal end 202 is inserted into the main cavity 128. Accordingly, the three ball bearings 208 are distributed evenly, at approximately 120° intervals center-to-center, about the longitudinal axis of the actuator 200 at the same axial position along the longitudinal axis of the actuator 200.

The T-shaped handle portion 204 is for grasping by a user. The distal end portion 202 is distal from the handle portion 204 and is adapted for insertion into the socket 102. The distal end portion 202 has an exterior surface 210. The pushbutton 206 is supported by the handle portion 204 for movement between an extended position shown in FIGS. 24, 25, and 26, and a retracted position shown in FIGS. 22, 27 and 28. The ball bearings 208 are movably supported by the distal end portion 202 such that the ball bearings 208 are each movable between an extended position and a retracted position. Each ball bearing 208 projects outward from the exterior surface 210 of the distal end 202 when the ball bearing 208 is in the extended position. Each ball bearing 208 does not project outward from the exterior surface 210 of the distal end 202 when the ball bearing 208 is in the retracted position. Each ball bearing 208 is maintained in its extended position when the pushbutton 206 is in its extended position. Each ball bearing is free to move to its retracted position when the pushbutton 206 is pushed in by a user to its retracted position. Each ball bearing 208 is capable of engaging a corresponding lateral cavity 162 of the socket 102 such that the socket 102 will turn as the handle portion 204 is turned by a user when each ball bearing 208 is in its extended position. A user holds the pushbutton 206 in the retracted position to allow the ball bearings 208 to retract in order to insert the distal end 202 into the socket 102 and in order to withdraw the distal end 202, and consequently remove the actuator 200, from the socket 102. Once the distal end 202 is properly inserted, the user releases the pushbutton 206 allowing it to move to its extended position under spring bias. Each ball bearing 208 then engages a corresponding lateral cavity 162 of the socket 102, and the user can then turn the socket 102 to operate the latch mechanism 100 to latch and unlatch the door 101 using the T-handle actuator 200.

The T-handle actuator 200 will now be described in greater detail. The latch actuator 200 includes a sleeve 212, a pair of lateral arms 216 and 218, a plunger 226, a spring 234, and at least one ball bearing 208. The sleeve 212 has a bore 214 extending along the longitudinal axis of the sleeve 212. The pair of lateral arms 216 and 218 is provided at a first end portion 220 of the sleeve 212. The lateral arms 216 and 218 extend in opposite directions from the first end portion 220 of the sleeve 212 so as to form a T-shaped configuration with the sleeve 212 to thereby define a T-handle 222. The arms 216 and 218 and the sleeve 212, excluding the second end portion 202, define the T-handle portion 204. The sleeve 212 has a hole 224 at its first end portion 220 that communicates with the bore 214. The hole 224 is located intermediate the lateral arms 216 and 218.

The plunger 226 is supported for rectilinear motion in the bore 214. The plunger 226 is rectilinearly movable between an extended position and a retracted position. The plunger 226 has a button portion 228 that projects outward from the hole 224 when the plunger 226 is in the extended position so as to define a pushbutton 206. The pushbutton 206 is movable between an extended position corresponding to the extended position of the plunger 226 and a retracted position corresponding to the retracted position of the plunger 226.

A user can move the plunger 226 to the retracted position by pushing the pushbutton 206 inward relative to the bore 214. The plunger 226 has at least one portion of a first diameter 230 and at least one portion of a second diameter 232. The first diameter is larger than the second diameter. The spring 234 biases the plunger 226 toward its extended position.

In the illustrated embodiment, actuator 200 has three ball bearings 208. Each ball bearing 208 is received at least in part within the bore 214 of the sleeve 212. The sleeve 212 has a second end portion 202 distal from the lateral arms 216 and 218 that is dimensioned for insertion into the main cavity 128 of the socket 102. The sleeve 212 has at least one lateral opening 236 in the second end portion 202 of the sleeve 212. In the illustrated example, the sleeve 212 has six lateral openings 236 in the second end portion 202 of the sleeve 212, three of which correspond to the three ball bearings 208. The sleeve 212 has an exterior surface 210, and each lateral opening 236 extends between the bore 214 and the exterior surface 210. Each ball bearing 208 is in registry with a corresponding lateral opening 236. Each ball bearing 208 is movable between an extended position and a retracted position. Each ball bearing 208 projects outward in part from the exterior surface 210 when the ball bearing 208 is in its extended position. Each and every ball bearing 208 is in its extended position when the pushbutton 206 and consequently the plunger 226 are in their extended positions. The portion 230 of the plunger 226 having the first diameter is in registry with the ball bearings 208 to thereby maintain all the ball bearings 208 in their extended positions, when the plunger 226 and the pushbutton 206 are in their extended positions. The portion 232 of the plunger 226 having the second diameter is in registry with the ball bearings 208 to thereby allow movement of all the ball bearings 208 to their retracted positions, when the pushbutton 206 and consequently the plunger 226 are in their retracted positions.

When the second end portion 202 of the sleeve 212 is inserted into the socket 102 with each lateral opening 236, corresponding to a ball bearing 208, being in registry with a corresponding lateral cavity 162 in the socket 102 and with the plunger 226 and the pushbutton 206 in their extended positions, each and every ball bearing 208 will be in its extended position and will project in part into its corresponding lateral cavity 162 in the socket 102. Under these conditions, the ball bearings 208 can engage the corresponding lateral cavities 162 such that a user can turn the socket 102 and thus operate the latch mechanism 100 by turning the T-handle actuator 200.

When the second end portion 202 of the sleeve 212 is inserted into the socket 102 with each lateral opening 236, corresponding to a ball bearing 208, being in registry with a corresponding lateral cavity 162 in the socket 102 and with the plunger 226 and the pushbutton 206 in their extended positions, a user can push in the pushbutton 206 to its retracted position to allow movement of the ball bearings 208 to their retracted positions and thereby allow the latch actuator 200 to be removed from the socket 102.

In the latch actuator 200, the spring 234 is a coil spring 234 and the plunger 226 extends through the coil spring 234. The plunger 226 has an annular step 238 and the sleeve 212 has an annular step 240. The annular step 238 of the plunger 226 is positioned intermediate the button portion 228 and the annular step 240 of the sleeve 212. The coil spring 234 extends between the annular step 238 of the plunger 226 and the annular step 240 of the sleeve 212 to thereby bias the plunger 226 and the pushbutton 206 to their extended positions.

In the latch actuator 200, a pin 242 passing through the wall 244 of the sleeve 212 engages a groove 246 in the plunger 226 in order to at least limit the outward movement of the plunger 226 relative to the sleeve 212. This arrangement prevents the plunger 226 from moving past its extended position in the direction of the plunger's movement from its retracted position to its extended position, and thus this arrangement prevents the plunger 226 from being ejected from the sleeve 212. In the illustrated embodiment, the groove 246 is annular and the pin 242 hits one side 245 of the groove 246 to limit the outward movement of the pushbutton 206 and the other side 247 of the groove 246 to limit the inward movement of the pushbutton 206. Alternatively, the groove 246 could be longitudinal with the pin 242 being captured between its ends to limit the range of motion of the plunger 226 and consequently the range of motion of the pushbutton 206. Furthermore, the annular step 238, the coil spring 234, and the annular step 240 can act to limit the inward movement of the pushbutton 206 in a variation of the illustrated design. In such a case, only the side of the groove 246 farthest from the pushbutton 206 would be required to limit the outward movement of the pushbutton 206 in cooperation with the pin 242.

The diameter of the portion 232 of the plunger 226 is selected such that each ball bearing 208 extends in part into its corresponding lateral opening 236 in the wall of the sleeve 212 even when the ball bearing 208 is in its retracted position. This arrangement ensures that each ball bearing 208 will remain in substantial alignment with its corresponding lateral opening 236 so that each ball bearing 208 is properly positioned, even when retracted, to return to its extended position when the plunger 226 returns to its extended position.

In the illustrated embodiment, the lateral arms 216 and 218 are in the form of U-shaped bars having a bend portion 248 extending between two lateral bar portions 250 and 252. Each of the lateral bar portions 250 and 252 has a distal end portion 254 and 256, respectively, that is distal from the corresponding bend portion 248. The distal end portion 254 and 256 of every one of the lateral bar portions 250 and 252 is attached to the first end portion 220 of the sleeve 212, thereby providing for the attachment of the attachment of the lateral arms 216 and 218 to the first end portion 220 of the sleeve 212. Accordingly, each of the lateral arms 216 and 218 is open in the middle.

From the detailed description of the actuator 200, it should be apparent that each and every one of the ball bearings 208 must be in its extended position for the plunger 226 to be in its extended position. If even one of the ball bearings 208 is blocked from returning to its extended or protruding position, then the plunger 226 cannot return to its extended position.

Therefore, if all of the ball bearings positioned within the main cavity 128 of the socket 102 are not simultaneously in alignment with corresponding lateral cavities 162 such that the inner lateral wall surface 126 of the socket 102 blocks at least one ball bearing from its extended position, then the plunger 226 cannot move to its extended position where it would maintain the ball bearings 208 in engagement with their corresponding lateral cavities 162 and the latch actuator 200 could not be used to turn the socket 102 and the pawl 112 between their latched positions and their unlatched positions. This fact provides an opportunity for providing the latch mechanisms according to the present invention with a greater capability to discriminate between authorized and unauthorized users.

Different individual latch mechanisms according to the present invention can be provided with different pluralities of lateral cavities 162 of different predetermined numbers distributed in different predetermined patterns of locations over the inner lateral wall surfaces 126 of their sockets 102. Corresponding T-handle actuators would have different pluralities of lateral openings 236 in different numbers and patterns of locations with at least some matching the number and pattern of locations of the plurality of lateral cavities 162 of the socket 102 of their corresponding latch mechanism. Also, the corresponding T-handle actuators would have pluralities of ball bearings 208 provided in the bore 214 of their sleeves 212 in different numbers matching the number of the plurality of lateral cavities 162 of their respective sockets 102. Of course, in each T-handle actuator each of its plurality of ball bearings 208 would be in substantial alignment with a corresponding one of the plurality of lateral openings 236 of its sleeve 212. Accordingly, the T-handle actuator for one latch mechanism may not used to operate the other latch mechanism as long as all the ball bearings 208 of the T-handle actuator cannot be simultaneously aligned with lateral cavities 162 in the socket of the other latch mechanism.

Figure 43:
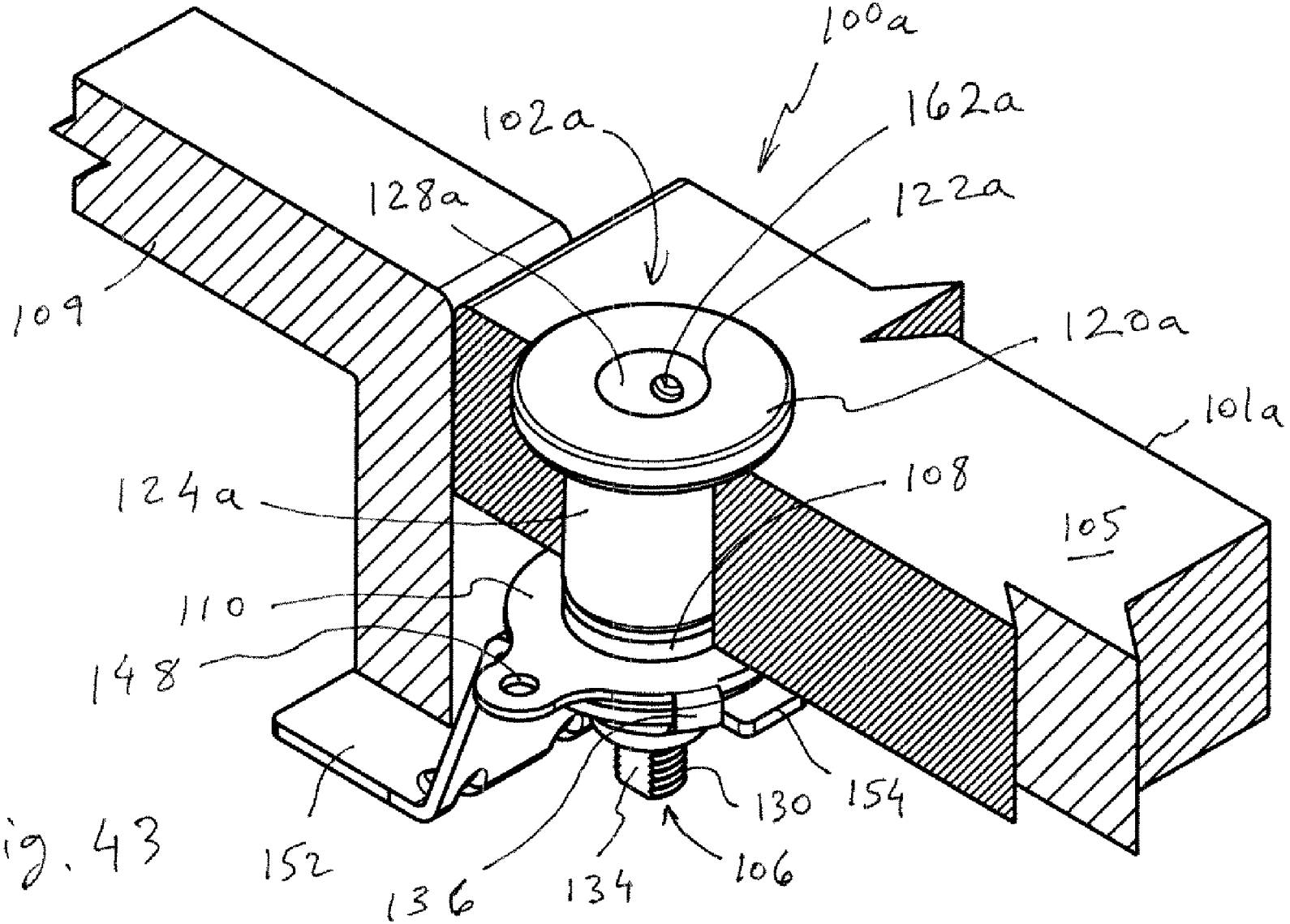
FIGS. 43-45 are environmental views of the second embodiment of a latch assembly according to the present invention shown in the latched configuration.
Figure 44:
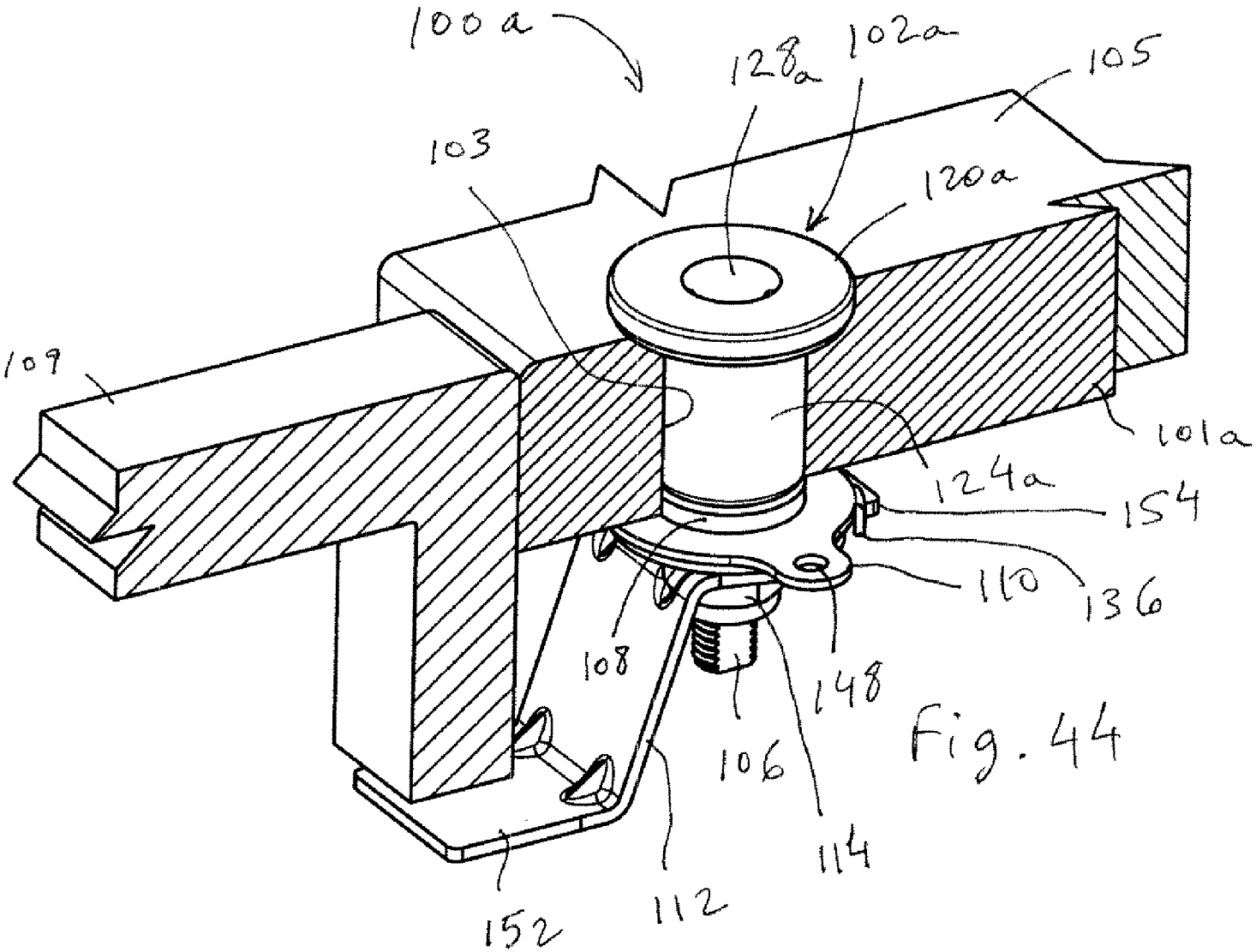
Figure 45:
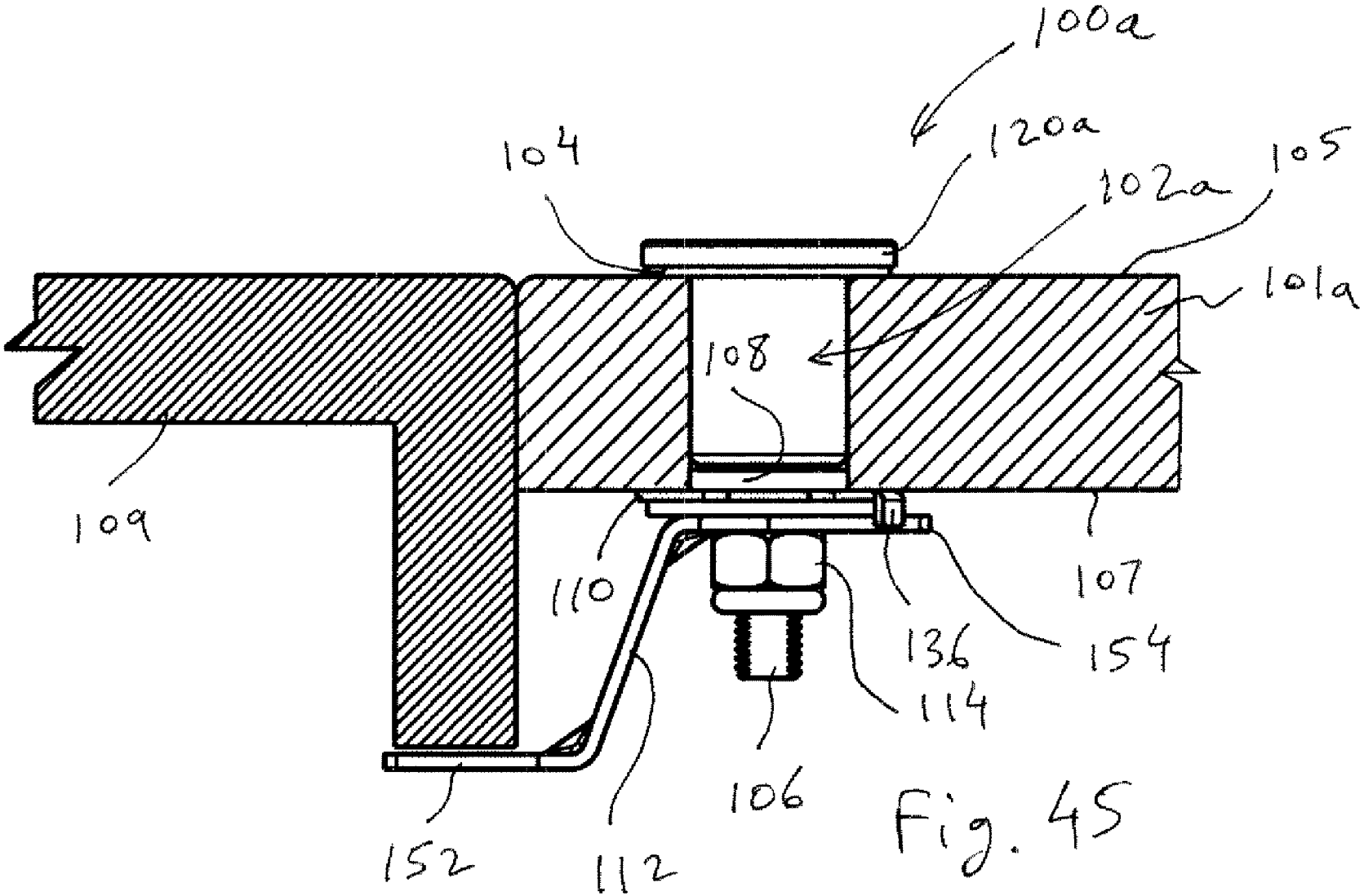
Figure 46:
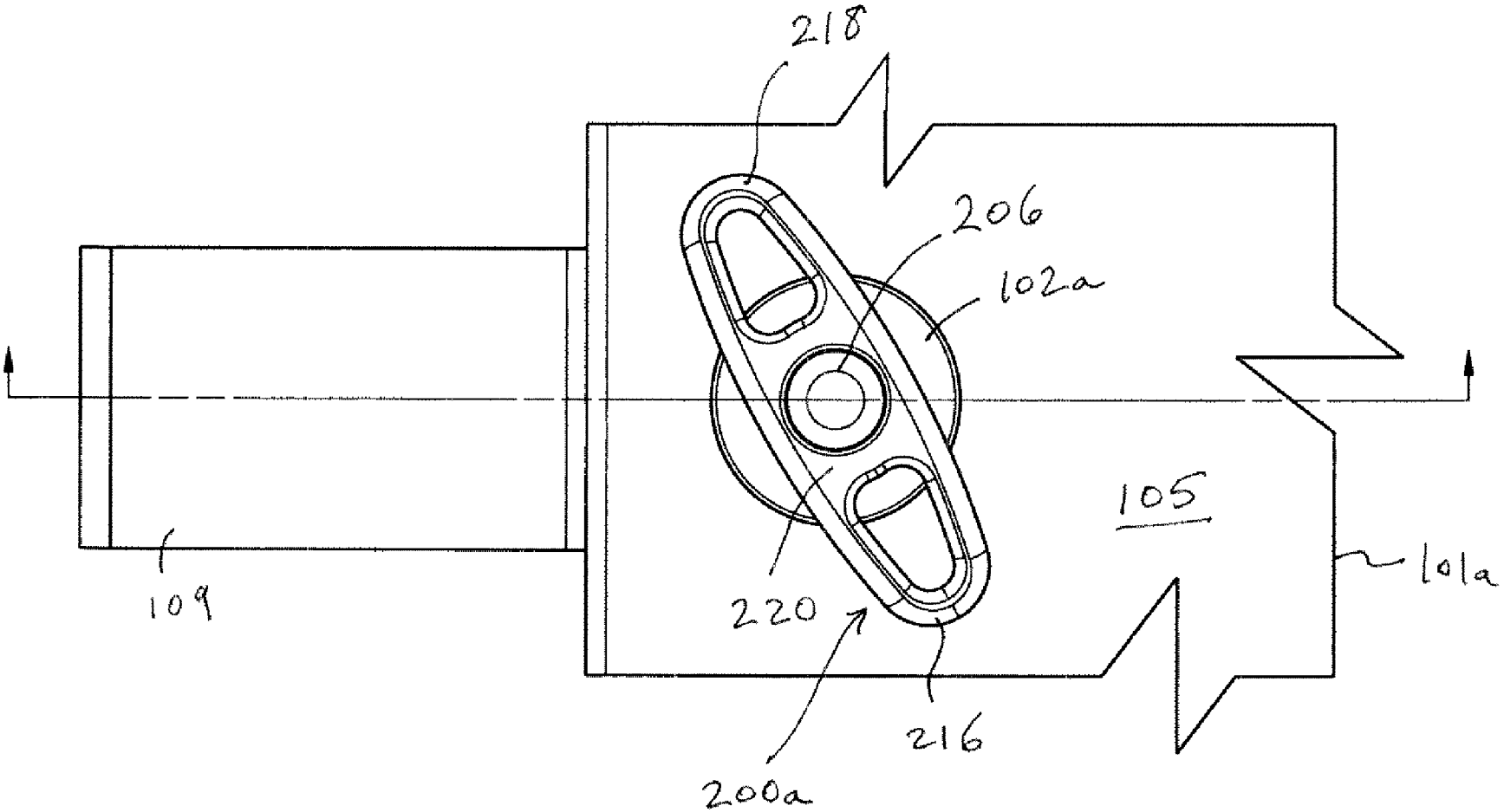
FIG. 46 is an environmental view of the second embodiment of a latch assembly and T-handle actuator according to the present invention shown in the latched configuration.
Figure 47:
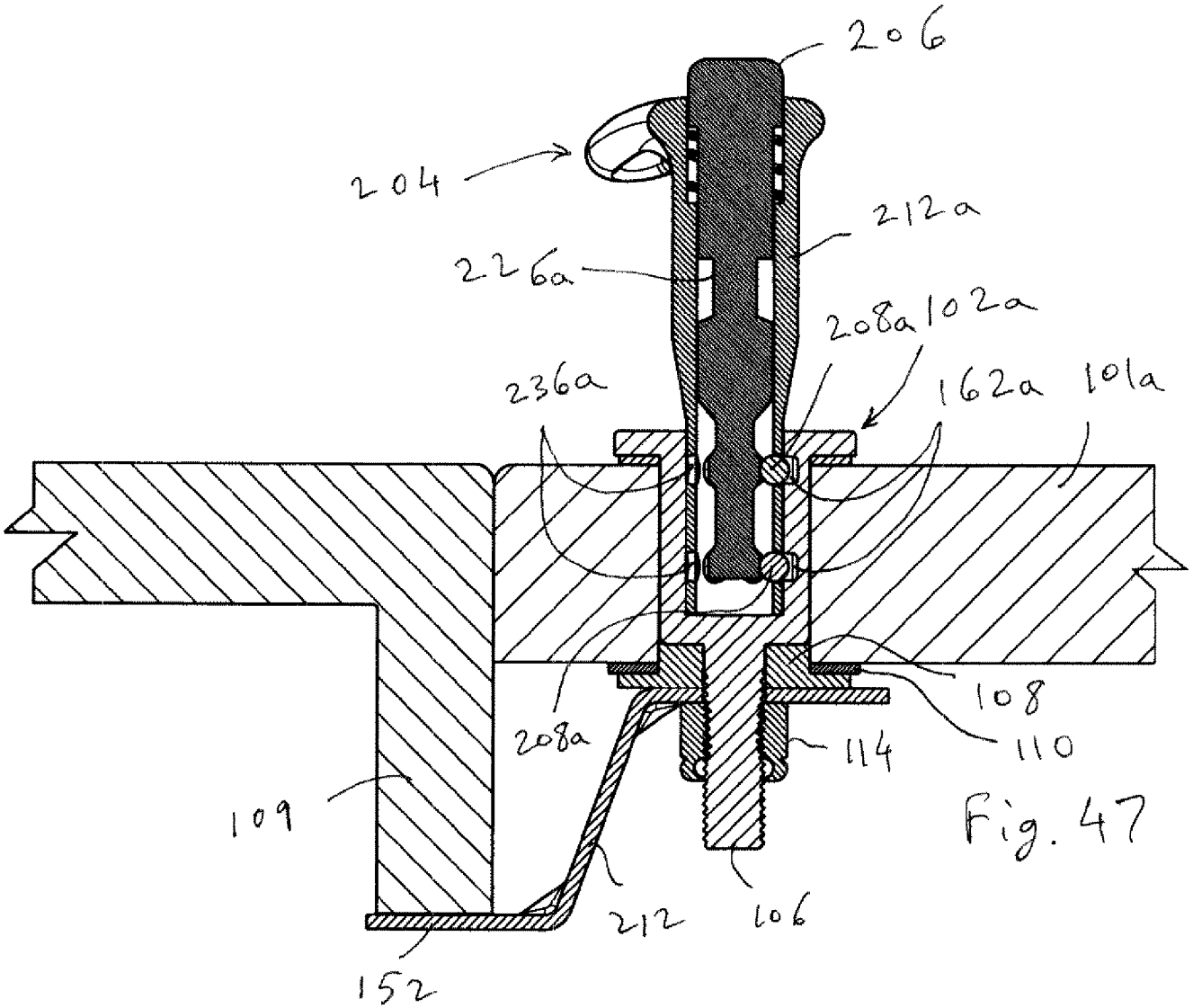
FIG. 47 is a cross sectional environmental view of the second embodiment of a latch assembly and T-handle actuator according to the present invention shown in the latched configuration.
Figure 48:
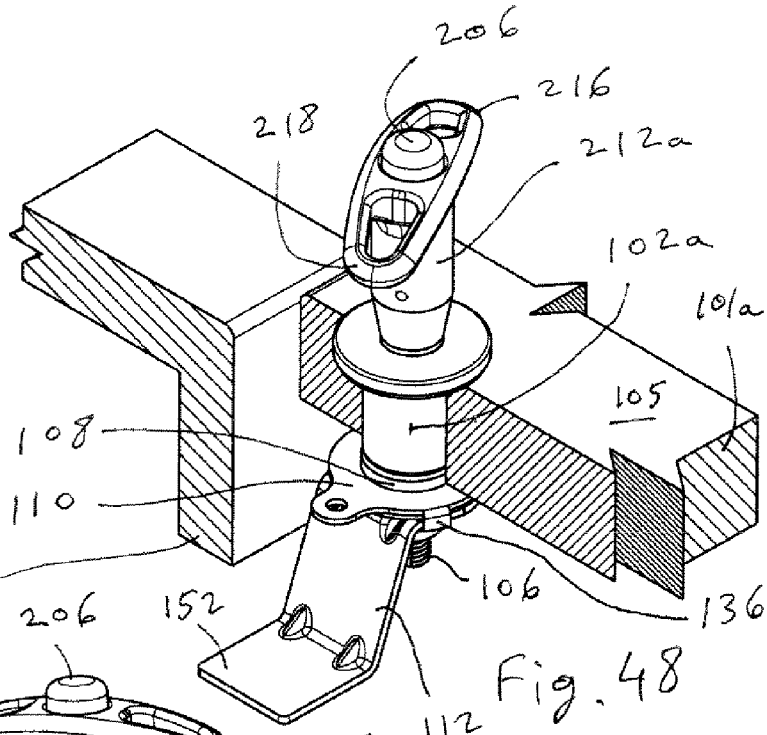
FIGS. 48-51 are environmental views of the second embodiment of a latch assembly and T-handle actuator according to the present invention shown in the unlatched configuration.
Figure 49:
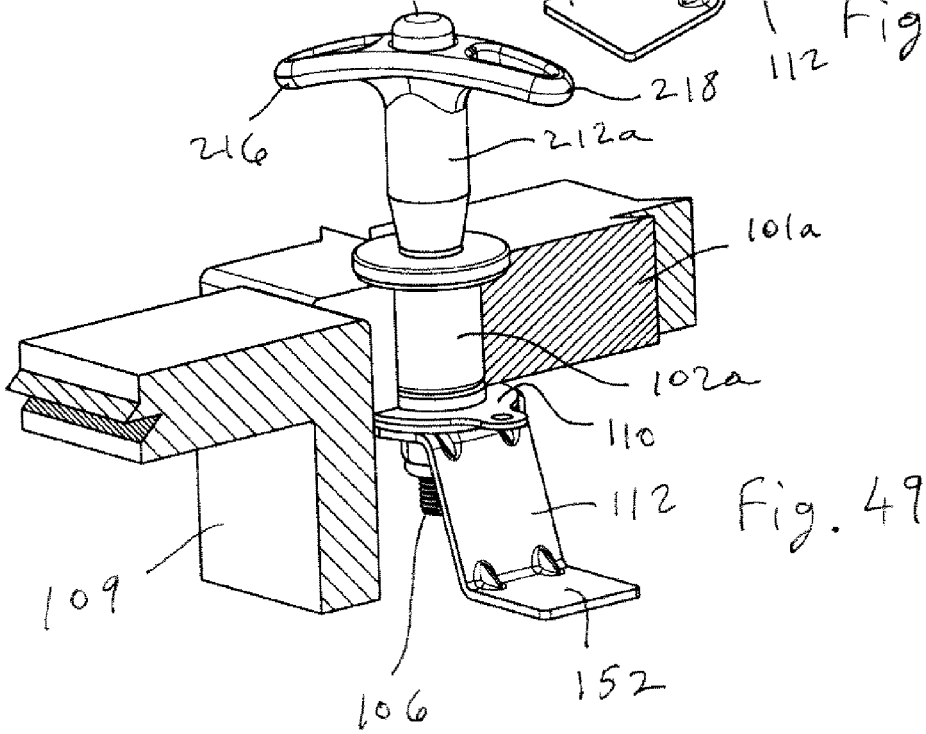
Figure 50:
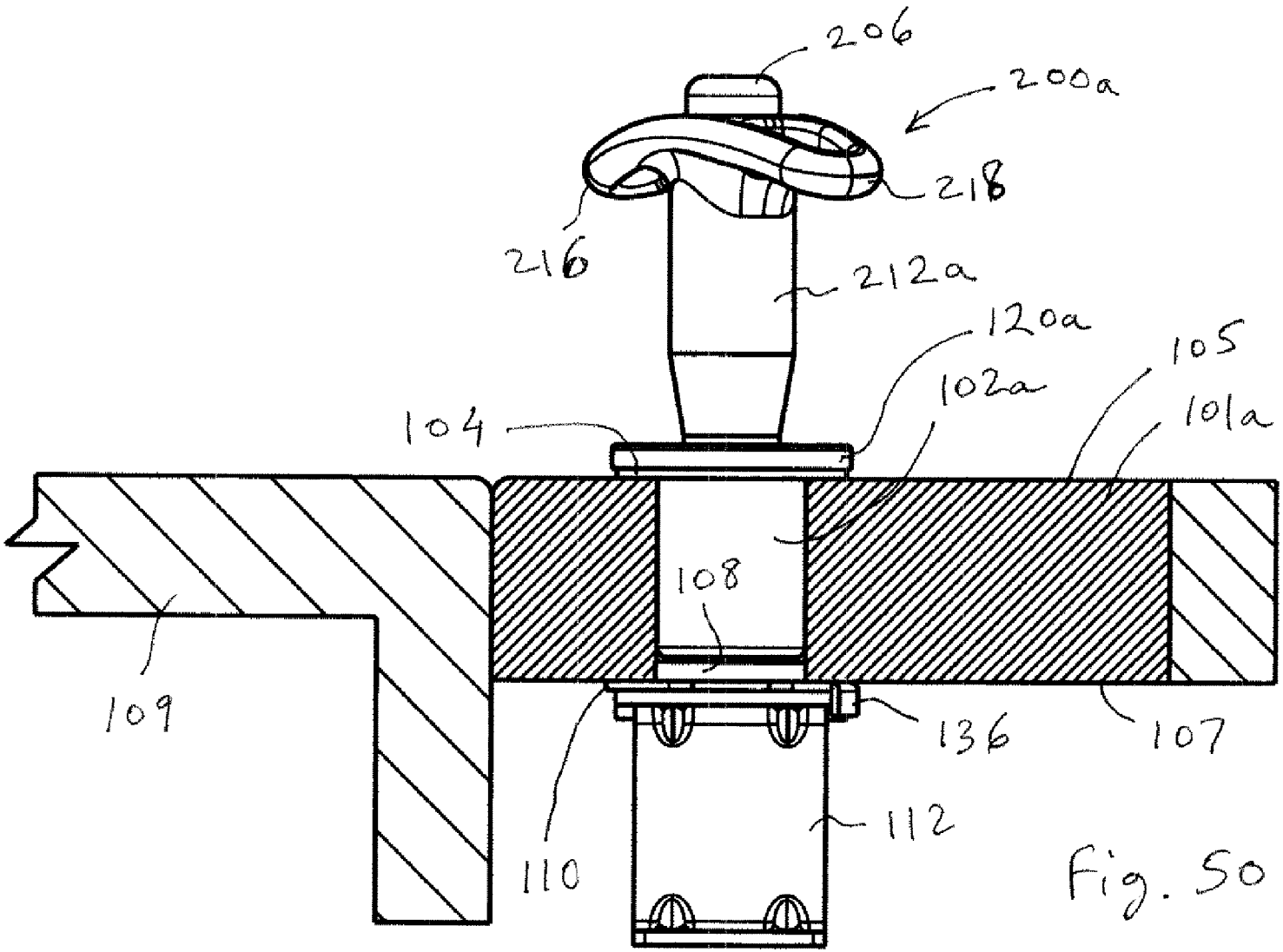
Figure 51:
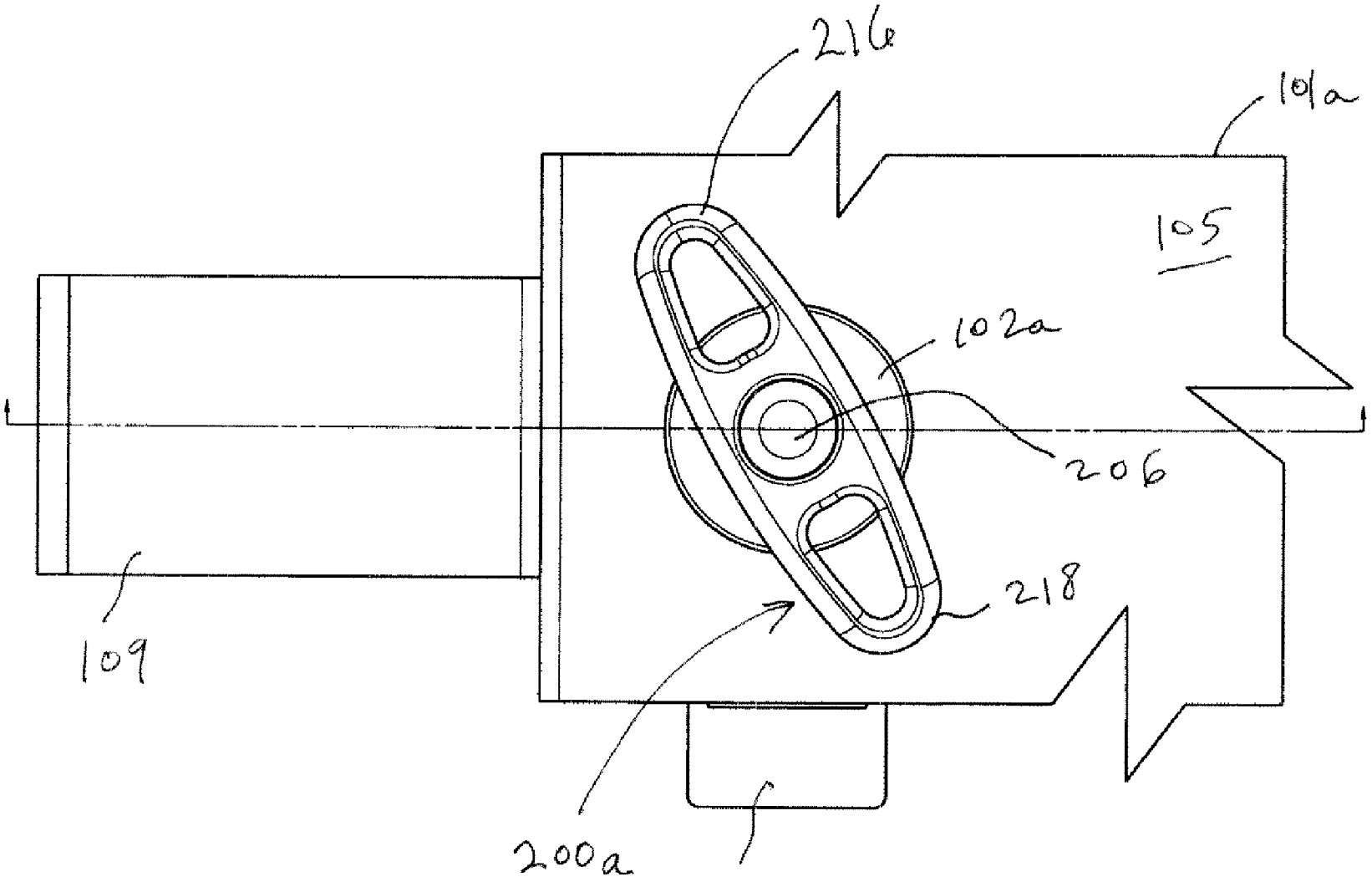
Figure 52:
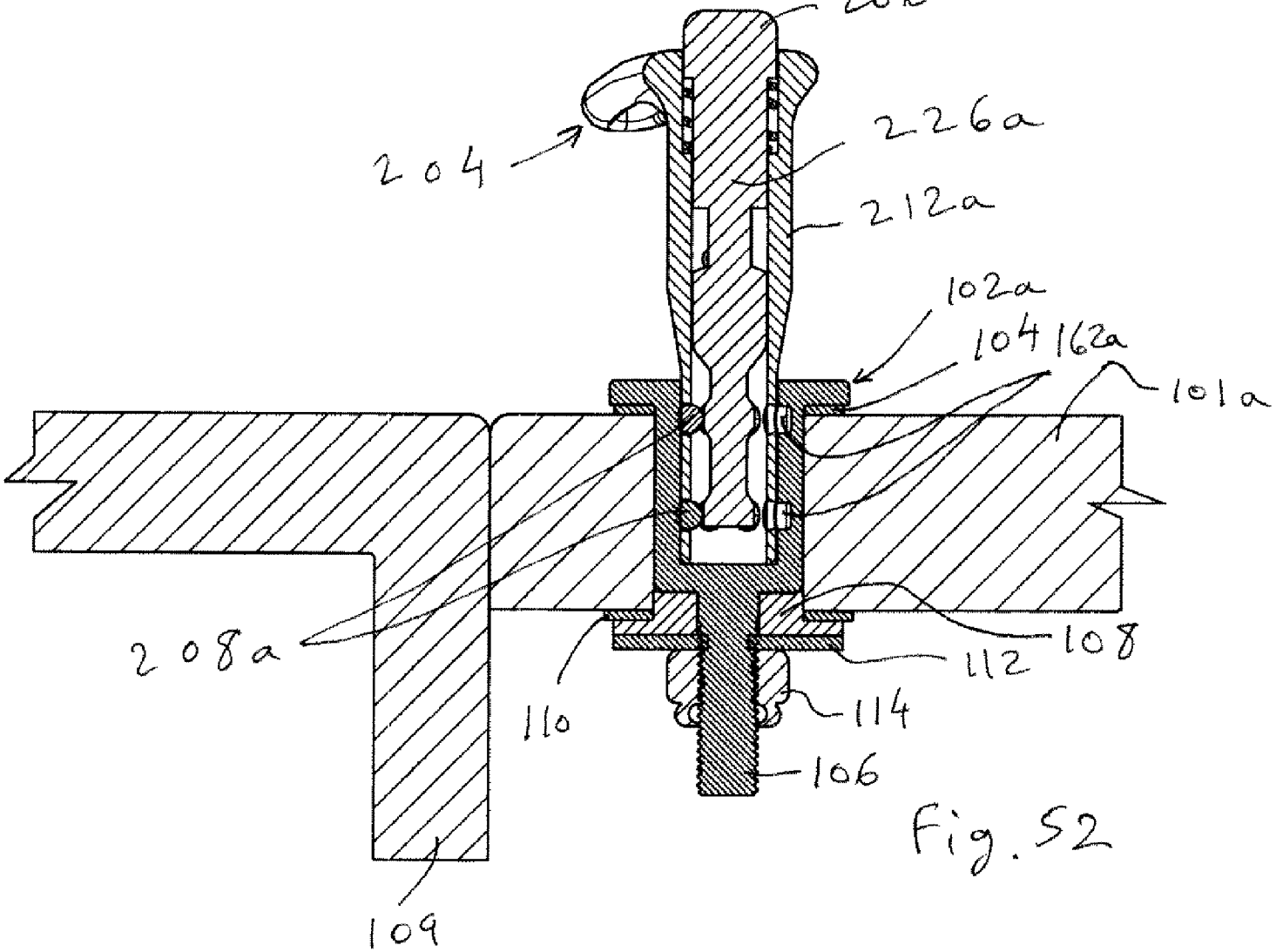
FIG. 52 is a cross sectional environmental view of the second embodiment of a latch assembly and T-handle actuator according to the present invention shown in the unlatched configuration.
Figures 53, 54:
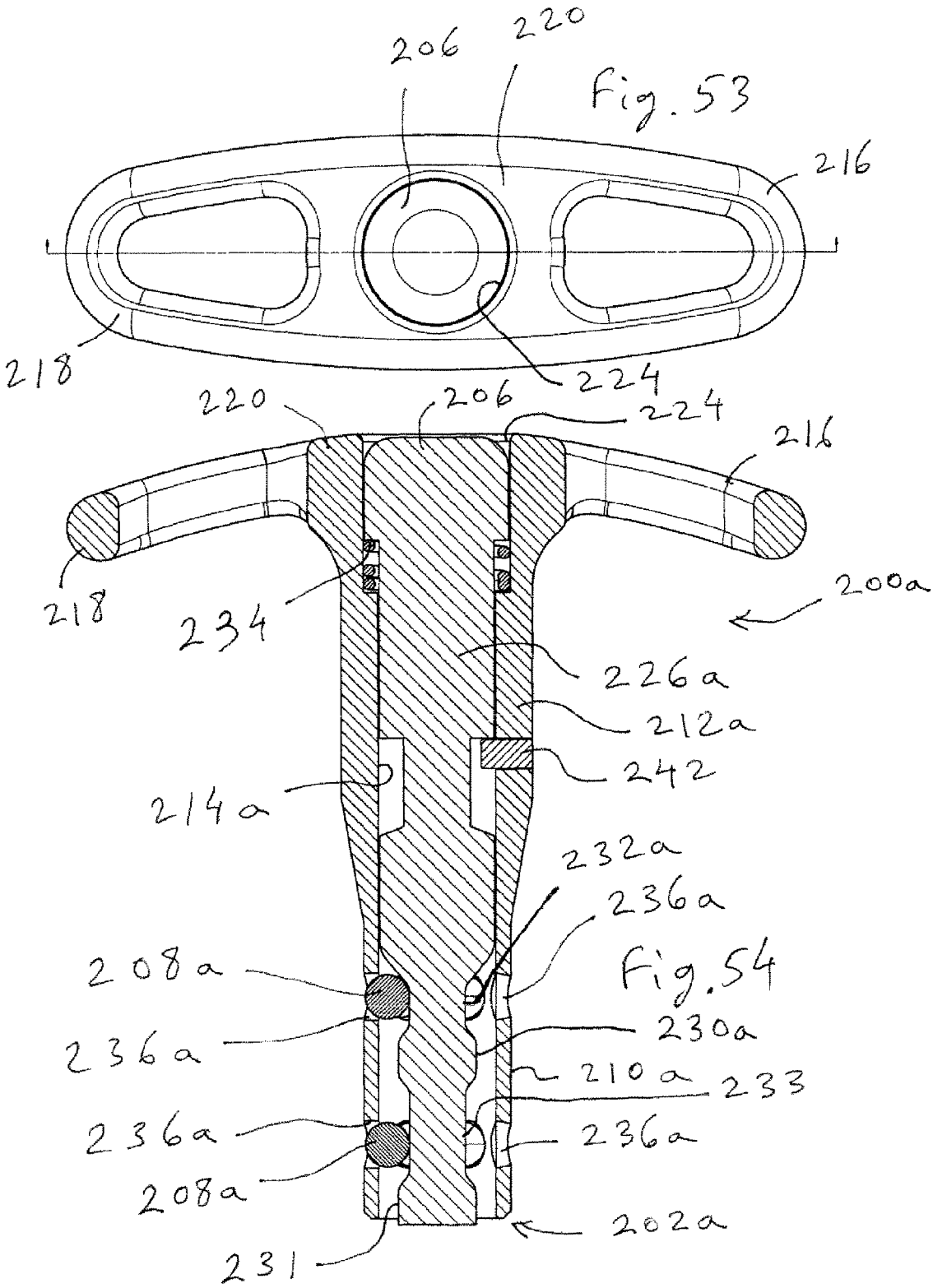
FIG. 53 is a top view of the second embodiment of a T-handle actuator according to the present invention shown with the pushbutton retracted.
FIG. 54 is a cross sectional view of the second embodiment of a T-handle actuator according to the present invention shown with the pushbutton retracted.
Figure 55:
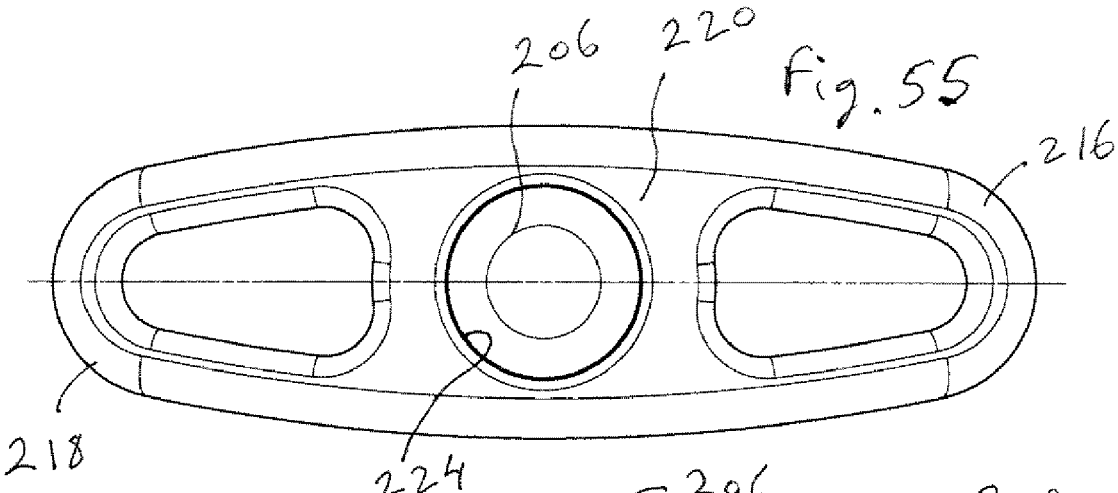
FIG. 55 is a top view of the second embodiment of a T-handle actuator according to the present invention shown with the pushbutton in the extended position.
Figure 56:
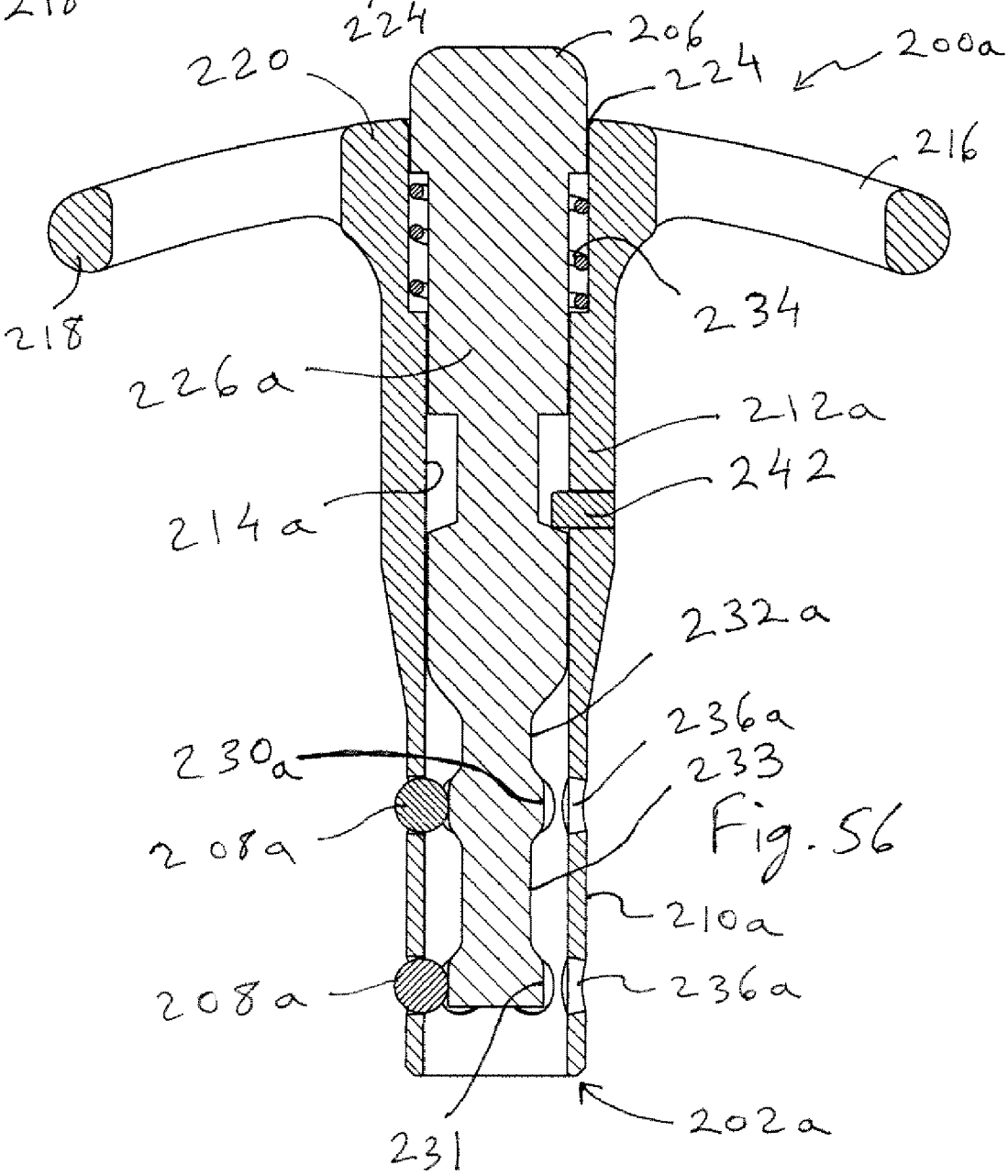
FIG. 56 is a cross sectional view of the second embodiment of a T-handle actuator according to the present invention shown with the pushbutton in the extended position.
Figures 57, 58, 59:
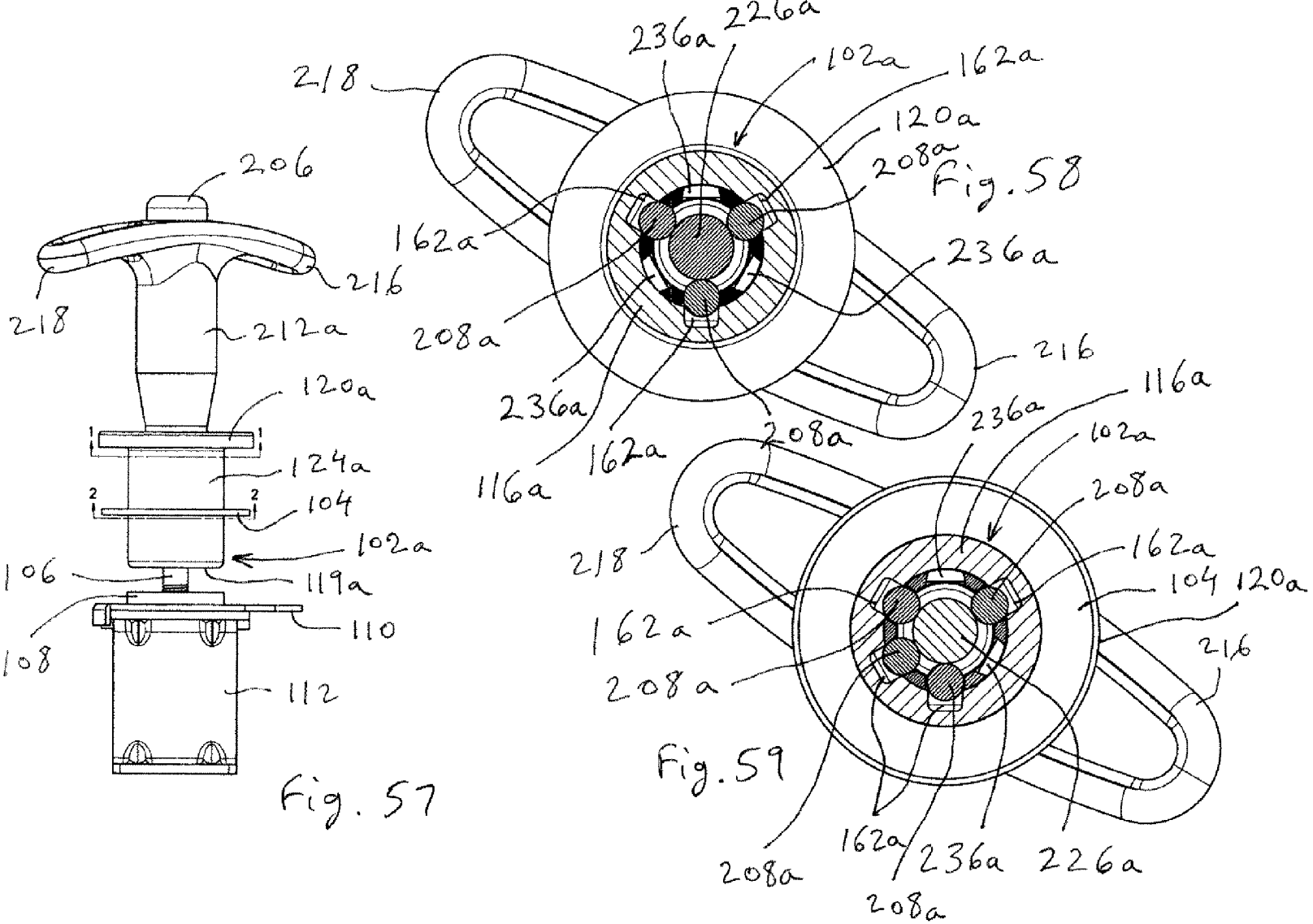
FIG. 57 is a view of the second embodiment of a latch assembly and T-handle actuator according to the present invention showing the T-handle actuator inserted onto the socket of the latch assembly an its pushbutton extended.
FIG. 58 is a cross sectional view of the second embodiment of a latch assembly and T-handle actuator according to the present invention showing the first set of ball bearings of the T-handle actuator engaging the lateral cavities of the socket of the latch assembly.
FIG. 59 is a cross sectional view of the second embodiment of a latch assembly and T-handle actuator according to the present invention showing the second set of ball bearings of the T-handle actuator engaging the lateral cavities of the socket of the latch assembly.
Figures 60, 61, 62:
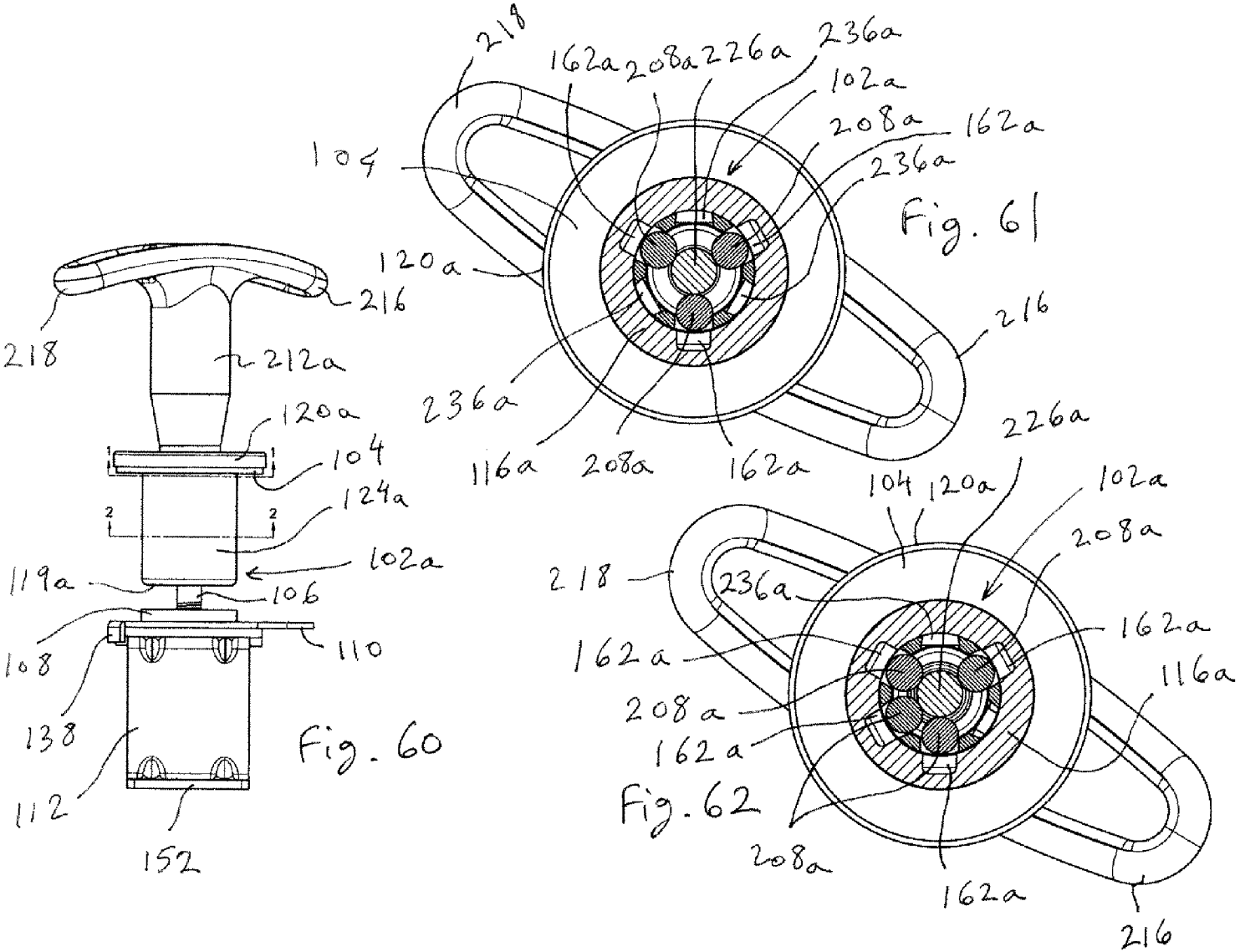
FIG. 60 is a view of the second embodiment of a latch assembly and T-handle actuator according to the present invention showing the T-handle actuator inserted onto the socket of the latch assembly an its pushbutton retracted.
FIG. 61 is a cross sectional view of the second embodiment of a latch assembly and T-handle actuator according to the present invention showing the first set of ball bearings of the T-handle actuator disengaged from the lateral cavities of the socket of the latch assembly.
FIG. 62 is a cross sectional view of the second embodiment of a latch assembly and T-handle actuator according to the present invention showing the second set of ball bearings of the T-handle actuator disengaged from the lateral cavities of the socket of the latch assembly.
Figure 63:
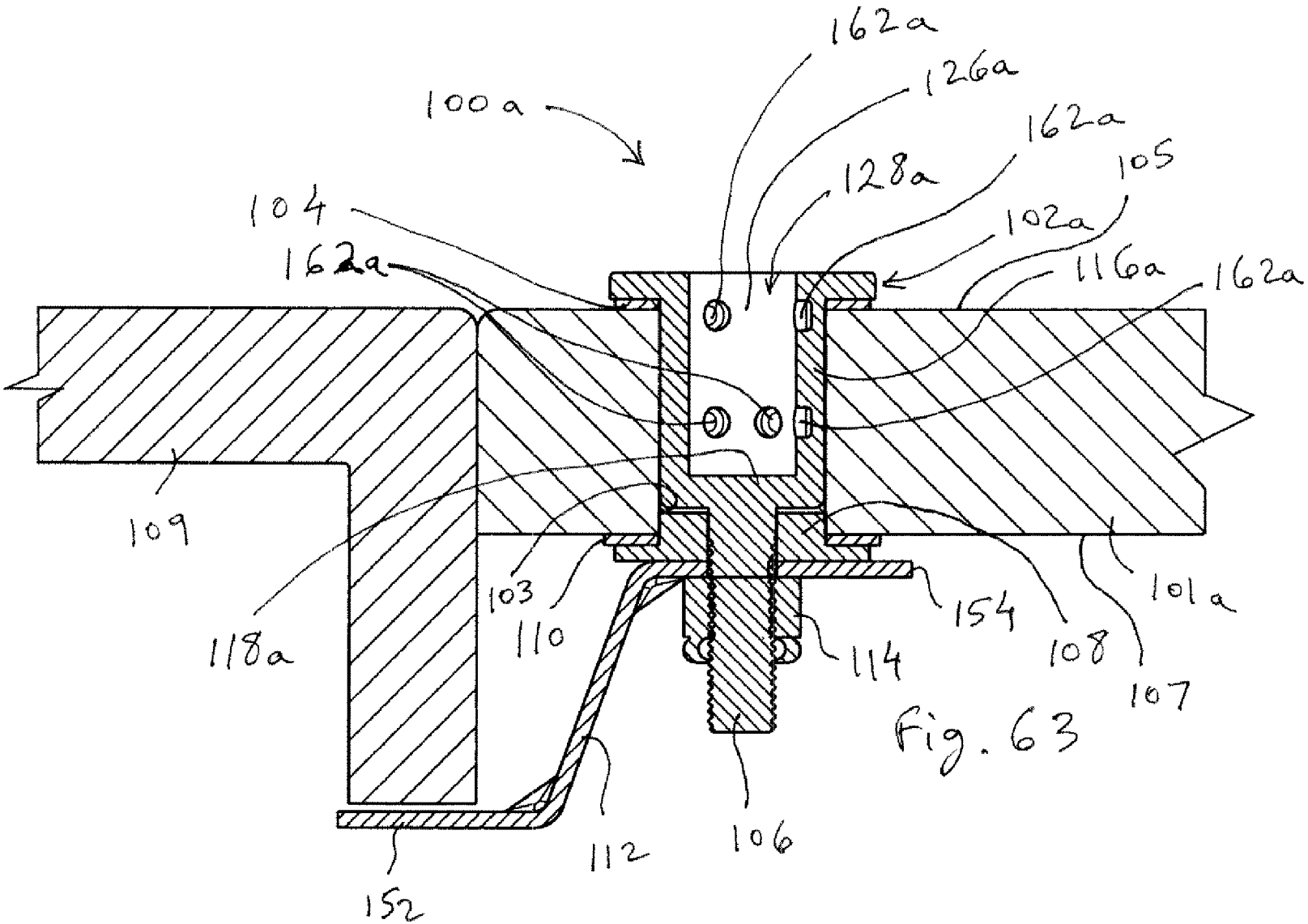
FIG. 63 is a cross sectional environmental view of the second embodiment of a latch assembly according to the present invention showing the latch assembly in the latched configuration.
Figure 64:
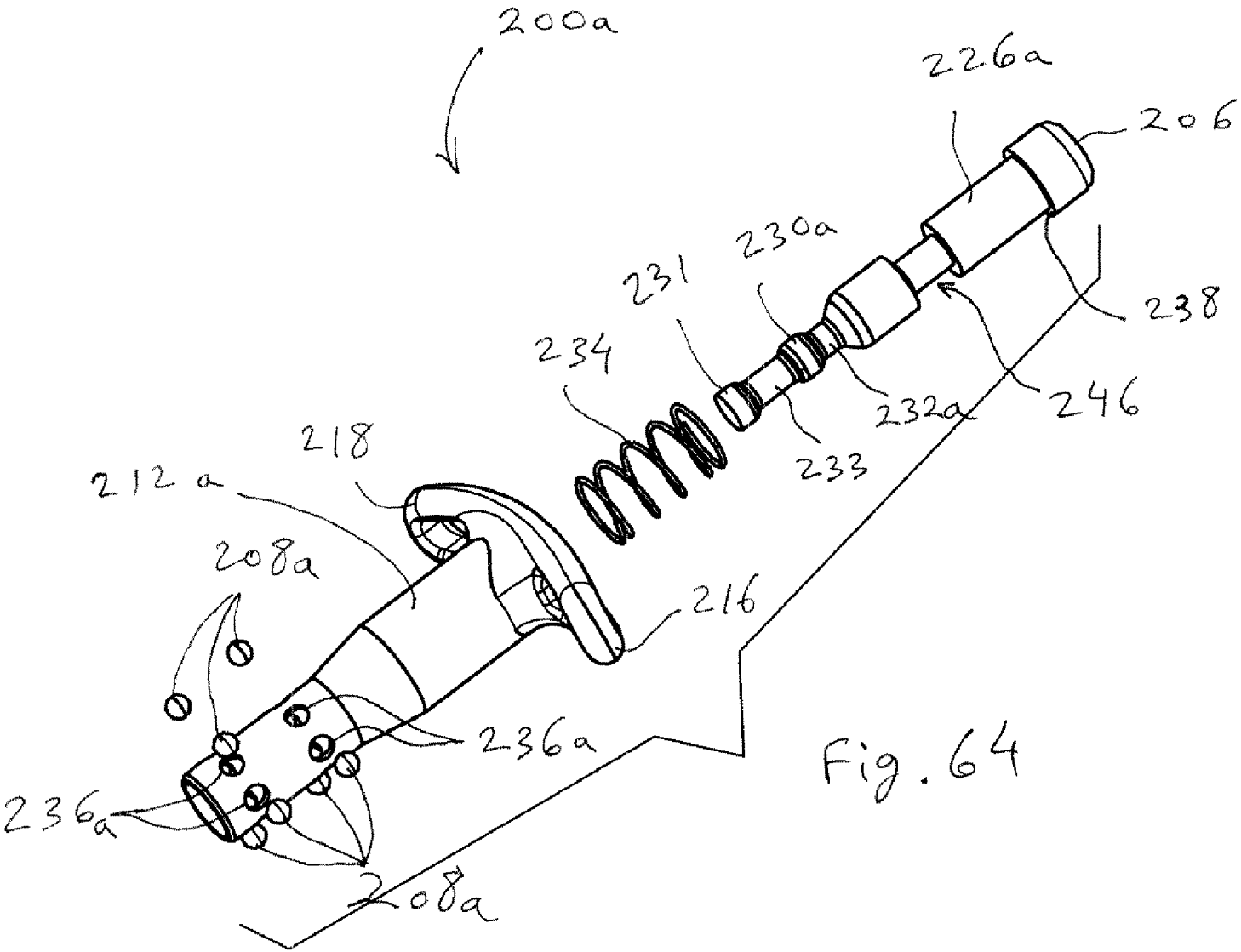
FIG. 64 is an exploded view of the second embodiment of a T-handle actuator according to the present invention.
Figure 65:
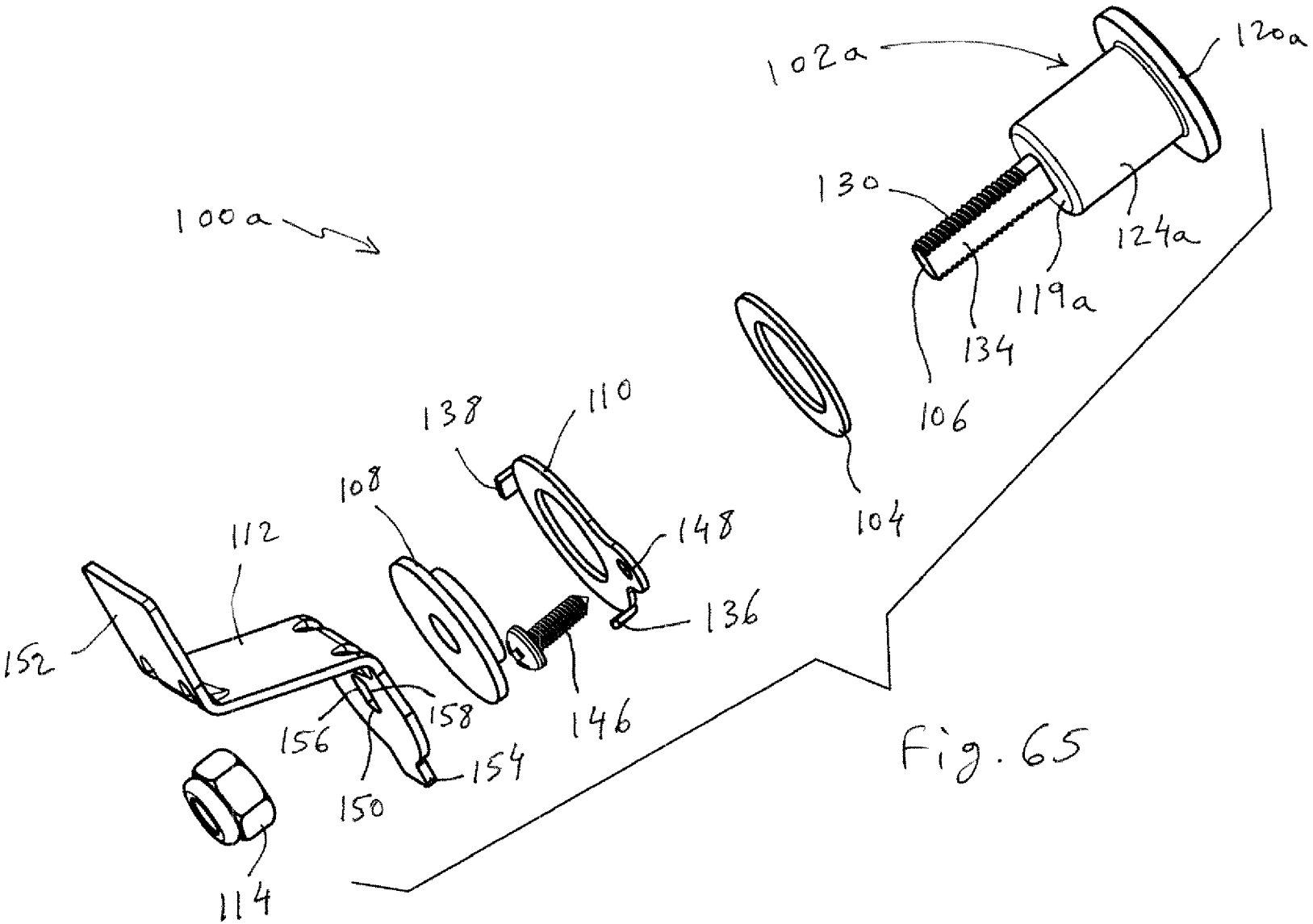
FIG. 65 is an exploded view of the second embodiment of a latch assembly according to the present invention.
Figure 66:
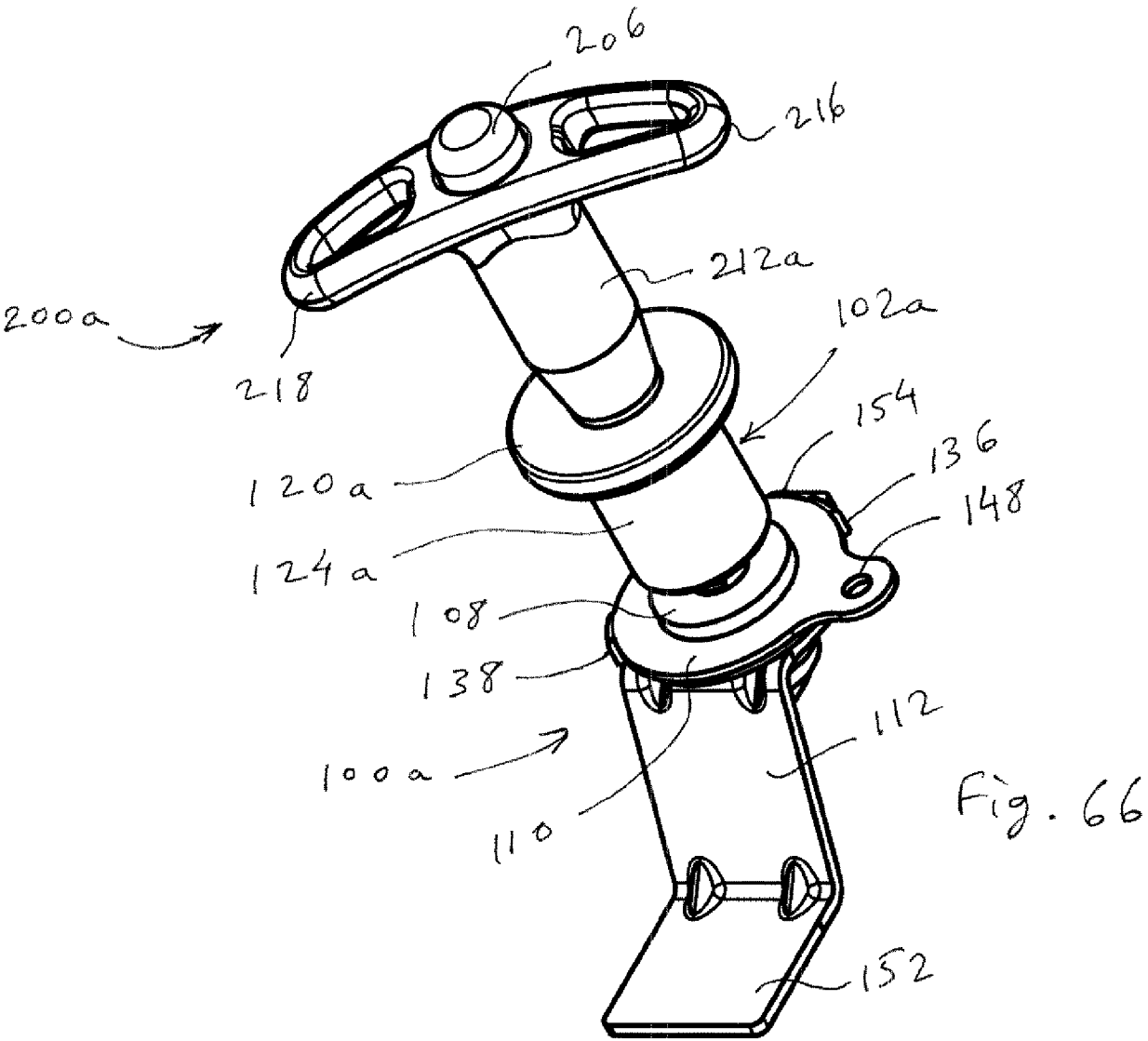
FIGS. 66-69 are various views of the second embodiment of a latch assembly and T-handle actuator according to the present invention showing the T-handle actuator inserted onto the socket of the latch assembly.
Figure 67:
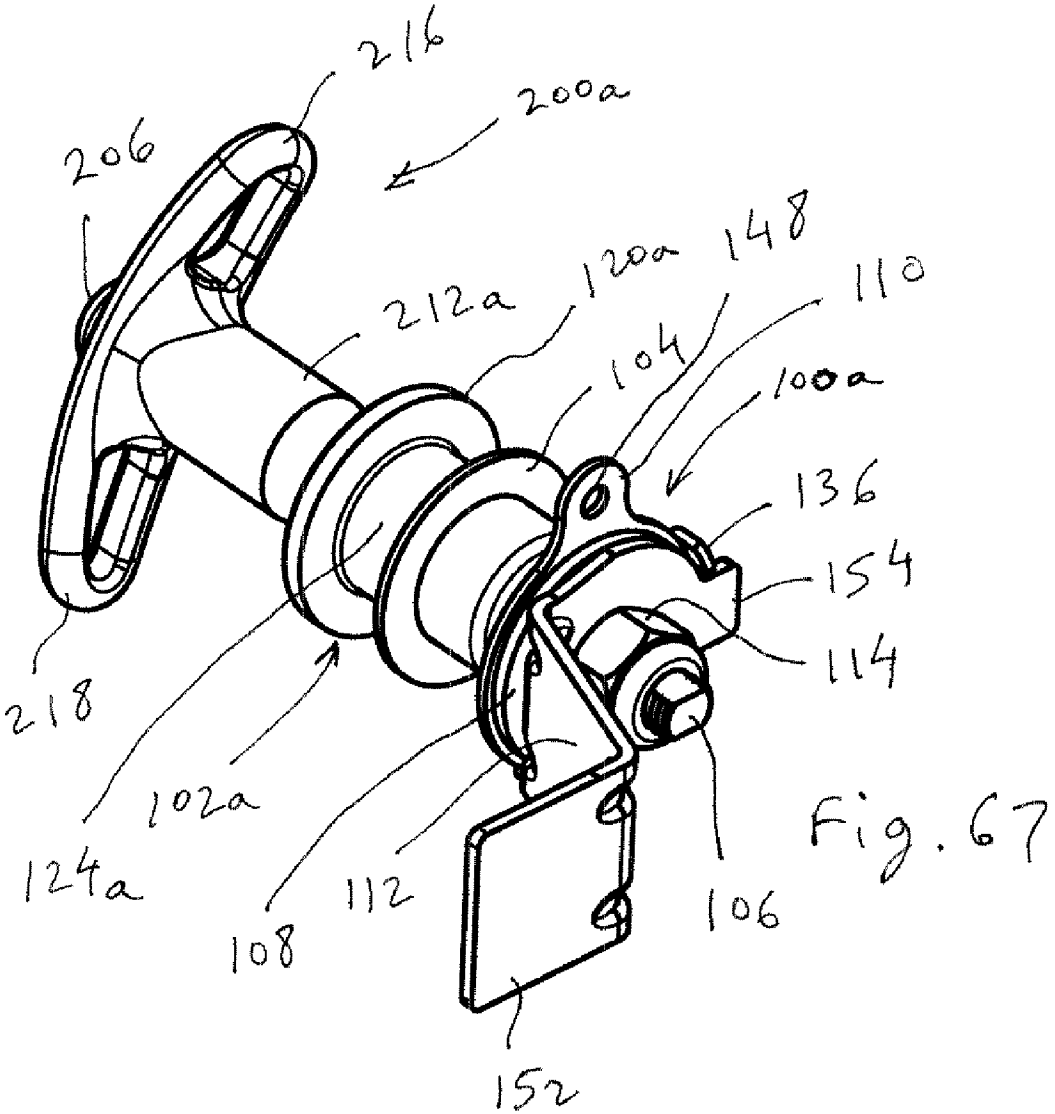
Figure 68:
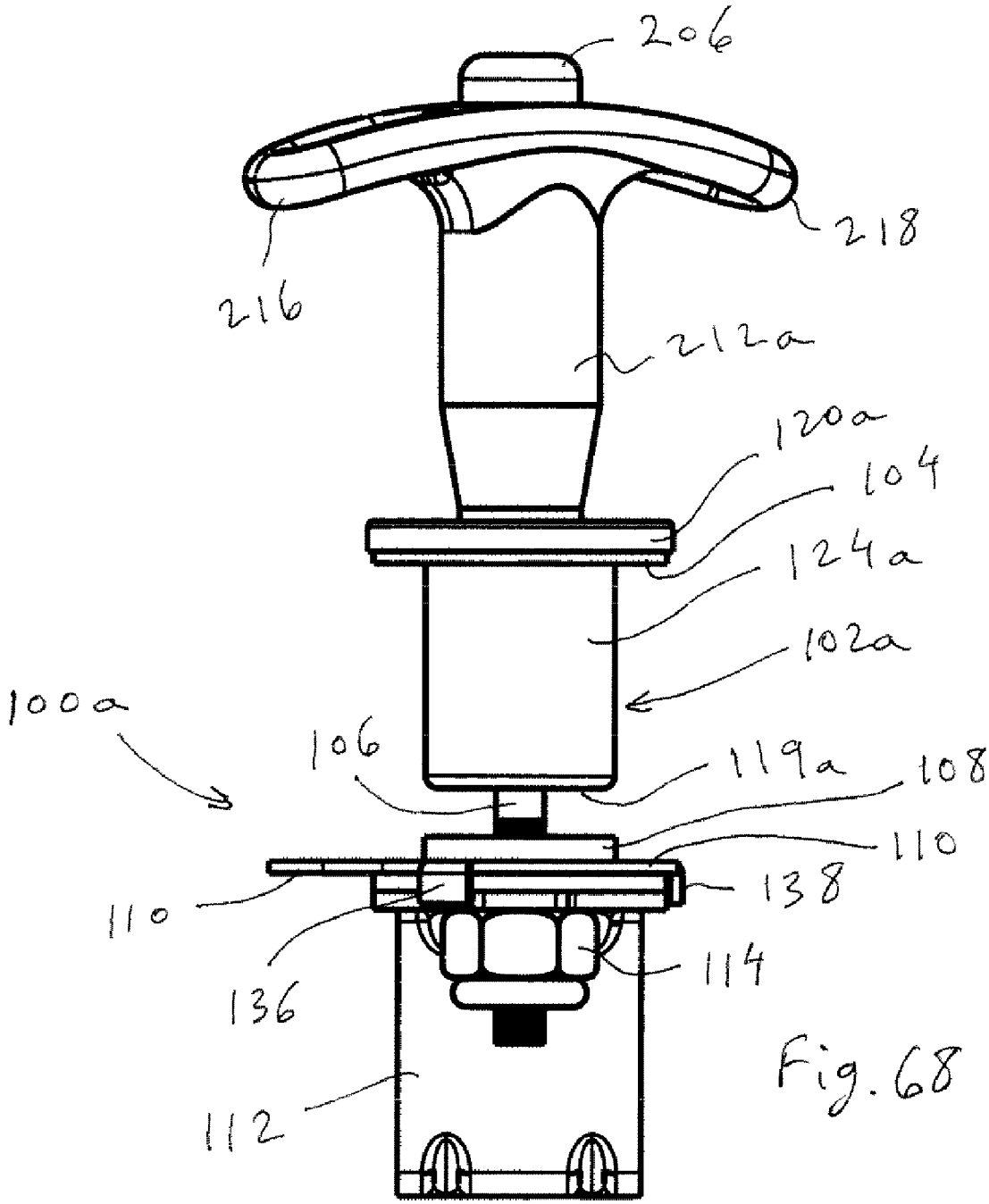
Figure 69:
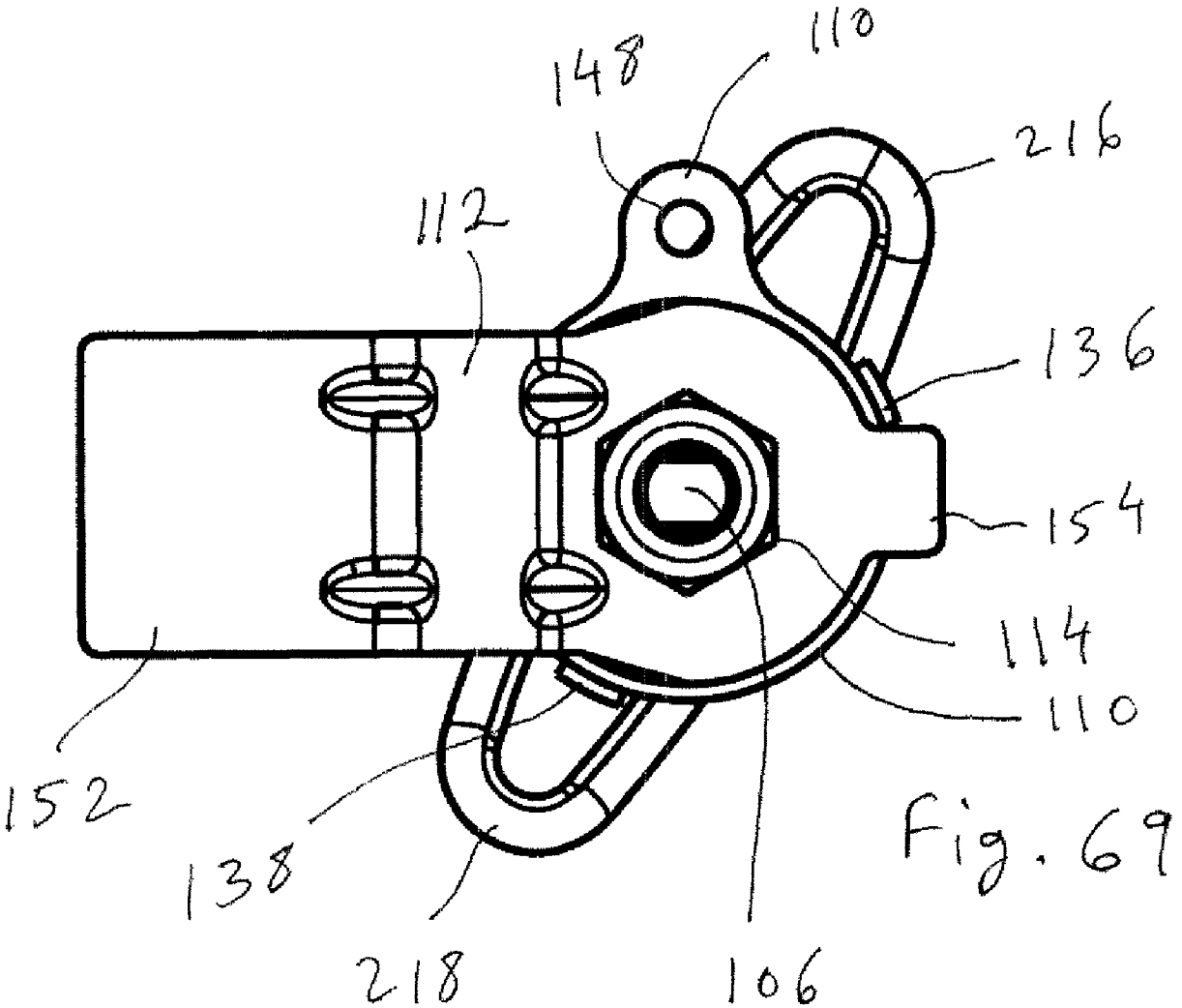

Referring to FIGS. 43-69, a second embodiment 100*a* of the latch mechanism of the present invention can be seen. In all the attached drawings parts indicated by identical reference numerals are identical in both structure and function as between the various disclosed embodiments. In the interest of brevity, only those parts that are different as between the embodiments 100 and 100*a* of the latch mechanism and as between the embodiments 200 and 200*a* of the T-handle actuator will be discussed here in detail. The embodiments 200 and 200*a* of the T-handle actuator are used and operated in exactly the same manner.

The door 101*a* is thicker than the door 101. Otherwise the doors 101*a* and 101 are identical in both structure and function. The only differences between the latch mechanism 100 and the latch mechanism 100*a* are in the sockets 102 and 102*a*. The socket 102*a* has a cylindrical side wall 116*a*, a bottom 118*a*, and a top flange 120*a*. The socket 102*a* is essentially in the form of a cup with an open top 122*a*. The top flange 120*a* is annular and surrounds the open top 122*a*. The cylindrical side wall 116*a* extends between the top flange 120*a* and the bottom 118*a*. The cylindrical side wall 116*a* has an outer surface 124*a* and an inner surface 126*a*. The cylindrical side wall 116*a* and the bottom 118*a* together define the main cavity 128*a* of the socket 102*a*. The socket 102*a* has a longitudinal axis that is the same as the longitudinal axis of the cylindrical side wall 116*a* and the longitudinal axis of the main cavity 128*a*. The main cavity 128*a* is sized to receive the second end portion 202*a* of the T-handle actuator 200*a*. The socket 102*a* has a bottom surface 119*a*.

The wall 116*a* has at least one lateral cavity 162*a*. Preferably, the wall 116*a* has a plurality of lateral cavities 162*a*. The opening of each lateral cavity 162*a* faces toward the interior of the main cavity 128*a*. In other words, the opening of each lateral cavity 162*a* faces toward the longitudinal axis of the socket 102*a*. In the illustrated example, the socket 102*a* is provided with seven lateral cavities 162*a* arranged in two sets. The first set of lateral cavities 162*a* includes three lateral cavities 162*a* distributed evenly, at about 120° intervals center-to-center, about the longitudinal axis of the socket 102*a* at the same distance from the bottom 118*a* of the socket 102*a*. The second set of lateral cavities 162*a* includes four lateral cavities 162*a* three of which are distributed evenly, at about 120° intervals center-to-center, about the longitudinal axis of the socket 102*a* at the same distance from the bottom 118*a* of the socket 102*a*. The fourth lateral cavity 162*a* of the second set of lateral cavities 162*a* is positioned midway between two of the first three evenly distributed lateral cavities of the second set of lateral cavities 162*a*. The second set of lateral cavities 162*a* are at spaced separation from the first set of lateral cavities 162*a*, and the second set of lateral cavities 162*a* are positioned between the first set of lateral cavities 162*a* and the bottom 118*a* of the socket 102*a*. The first set of lateral cavities 162*a* constitutes a first plurality of lateral cavities 162*a*, and the second set of lateral cavities 162*a* constitutes a second plurality of lateral cavities 162*a*.

The T-handle actuator 200*a* will now be described in greater detail. The latch actuator 200*a* includes a sleeve 212*a*, a pair of lateral arms 216 and 218, a plunger 226*a*, a spring 234, and at least one ball bearing 208*a*. The sleeve 212*a* has a bore 214*a* extending along the longitudinal axis of the sleeve 212*a*. The pair of lateral arms 216 and 218 is provided at a first end portion 220 of the sleeve 212*a*. The lateral arms 216 and 218 extend in opposite directions from the first end portion 220 of the sleeve 212*a* so as to form a T-shaped configuration with the sleeve 212*a* to thereby define a T-handle 222. The arms 216 and 218 and the sleeve 212*a*, excluding the second end portion 202*a*, define the T-handle portion 204. The sleeve 212*a* has a hole 224 at its first end portion 220 that communicates with the bore 214*a*. The hole 224 is located intermediate the lateral arms 216 and 218.

The plunger 226*a* is supported for rectilinear motion in the bore 214*a*. The plunger 226*a* is rectilinearly movable between an extended position and a retracted position. The plunger 226*a* has a button portion 228 that projects outward from the hole 224 when the plunger 226*a* is in the extended position so as to define a pushbutton 206. The pushbutton 206 is movable between an extended position corresponding to the extended position of the plunger 226*a* and a retracted position corresponding to the retracted position of the plunger 226*a*.

A user can move the plunger 226*a* to the retracted position by pushing the pushbutton 206 inward relative to the bore 214*a*. The plunger 226*a* has at least a first portion of a first diameter 230*a*, a second portion of the first diameter 231, a first portion of a second diameter 232*a*, and a second portion of the second diameter 233. The first diameter is larger than the second diameter. The first portion 232*a* of the second diameter is positioned intermediate the first portion 230*a* of the first diameter and the second portion 231 of the first diameter along the longitudinal axis of the plunger 226*a*. The second portion 231 of the first diameter is positioned intermediate the first portion 232*a* of the second diameter and the second portion 233 of the second diameter along the longitudinal axis of the plunger 226*a*. The spring 234 biases the plunger 226*a* toward its extended position.

Actuator 200*a* has seven ball bearings 208*a*. Each ball bearing 208*a* is received at least in part within the bore 214*a* of the sleeve 212*a*. The sleeve 212*a* has a second end portion

202*a* distal from the lateral arms 216 and 218 that is dimensioned for insertion into the main cavity 128*a* of the socket 102*a*. The sleeve 212*a* has twelve lateral openings 236*a* in the second end portion 202*a* of the sleeve 212*a*. The lateral openings 236*a* are arranged in two sets of six openings each with each set at spaced separation from the other along the longitudinal axis of the sleeve 212*a*. The position of the first set of lateral openings 236*a* along the longitudinal axis of the sleeve 212*a* is selected such that the first set of lateral openings 236*a* are at the same distance as the first set of lateral cavities 162*a* from the bottom 118*a* of the socket 102*a* when the second end portion 202*a* of the sleeve 212*a* is fully inserted into the socket 102*a*. The position of the second set of lateral openings 236*a* along the longitudinal axis of the sleeve 212*a* is selected such that the second set of lateral openings 236*a* are at the same distance as the second set of lateral cavities 162*a* from the bottom 118*a* of the socket 102*a* when the second end portion 202*a* of the sleeve 212*a* is fully inserted into the socket 102*a*. The sleeve 212*a* has an exterior surface 210*a*, and each lateral opening 236*a* extends between the bore 214*a* and the exterior surface 210*a*. The first set of lateral openings 236*a* are distributed evenly about the longitudinal axis of the sleeve 212*a* such that the lateral openings 236*a* of the first set of lateral openings 236*a* are 60° apart center-to-center about the longitudinal axis of the sleeve 212*a*. The second set of lateral openings 236*a* are distributed evenly about the longitudinal axis of the sleeve 212*a* such that the lateral openings 236*a* of the second set of lateral openings 236*a* are 60° apart center-to-center about the longitudinal axis of the sleeve 212*a*. Three lateral openings 236*a* of the first set of lateral openings 236*a* can be in alignment with the three lateral cavities 162*a* of the first set of lateral cavities 162*a* at the same time. Four lateral openings 236*a* of the second set of lateral openings 236*a* can be in alignment with the four lateral cavities 162*a* of the second set of lateral cavities 162*a* at the same time. Also, the three lateral openings 236*a* of the first set of lateral openings 236*a* and the four lateral openings 236*a* of the second set of lateral openings 236*a* can all be in alignment with their corresponding lateral cavities 162*a* at the same time when the second end portion 202*a* of the sleeve 212*a* is fully inserted into the socket 102*a*.

A first set of three ball bearings 208*a* are positioned within the bore of the sleeve 212*a* in substantial alignment with three corresponding lateral openings 236*a* selected from the first set of lateral openings 236*a* and a second set of four ball bearings 208*a* are positioned within the bore of the sleeve 212*a* in substantial alignment with four corresponding lateral openings 236*a* selected from the second set of lateral openings 236*a*, such that the first set of three ball bearings 208*a* and the second set of four ball bearings 208*a* can be in alignment with the three lateral cavities 162*a* of the first set of lateral cavities 162*a* and the four lateral cavities 162*a* of the second set of lateral cavities 162*a*, respectively, at the same time when the second end portion 202*a* of the sleeve 212*a* is fully inserted into the socket 102*a*. Thus, each ball bearing 208*a* is in registry with a corresponding lateral opening 236*a*.

Each ball bearing 208*a* is movable between an extended position and a retracted position. Each ball bearing 208*a* projects outward in part from the exterior surface 210*a* when the ball bearing 208*a* is in its extended position. Each and every ball bearing 208*a* is in its extended position when the plunger 226*a* and consequently the pushbutton 206 are in their extended positions. The portions 230*a* and 231 of the plunger 226*a* having the first diameter are in registry with the first and second sets of ball bearings 208*a*, respectively, to thereby maintain all the ball bearings 208*a* in their extended positions, when the plunger 226*a* and the pushbutton 206 are in their extended positions. The portions 232*a* and 233 of the plunger 226*a* having the second diameter are in registry with the first and second sets of ball bearings 208*a*, respectively, to thereby allow movement of all the ball bearings 208*a* to their retracted positions, when the pushbutton 206 and consequently the plunger 226*a* are in their retracted positions.

When the second end portion 202*a* of the sleeve 212*a* is inserted into the socket 102*a* with each lateral opening 236*a* having an associated ball bearing 208*a*, i.e. having a ball bearing 208*a* in substantial alignment therewith, being in registry with a corresponding lateral cavity 162*a* in the socket 102*a* and with the plunger 226*a* and the pushbutton 206 in their extended positions, each and every ball bearing 208*a* will be in its extended position and will project in part into its corresponding lateral cavity 162*a* in the socket 102*a*. Under these conditions, the ball bearings 208*a* can engage the corresponding lateral cavities 162*a* such that a user can turn the socket 102*a* and thus operate the latch mechanism 100*a* by turning the T-handle actuator 200*a*.

When the second end portion 202*a* of the sleeve 212*a* is inserted into the socket 102*a* with each lateral opening 236*a* having an associated ball bearing being in registry with a corresponding lateral cavity 162*a* in the socket 102*a* and with the plunger 226*a* and the pushbutton 206 in their extended positions, a user can push in the pushbutton 206 to its retracted position to allow movement of the ball bearings 208*a* to their retracted positions and thereby allow the latch actuator 200*a* to be removed from the socket 102*a*. As with the actuator 200, the pushbutton 206 must held in its retracted position by the user when inserting the second end portion 202*a* of the actuator 200*a* into the socket 102*a* so that the ball bearings 208*a* can move to their retracted positions and therefore not interfere with the insertion of the second end portion 202*a*.

In the latch actuator 200*a*, the spring 234 is a coil spring 234 and the plunger 226*a* extends through the coil spring 234. The plunger 226*a* has an annular step 238 and the sleeve 212*a* has an annular step 240. The annular step 238 of the plunger 226*a* is positioned intermediate the button portion 228 and the annular step 240 of the sleeve 212*a*. The coil spring 234 extends between the annular step 238 of the plunger 226*a* and the annular step 240 of the sleeve 212*a* to thereby bias the plunger 226*a* and the pushbutton 206 to their extended positions.

In the latch actuator 200*a*, a pin 242 passing through the wall 244*a* of the sleeve 212*a* engages a groove 246 in the plunger 226*a* in order to at least limit the outward movement of the plunger 226*a* relative to the sleeve 212*a*. This arrangement prevents the plunger 226*a* from moving past its extended position in the direction of the plunger's movement from its retracted position to its extended position, and thus this arrangement prevents the plunger 226*a* from being ejected from the sleeve 212*a*. In the illustrated embodiment, the groove 246 is annular and the pin 242 hits one side of the groove to limit the outward movement of the pushbutton 206 and the other side of the groove 246 to limit the inward movement of the pushbutton 206. Alternatively, the groove 246 could be longitudinal with the pin 242 being captured between its ends to limit the range of motion of the plunger 226*a* and consequently the range of motion of the pushbutton 206. Furthermore, the annular step 238, the coil spring 234, and the annular step 240 can act to limit the inward movement of the pushbutton 206 in a variation of the illustrated design. In such a case, only the side of the groove 246 farthest from the pushbutton 206 would be required to limit the outward movement of the pushbutton 206 in cooperation with the pin 242.

The diameter of the portions 232*a* and 233 of the plunger 226*a* is selected such that each ball bearing 208*a* extends in part into its corresponding lateral opening 236*a* in the wall of the sleeve 212*a* even when the ball bearing 208*a* is in its retracted position. This arrangement ensures that each ball bearing 208*a* will remain in substantial alignment with its corresponding lateral opening 236*a* so that each ball bearing 208*a* is properly positioned, even when retracted, to return to its extended position when the plunger 226*a* returns to its extended position. This is what is meant by "substantial alignment" and this term encompasses perfect alignment.

Figure 70:
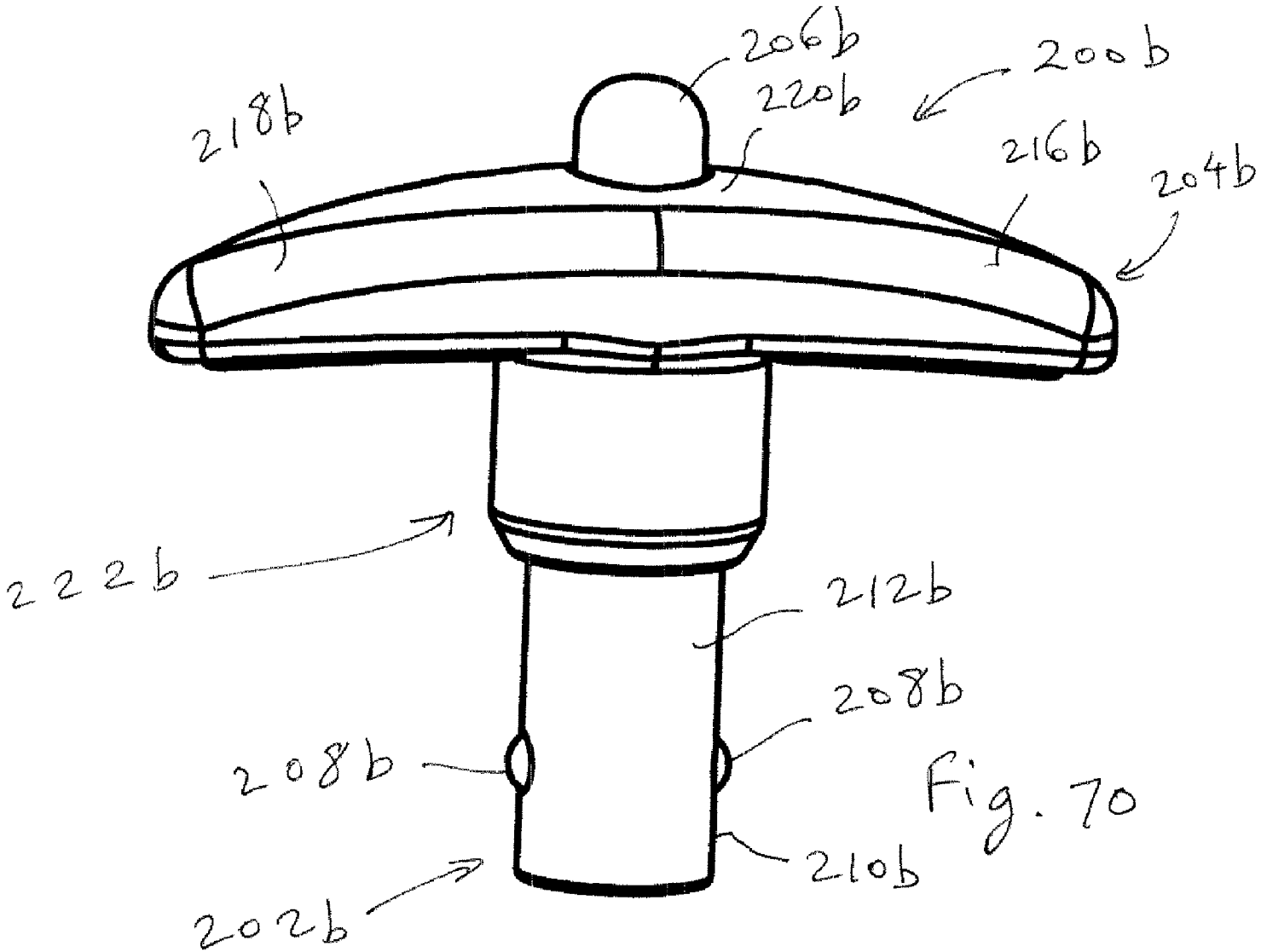
FIGS. 70-72 are various views of the third embodiment of a T-handle actuator according to the present invention showing the T-handle actuator inserted onto the socket of the latch assembly.
Figure 71:
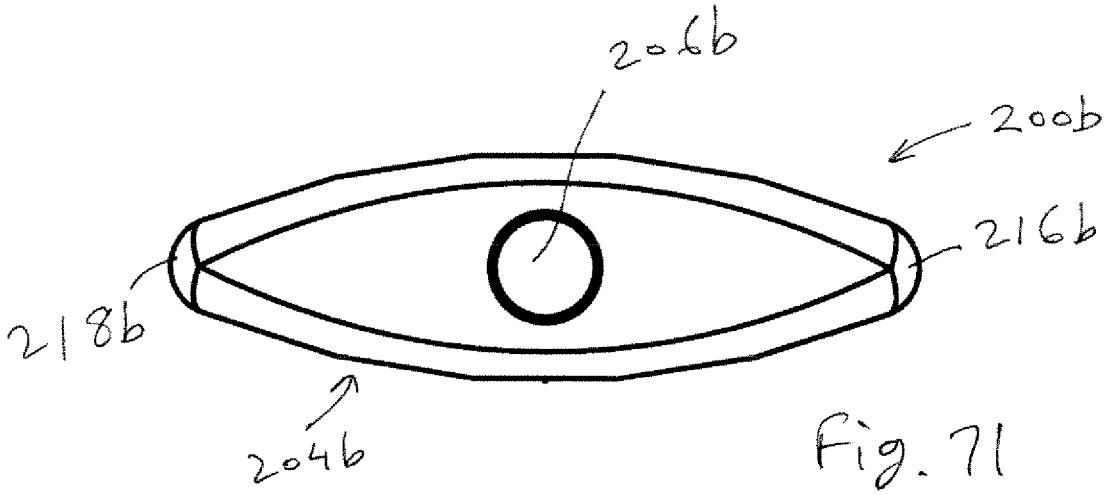
Figure 72:
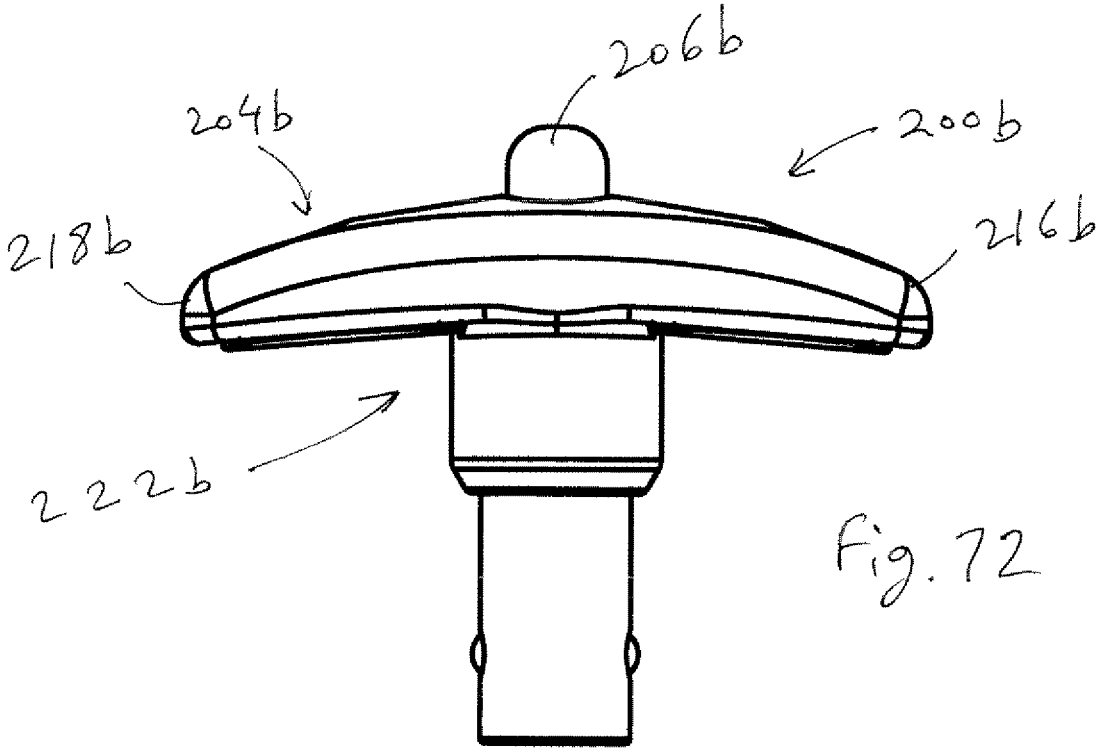
Figure 73:
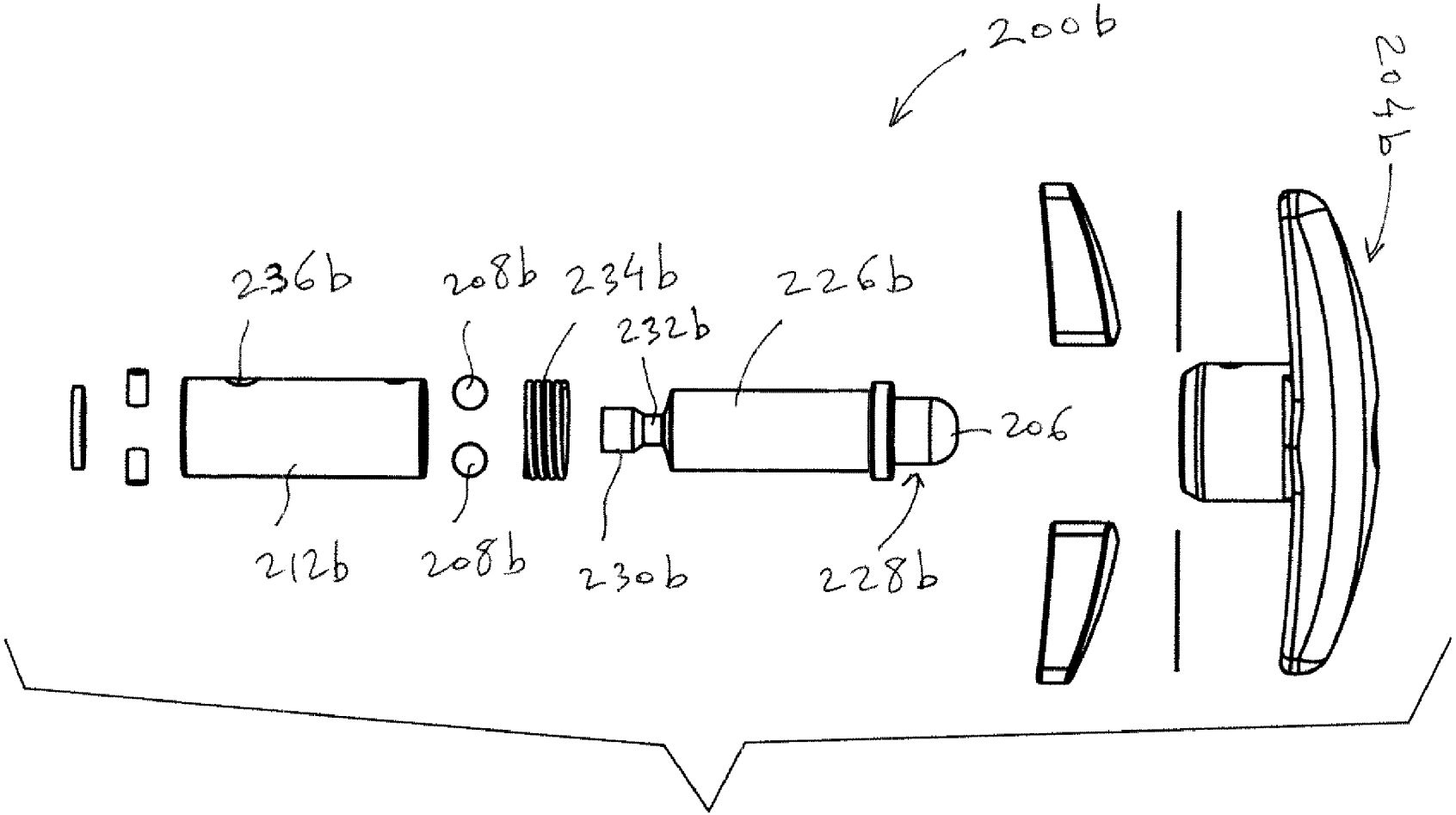
FIG. 73 is an exploded view of the third embodiment of a T-handle actuator according to the present invention.
Figure 74:
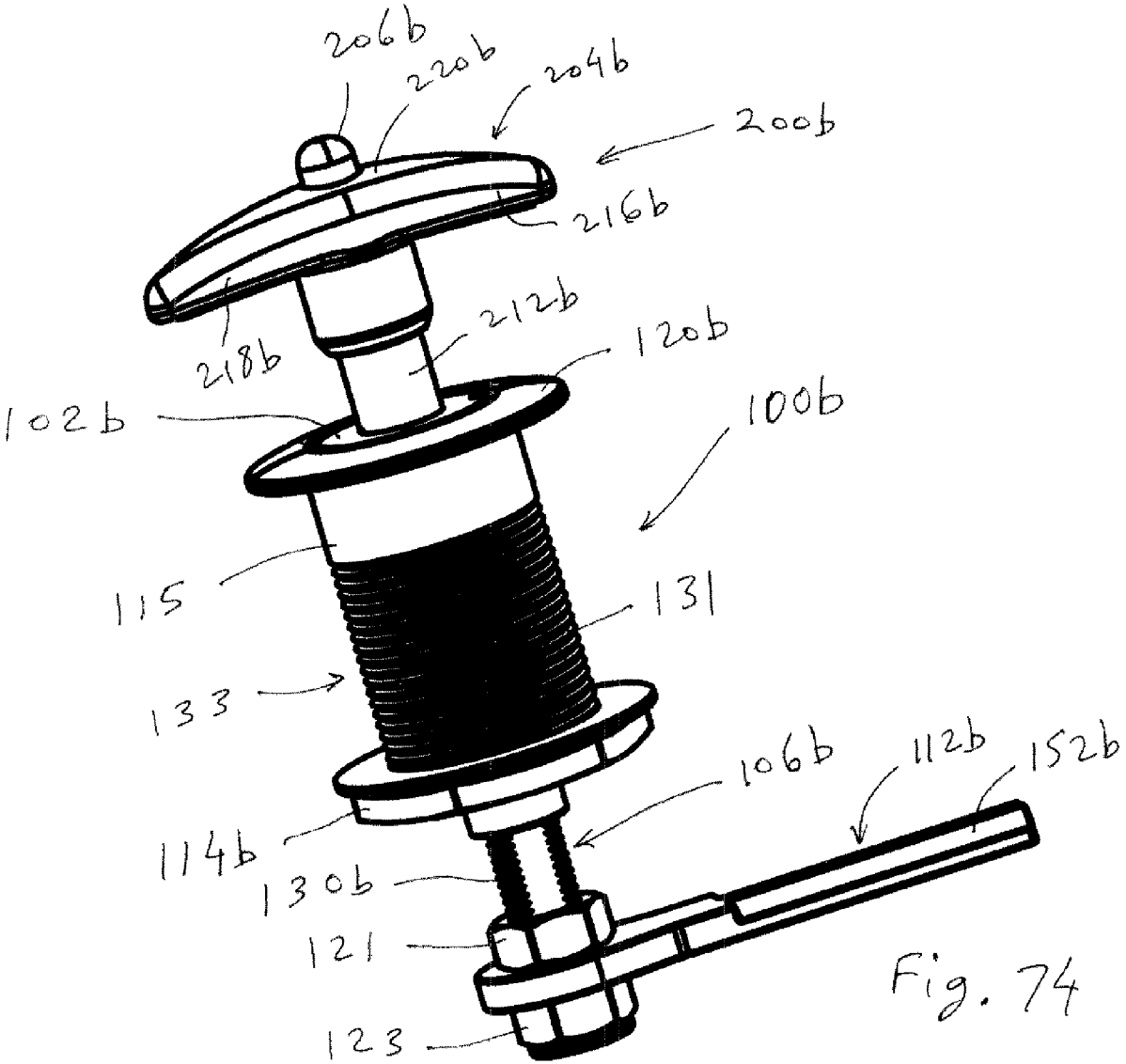
FIG. 74 is a view of the third embodiment of a latch assembly and T-handle actuator according to the present invention showing the T-handle actuator inserted onto the socket of the latch assembly.
Figure 75:
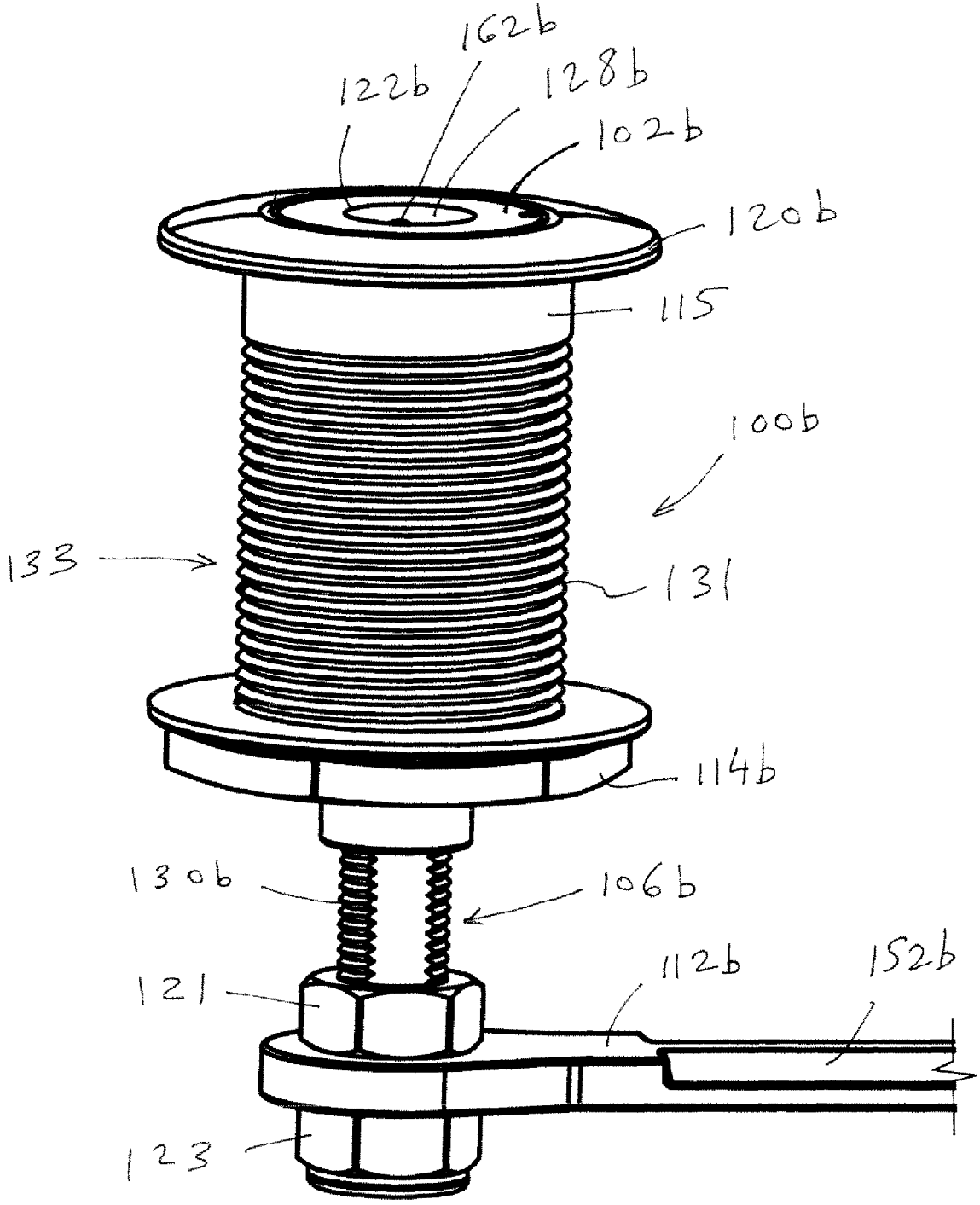
FIGS. 75-77 are various views of the third embodiment of a latch assembly according to the present invention.
Figure 76:
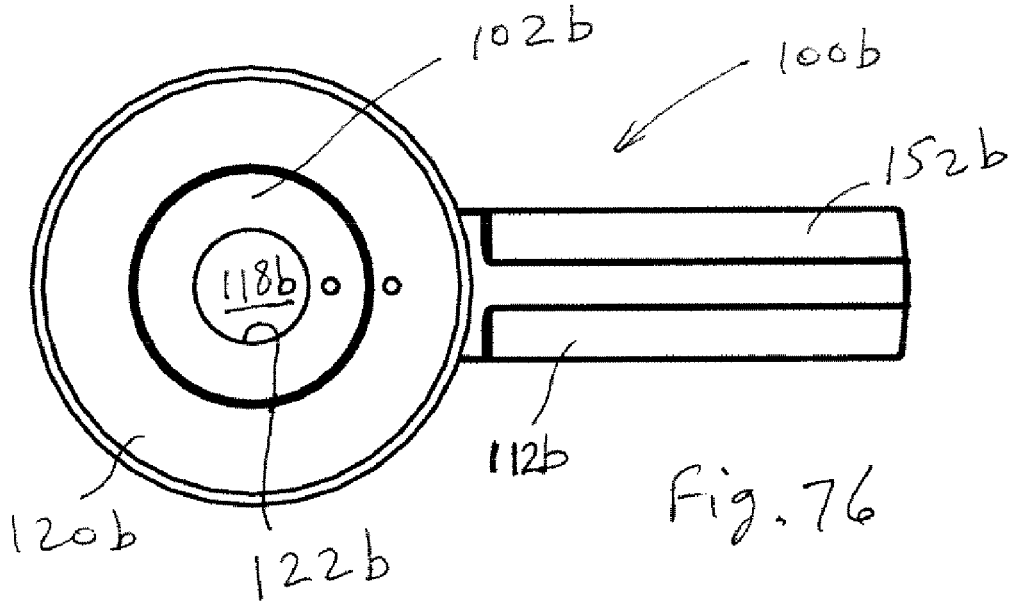
Figure 77:
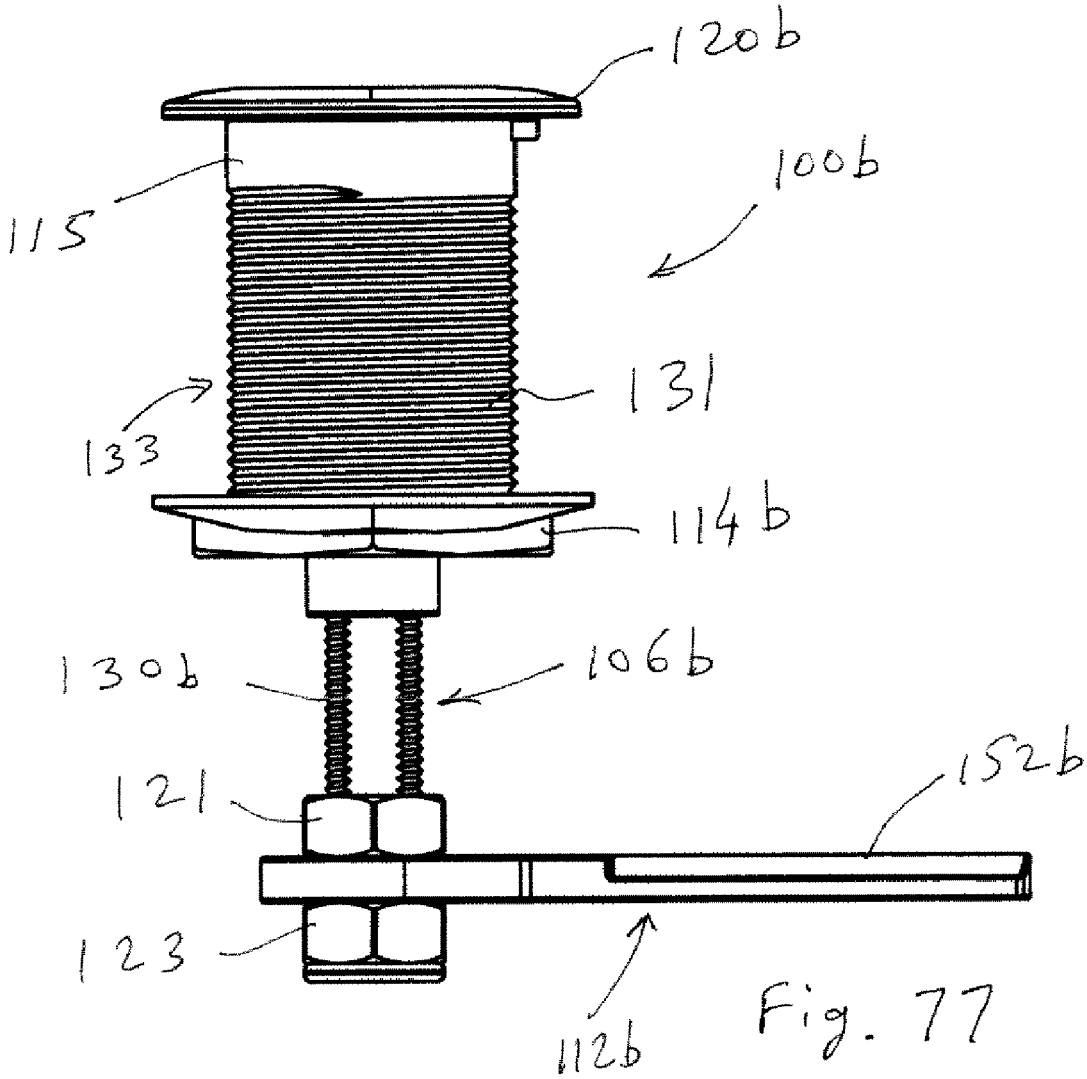
Figure 78:
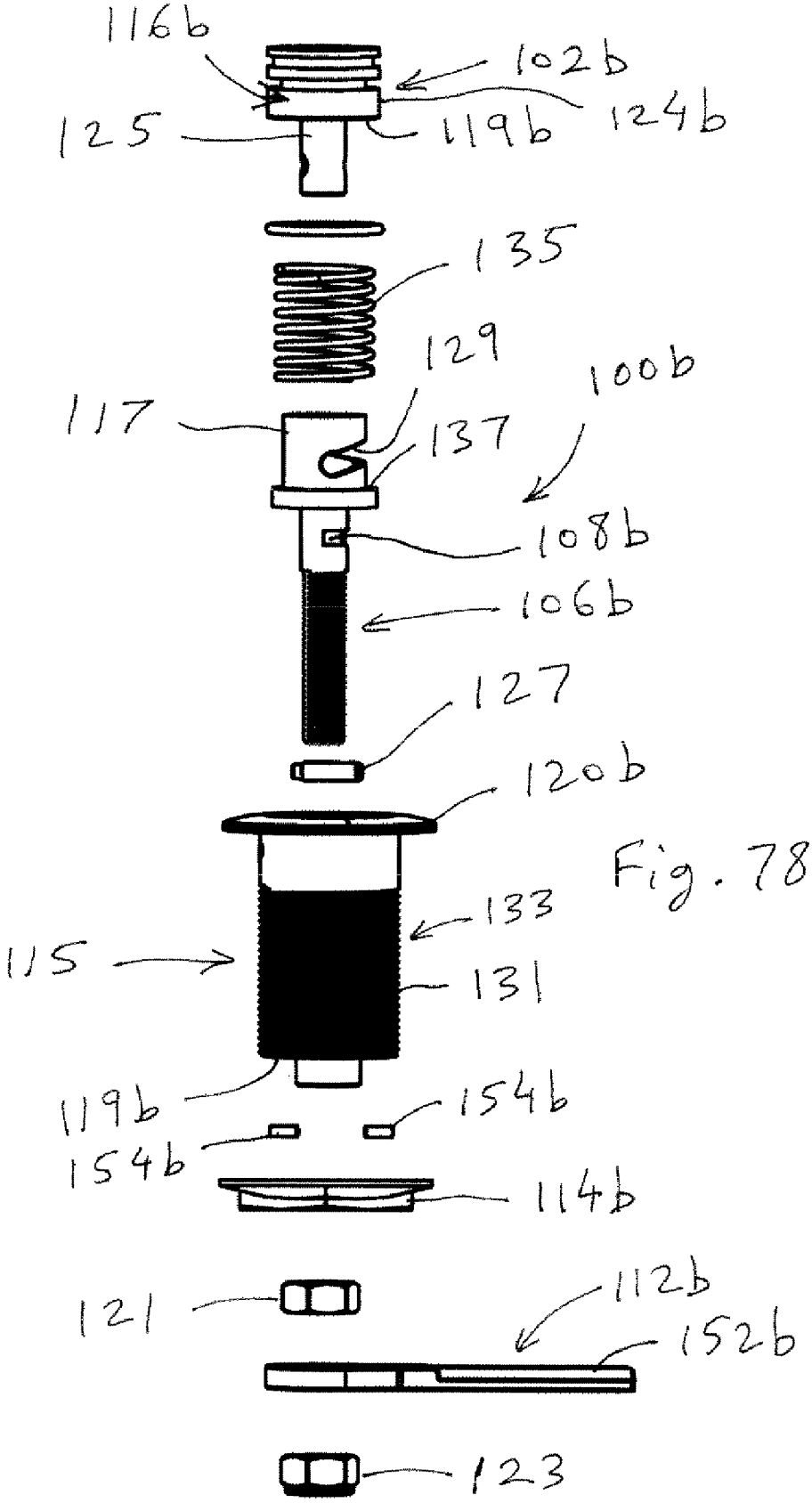
FIG. 78 is an exploded view of the third embodiment of a latch assembly according to the present invention.

The T-handle actuator and socket system of the present invention can be applied to almost any latch that is operated by a rotational or turning input. For example, the T-handle actuator and socket system of the present invention can be seen applied to a "pull-up" latch in FIGS. 70-78. Another pull-up latch with which the T-handle actuator and socket system of the present invention can be used is illustrated in U.S. Pat. No. 4,583,775, issued on Apr. 22, 1986, to Robert H. Bisbing.

Referring to FIGS. 74-78, a third embodiment of a latch 100*b* in accordance with the present invention can be seen. The latch 100*b* includes a drive plug 102*b*, a shaft 106*b*, a housing 115, a cam sleeve 117, a mounting nut 114*b*, a pawl 112*b*, and two pawl mounting nuts 121 and 123. The drive plug 102*b* has a cylindrical outer surface 124*b* extending between a bottom surface 119*b* and a top opening 122*b*. The drive plug 102*b* is rotationally supported proximate the top flange 120*b* of the housing 115. The housing 115 has external threads 131. The housing 115 is positioned in the opening 103 of the door 101 with the flange 120*b* in contact with the exterior surface 105 of the door 101 and with the threaded body 133 of the housing 115 extending through the opening 103 to the interior side of the door 101. The nut 114*b* is engaged to the external threads 131 of the housing 115 and tightened to secure the latch 110*b* to the door 101.

A shaft 125 extends from the bottom surface 119*b* of the drive plug 102*b* and has a longitudinal axis. The shaft 125 supports a pin 127 at a right angle to its longitudinal axis. The shaft 106*b* is attached to the cam sleeve 117 such that the shaft 106*b* and the cam sleeve 117 rotate together as a unit about the longitudinal axis of the shaft 106*b*. The pin 127 engages a spiral cam slot 129 in the cam sleeve 117 such that relative rotation between the drive plug 102*b* and the cam sleeve 117 causes the shaft 106*b* to move rectilinearly in a direction parallel to the longitudinal axis of the shaft 106*b*. The shaft 106*b* has at least a portion that is threaded and has a non-circular cross section.

The pawl 112*b* is capable of engaging the second closure member 109, which is a doorframe in the illustrated example, to secure the first closure member, in this example the door 101, in the closed position once the latch mechanism 100*b* is in the latched configuration and installed to the first closure member 101. The pawl 112*b* has a hole for mounting the pawl 112*b* to the shaft 106*b* and a latching portion 152*b*. The shaft 106*b* has at least one L-shaped motion control slot 108*b* and corresponding motion control pins 154*b*. The motion control pins 154*b* are pressed into holes in the sides of the housing 115 and engage corresponding L-shaped motion control slots 108*b*. Each motion control slot 108*b* has an axial portion that extends parallel to the longitudinal axis of the shaft 106*b* and an arc-shaped portion extending along the surface of the non-threaded portion of the shaft 106*b*. The arc-shaped portion of each motion control slot 108*b* is perpendicular to the corresponding axial portion of each motion control slot 108*b*. When the motion control pins 154*b* are positioned in the arc-shaped portions of the corresponding motion control slots 108*b*, the shaft 106*b* cannot move rectilinearly relative to the housing 115. Therefore, as the drive plug 102*b* is turned, the pin 127 acts on one or the other side of the spiral cam slot 129 to rotate the shaft 106*b* about its longitudinal axis in response to the turning of the drive plug 102*b*. When the motion control pins 154*b* are positioned in the axial portions of the corresponding motion control slots 108*b*, the shaft 106*b* cannot move rotationally about its longitudinal axis. Therefore, as the drive plug 102*b* is turned, the pin 127 acts on one or the other side of the spiral cam slot 129 to move the shaft 106*b* rectilinearly relative to the housing 115. Accordingly, the shaft 106*b* moves in a sequence of a rotation followed by a rectilinear motion as the drive plug 102*b* is turned from the unlatched position to the latched position. Also, the shaft 106*b* moves in a sequence of a rectilinear motion followed by a rotation as the drive plug 102*b* is turned from the latched position to the unlatched position. A spring 135 held between the bottom surface 119*b* of the drive plug 102*b* and a shoulder 137 of the cam sleeve 117 biases the shaft 106*b* toward its extended position where the shaft 106*b* projects outward from the bottom of the housing 115 to the greatest extent.

The shaft 106*b* extends through the hole of the pawl 112*b*. The hole of the pawl is non-circular and has a size and shape that allows the pawl 112*b* to be positioned adjustably along the shaft 106*b*, while essentially preventing relative rotation between the pawl 112*b* and the shaft 106*b* about the longitudinal axis of the shaft 106*b*. The nuts 121 and 123 engage the shaft 106*b* to secure the pawl 112*b* to the shaft 106*b* at the desired location.

The latch mechanism 100*b* is for use with a first closure member 101 having an opening 103 for the installation of the latch mechanism 100*b*. The latch mechanism 100*b* is capable of selectively securing the first closure member 101 in a closed position relative to a second closure member 109. The drive plug 102 is adapted for engagement by the T-handle actuator 200*b* so as to allow a user to turn the drive plug 102*b* to operate the latch mechanism 100*b*. The pawl 112*b* is moved between a latched position and an unlatched position in a sequence of rotational and rectilinear motions in response to the rotation of the drive plug 102*b* between its latched position and its unlatched position.

The drive plug 102*b* is a socket 102*b* that is specially designed for engagement and turning by the actuator 200*b* as is described below. The socket 102*b* has a cylindrical side wall 116*b* and a bottom 118*b*. The socket 102*b* is essentially in the form of a cup with an open top 122*b*. The cylindrical side wall 116*b* and the bottom 118*b* together define the main cavity 128*b* of the socket 102*b*. The socket 102*b* has a longitudinal axis that is the same as the longitudinal axis of the cylindrical side wall 116*b* and the longitudinal axis of the main cavity 128*b*. The main cavity 128*b* is sized to receive the second end portion 202*b* of the T-handle actuator 200*b*.

The shaft 106*b* has a threaded portion 130*b*. The threads of the threaded portion 130*b* are interrupted by two flat surfaces on either side of the threaded portion 130*b* of the shaft 106*b*. The flat surfaces or sides of the threaded portion 130*b* at least in part give the shaft 106*b* a non-circular cross section. Accordingly, the pawl 112*b* is coupled to the shaft 106*b* such that the pawl 112*b* moves with the shaft 106*b* as a unit.

The latch mechanism 100*b* is mounted to a first closure member, for example the door 101, as previously described. The pawl 112*b* is capable of engaging the second closure member, for example the doorframe 109, to secure the first closure member, for example the door 101, in the closed position relative to the second closure member. The latch mechanism 100*b* can be used to selectively secure the door 101 in the closed position relative to the doorframe 109. A user can turn the socket 102*b* between a latched position and an unlatched position using the actuator 200*b*.

In the latched position the pawl 112*b*, in particular the latching portion 152*b* of the pawl 112*b*, would engage the doorframe 109 and prevent the door 101 from being opened if an attempt was made to do so. To open the door 101, a user turns the socket 102*b* using the actuator 200*b* from the latched position to the unlatched position thereby moving the pawl 112*b*, in a sequence of a rectilinear motion away from the housing 115 followed by a rotational motion, from the latched position to the unlatched position where the latching portion 152*b* of the pawl 112*b* no longer overlaps any part of the doorframe 109. The door 101 can now be opened because the pawl 112*b* can no longer engage the doorframe 109.

To once again secure the door 101 in the closed position, the user rotates the socket 102*b* from the unlatched position to the latched position with the door 101 closed using the actuator 200*b*. As the socket 102*b* is rotated from the unlatched position to the latched position, the pawl 112*b* is rotated from the unlatched position until the latching portion 152*b* of the pawl 112*b* moves behind the doorframe 109 and then the pawl 112*b* moves rectilinearly toward the housing 115 to thereby draw or pull the door 101 and the doorframe 109 together, thus securing the door 101 in the closed position.

Referring to FIGS. 70-74, a latch actuator 200*b* for use with the latch mechanism 100*b* can be seen. The latch mechanism 100*b* has a socket 102*b* that is moved rotationally to operate the latch mechanism 100*b*, as has already been described. The socket 102*b* has a main cavity 128*b* that has a wall 116*b*. The wall 116*b* has two lateral cavities 162*b*. The opening of each lateral cavity 162*b* faces toward the interior of the main cavity 128*b*. In other words, the opening of each lateral cavity 162*b* faces toward the longitudinal axis of the socket 102*b*.

The actuator 200*b* includes a T-shaped handle portion 204*b*, a distal end or second end portion 202*b*, a pushbutton 206*b*, and two ball bearings 208*b*. The two ball bearings 208*b* are in positions corresponding to the positions of the lateral cavities 162*b* such that the ball bearings 208*b* can engage the lateral cavities 162*b* when the distal end 202*b* is inserted into the main cavity 128*b*.

The T-shaped handle portion 204*b* is for grasping by a user. The distal end portion 202*b* is distal from the handle portion 204*b* and is adapted for insertion into the socket 102*b*. The distal end portion 202*b* has an exterior surface 210*b*. The pushbutton 206*b* is supported by the handle portion 204*b* for movement between an extended position and a retracted position. The ball bearings 208*b* are movably supported by the distal end portion 202*b* such that the ball bearings 208*b* are each movable between an extended position and a retracted position. Each ball bearing 208*b* projects outward from the exterior surface 210*b* of the distal end 202*b* when the ball bearing 208*b* is in the extended position. Each ball bearing 208*b* does not project outward from the exterior surface 210*b* of the distal end 202*b* when the ball bearing 208*b* is in the retracted position. Each ball bearing 208*b* is maintained in its extended position when the pushbutton 206*b* is in its extended position. Each ball bearing is free to move to its retracted position when the pushbutton 206*b* is pushed in by a user to its retracted position. Each ball bearing 208*b* is capable of engaging a corresponding lateral cavity 162*b* of the socket 102*b* such that the socket 102*b* will turn as the handle portion 204*b* is turned by a user when each ball bearing 208*b* is in its extended position. A user holds the pushbutton 206*b* in the retracted position to allow the ball bearings 208*b* to retract in order to insert the distal end 202*b* into the socket 102*b* and in order to withdraw the distal end 202*b*, and consequently remove the actuator 200*b*, from the socket 102*b*. Once the distal end 202*b* is properly inserted, the user releases the pushbutton 206*b* allowing it to move to its extended position under spring bias. Each ball bearing 208*b* then engages a corresponding lateral cavity 162*b* of the socket 102*b*, and the user can then turn the socket 102*b* to operate the latch mechanism 100*b* to latch and unlatch the door 101 using the T-handle actuator 200*b*.

The T-handle actuator 200*b* further includes a sleeve 212*b*, a pair of lateral arms 216*b* and 218*b*, a plunger 226*b*, and a spring 234*b*. The sleeve 212*b* has a bore extending along the longitudinal axis of the sleeve 212*b*. The pair of lateral arms 216*b* and 218*b* is provided at a first end portion 220*b* of the sleeve 212*b*. The lateral arms 216*b* and 218*b* extend in opposite directions from the first end portion 220*b* of the sleeve 212*b* so as to form a T-shaped configuration with the sleeve 212*b* to thereby define a T-handle 222*b*. The arms 216*b* and 218*b* and the sleeve 212*b*, excluding the second end portion 202*b*, define the T-handle portion 204*b*. The sleeve 212*b* has a hole at its first end portion 220*b* that allows the push button 206 to project outward from the sleeve 212*b*.

The plunger 226*b* is supported for rectilinear motion in the bore of the sleeve 212*b*. The plunger 226*b* is rectilinearly movable between an extended position and a retracted position. The plunger 226*b* has a button portion 228*b* that projects outward from the hole in the first end of the sleeve 212*b* when the plunger 226*b* is in the extended position so as to define the pushbutton 206*b*. The pushbutton 206*b* is movable between an extended position corresponding to the extended position of the plunger 226*b* and a retracted position corresponding to the retracted position of the plunger 226*b*.

A user can move the plunger 226*b* to the retracted position by pushing the pushbutton 206*b* inward relative to the bore of the sleeve 212*b*. The plunger 226*b* has at least one portion of a first diameter 230*b* and at least one portion of a second diameter 232*b*. The first diameter is larger than the second diameter. The spring 234*b* biases the plunger 226*b* toward its extended position.

The sleeve 212 has two lateral openings 236*b* in the second end portion 202*b* of the sleeve 212*b*. Each lateral opening 236*b* extends between the bore of the sleeve 212*b* and the exterior surface 210*b*. Each ball bearing 208*b* is in registry with a corresponding lateral opening 236*b*. Each ball bearing 208*b* is movable between an extended position and a retracted position. Each ball bearing 208*b* projects outward in part from the exterior surface 210*b* when the ball bearing 208*b* is in its extended position. Each ball bearing 208*b* is in its extended position when the plunger 226*b* and consequently the pushbutton 206*b* are in their extended positions. The portion 230*b* of the plunger 226*b* having the first diameter is in registry with the ball bearings 208*b* to thereby maintain both the ball bearings 208*b* in their extended positions, when the plunger 226*b* and the pushbutton 206*b* are in their extended positions. The portion 232*b* of the plunger 226*b* having the second diameter is in registry with the ball bearings 208*b* to thereby allow movement of both the ball bearings 208*b* to their retracted positions, when the plunger 226*b* and consequently the pushbutton 206*b* are in their retracted positions.

When the second end portion 202*b* of the sleeve 212*b* is inserted into the socket 102*b* with each lateral opening 236*b* in registry with a corresponding lateral cavity 162*b* in the socket 102*b* and with the plunger 226*b* and the pushbutton 206*b* in their extended positions, each ball bearing 208*b* will be in its extended position and will project in part into its corresponding lateral cavity 162*b* in the socket 102*b*. Under these conditions, the ball bearings 208*b* can engage the corresponding lateral cavities 162*b* such that a user can turn the socket 102*b* and thus operate the latch mechanism 100*b* by turning the T-handle actuator 200*b*.

When the second end portion 202*b* of the sleeve 212*b* is inserted into the socket 102*b* with each lateral opening 236*b* in registry with a corresponding lateral cavity 162*b* in the socket 102*b* and with the plunger 226*b* and the pushbutton 206*b* in their extended positions, a user can push in the pushbutton 206*b* to its retracted position to allow movement of the ball bearings 208*b* to their retracted positions and thereby allow the latch actuator 200*b* to be removed from the socket 102*b*.

The diameter of the portion 232*b* of the plunger 226*b* is selected such that each ball bearing 208*b* extends in part into its corresponding lateral opening 236*b* in the wall of the sleeve 212*b* even when the ball bearing 208*b* is in its retracted position. This arrangement ensures that each ball bearing 208*b* will remain in substantial alignment with its corresponding lateral opening 236*b* so that each ball bearing 208*b* is properly positioned, even when retracted, to return to its extended position when the plunger 226*b* returns to its extended position. The sleeve 212*b* is of two-piece construction.

The sleeves 212, 212*a*, and 212*b* a larger outside diameter between the handle arms and the second end portions 202, 202*a*, and 202*b* as compared to the outside diameter of the second end portions 202, 202*a*, and 202*b*. This provides a means of decreasing the likelihood that an actuator can be used to operate a latch for which it was not intended by limiting the length of the second end portions 202, 202*a*, and 202*b* that can be inserted into the socket. The sleeves 212 and 212*a* have more lateral openings 236 and 236*a* than necessary. This allows the pattern of the ball bearings and lateral cavities to be changed without having to manufacture a custom actuator sleeve for every latch mechanism. An actuator can have fewer ball bearings than there are lateral cavities in a particular latch and could therefore act as a master key for several latches as long as all the ball bearings in the actuator can simultaneously align with a subset of the lateral cavities in each of the several latches. The actuator of the present invention can be provided with more than two sets of axially spaced ball bearings for use with a latch socket having more than two sets of axially spaced lateral cavities, as long as corresponding portions having the first and second diameters are added along the length of the plunger 226 or 226*a*.

It will be apparent to those skilled in the art that various modifications can be made to the latch and actuator of the present invention without departing from the scope and spirit of the invention, and it is intended that the present invention cover modifications and variations of the latch and actuator which are within the scope of the appended claims and their equivalents.

The invention claimed is:

1. A latching system comprising:

a latch mechanism for selectively securing a first member in a closed position relative to a second member, said latch mechanism comprising:

a socket that is moved rotationally to operate said latch mechanism, said socket having a main cavity having a wall having at least three lateral cavities therein;

a shaft operably connected to said socket such that said shaft moves responsive to a movement of said socket; and a pawl operably connected to said shaft such that said pawl moves between a latched position and an unlatched position responsive to a movement of said socket, wherein said latch mechanism is adapted for mounting to the first member and wherein said pawl engages the second member so as to secure the first member in the closed position relative to the second member when the first member is in the closed position relative to the second member, said latch mechanism is mounted to the first member, and said pawl is in said latched position; and a latch actuator comprising:

a sleeve having a bore extending along a longitudinal axis of said sleeve;

a pair of lateral arms provided at a first end portion of said sleeve, said lateral arms extending in opposite directions from said first end portion of said sleeve so as to form a T-shaped configuration with said sleeve to thereby define a T-handle, wherein said sleeve has a hole at said first end portion thereof that communicates with said bore, said hole being located intermediate said lateral arms;

a plunger supported for rectilinear motion in said bore, said plunger being rectilinearly movable between an extended position and a retracted position, said plunger having a button portion that projects from said hole when said plunger is in said extended position so as to define a pushbutton that is movable between an extended position corresponding to said extended position of said plunger and a retracted position corresponding to said retracted position of said plunger, wherein a user can move said plunger to said retracted position by pushing said pushbutton inward relative to said bore, said plunger having at least one portion of a first diameter and at least one portion of a second diameter, said first diameter being larger than said second diameter;

a spring biasing said plunger toward said extended position; and at least three ball bearings received at least in part within said bore, said sleeve having a second end portion distal from said lateral arms that is dimensioned for insertion into said main cavity of said socket, said sleeve having at least three lateral openings in said second end portion of said sleeve, said sleeve having an exterior surface, said lateral openings extending between said bore and said exterior surface, each of said ball bearings being in registry with a respective one of said lateral openings, each of said ball bearings being movable between an extended position and a retracted position, each of said ball bearings projecting in part from said exterior surface when each of said ball bearings is in its extended position, each of said ball bearings being in its extended position when said plunger and consequently said pushbutton are in their extended positions, said portion of said plunger having said first diameter being in registry with said ball bearings to thereby maintain each of said ball bearings in its extended position when said plunger and said pushbutton are in their extended positions, said portion of said plunger having said second diameter being in registry with said ball bearings to thereby allow movement of each of said ball bearings to its retracted position when said plunger and consequently said pushbutton are in their retracted positions, wherein when said second end portion of said sleeve is inserted into said socket with each of said ball bearings in registry with a respective one of said lateral cavities in said socket and said plunger and said pushbutton are in their extended positions, each of said ball bearings will be in its extended position and projecting in part into a respective one of said lateral cavities of said socket such that a user can turn said sleeve by turning said T-handle to thereby turn said socket and thus operate said latch mechanism, and wherein when said second end portion of said sleeve is inserted into said socket with each of said ball bearings in registry with said respective one of said lateral cavities of said socket and said plunger and said pushbutton are in their extended positions, a user can push in said pushbutton to its retracted position to allow movement of each of said ball bearings to its retracted position and thereby allow said latch actuator to be removed from said socket.

2. The latching system according to claim 1, wherein said spring is a coil spring and said plunger extends through said coil spring, wherein said plunger has an annular step and said sleeve has an annular step, said annular step of said plunger is positioned intermediate said button portion and said annular step of said sleeve, and said coil spring extends between said annular step of said plunger and said annular step of said sleeve to thereby bias said plunger and said pushbutton to their extended positions.

3. The latching system according to claim 1, wherein said second diameter is selected such that each of said ball bearings extends in part into its respective one of said lateral openings of said sleeve even when each of said ball bearings is in its retracted position such that each of said ball bearings will remain in substantial alignment with its respective one of said lateral openings of said sleeve to allow each of said ball bearings to return to its extended position when said plunger returns to its extended position.

4. The latching system according to claim 1, wherein said lateral arms are in the form of U-shaped bars having a bend portion extending between two lateral bar portions, and each of said lateral bar portions has a distal end portion distal from said bend portion, and wherein said distal end portions of said lateral bar portions are attached to said first end portion of said sleeve.

5. The latching system according to claim 1, wherein the main cavity of the socket has an inner lateral wall surface, wherein the at least three lateral cavities are distributed in a predetermined pattern of locations over the inner lateral wall surface of the socket, wherein said at least three ball bearings and their corresponding ones of said at least three lateral openings are provided in said second end portion of said sleeve in a pattern of locations matching the pattern of locations of respective ones of the at least three lateral cavities of the socket wherein said at least three ball bearings are provided in said bore of said sleeve in a number matching the number of the at least three lateral cavities of the socket, wherein each of said at least three ball bearings is in substantial alignment with a corresponding one of said at least three lateral openings of said sleeve, and wherein those lateral openings of said at least three lateral openings having one of said at least three ball bearings in substantial alignment therewith are provided in a number and pattern of locations matching the number and pattern of locations of the at least three lateral cavities of the socket.

6. The latching system according to claim 5, wherein the at least three lateral cavities of the socket includes a first plurality of lateral cavities and a second plurality of lateral cavities provided at spaced separation from said first plurality of lateral cavities along a longitudinal axis of the main cavity of the socket, wherein said at least three lateral openings provided in said second end portion of said sleeve at least includes a first plurality of lateral openings at least corresponding in number and pattern to said first plurality of lateral cavities and a second plurality of lateral openings at least corresponding in number and pattern to said second plurality of lateral cavities, wherein said second plurality of lateral openings is provided at spaced separation from said first plurality of lateral openings along a longitudinal axis of said sleeve, wherein said at least three ball bearings includes a first plurality of ball bearings and a second plurality of ball bearings, each of said first plurality of ball bearings is in substantial registry with a corresponding one of said first plurality of lateral openings of said sleeve, each of said second plurality of ball bearings is in substantial registry with a corresponding one of said second plurality of lateral openings of said sleeve, wherein said plunger has a first portion of said first diameter, a second portion of said first diameter, a first portion of said second diameter and a second portion of said second diameter, wherein said first portion of said second diameter is intermediate said first portion of said first diameter and said second portion of said first diameter along said longitudinal axis of said plunger, wherein said second portion of said first diameter is intermediate said first portion of said second diameter and said second portion of said second diameter along said longitudinal axis of said plunger, wherein each of said first plurality of ball bearings is movable between an extended position and a retracted position, wherein each of said second plurality of ball bearings is movable between an extended position and a retracted position, wherein each of said first plurality of ball bearings projects in part from said exterior surface when each of said first plurality of ball bearings is in its extended position, wherein each of said second plurality of ball bearings projects in part from said exterior surface when each of said second plurality of ball bearings is in its extended position, wherein each of said first plurality of ball bearings and said second plurality of ball bearings is in its extended position when said plunger and said pushbutton are in their extended positions, wherein said first portion of said plunger having said first diameter is in registry with said first plurality of ball bearings to thereby maintain said first plurality of ball bearings in their extended positions when said plunger and said pushbutton are in their extended positions, wherein said second portion of said plunger having said first diameter is in registry with said second plurality of ball bearings to thereby maintain said second plurality of ball bearings in their extended positions when said plunger and said pushbutton are in their extended positions, wherein said first portion of said plunger having said second diameter is in registry with said first plurality of ball bearings to thereby allow movement of each of said first plurality of ball bearings to its retracted position when said plunger and said pushbutton are in their retracted positions, and wherein said second portion of said plunger having said second diameter is in registry with said second plurality of ball bearings to thereby allow movement of each of said second plurality of ball bearings to its retracted position when said plunger and said pushbutton are in their retracted positions.

7. The latching system according to claim 1, further comprising a pin passing through a wall of said sleeve and engaging a groove in said plunger in order to limit outward movement of said plunger relative to said sleeve and to prevent said plunger from moving past its extended position in a direction that is the same as a direction of movement defined by movement of said plunger from its retracted position to its extended position.

8. A latching system comprising:

a latch mechanism for selectively securing a first member in a closed position relative to a second member, said latch mechanism comprising:

a socket that is moved rotationally to operate said latch mechanism, said socket having a main cavity having a wall having at least three lateral cavities therein;

a shaft operably connected to said socket such that said shaft moves responsive to a movement of said socket; and a pawl operably connected to said shaft such that said pawl moves between a latched position and an unlatched position responsive to a movement of said socket, wherein said latch mechanism is adapted for mounting to the first member and wherein said pawl engages the second member so as to secure the first member in the closed position relative to the second member when the first member is in the closed position relative to the second member, said latch mechanism is mounted to the first member, and said pawl is in said latched position; and a latch actuator comprising:

a T-shaped handle portion for grasping by a user;

a distal end portion distal from said handle portion and being adapted for insertion into said socket, said distal end portion having an exterior surface;

a pushbutton supported by said handle portion for movement between an extended position and a retracted position; and at least three ball bearings movably supported by said distal end portion, each of said ball bearings being movable between an extended position and a retracted position, each of said ball bearings projecting from said exterior surface of said distal end when each of said ball bearings is in said extended position, each of said ball bearings not projecting from said exterior surface of said distal end when each of said ball bearings is in said retracted position, each of said ball bearings being maintained in its extended position when said pushbutton is in its extended position, each of said ball bearings being free to move to its retracted position when said pushbutton is in its retracted position, wherein each of said ball bearings is capable of engaging a corresponding one of said lateral cavities of said socket in order to turn said socket with said handle portion when each of said ball bearings is in its extended position.

9. The latching system according to claim 8, wherein the main cavity of the socket has an inner lateral wall surface, wherein the at least three lateral cavities of the socket are of a predetermined number distributed in a predetermined pattern of locations over the inner lateral wall surface of the socket, and wherein each of said at least three ball bearings can be placed in substantial alignment with a corresponding one of the at least three lateral cavities of the socket simultaneously with all others of said at least three ball bearings.

10. A latch mechanism for use with a first closure member having an opening for the installation of the latch mechanism, the latch mechanism being capable of selectively securing the first closure member in a closed position relative to a second closure member, the latch mechanism comprising:

a drive plug having a cylindrical outer surface extending between a bottom surface and a top flange, said drive plug being adapted for engagement by an actuator so as to allow a user to turn said drive plug to operate the latch mechanism;

a shaft extending from said bottom surface of said drive plug and having a longitudinal axis, said shaft being attached to said drive plug such that said drive plug and said shaft rotate together as a unit about said longitudinal axis of said shaft, said shaft having at least a portion with a non-circular cross section;

a guide washer having a center hole and an off-center hole, said guide washer also having a pair of axial projections extending at least in part parallel to said longitudinal axis of said shaft, said center hole of said guide washer being large enough so that said shaft can rotate relative to said guide washer without any interference from portions of said guide washer defining said center hole;

a fastener capable of engaging said off-center hole of said guide washer and the first closure member to prevent rotation of the guide washer relative to the first closure member in the fully assembled latch mechanism installed to the first closure member;

a pawl capable of engaging the second closure member to secure the first closure member in the closed position once the latch mechanism is fully assembled and installed to the first closure member, said pawl having a hole, a latching portion and a motion control tab, said shaft extending through said hole of said pawl, said hole of said pawl being non-circular and having a size and shape that allows said pawl to be positioned adjustably along said shaft, said pawl being coupled to said shaft such that said pawl rotates in response to rotation of said shaft; and a nut engaging said shaft to secure said pawl to said shaft, said pawl being rotated between a latched position and an unlatched position in response to rotation of said drive plug, said motion control tab cooperating with said axial projections of said guide washer to define limits of rotational motion of said pawl.

11. The latch mechanism according to claim 10, further comprising a spacer bushing having a barrel portion sized to fit in the opening in the first closure member and an annular flange that fits between said guide washer and said pawl, said spacer bushing having a bore extending through said spacer bushing, said shaft extending through said bore of said spacer bushing.

12. The latch mechanism according to claim 11, further comprising a spacer washer positioned under said top flange of said drive plug and fitting around said outer surface of said drive plug, said spacer washer fitting between said top flange of said drive plug and an exterior surface of the first closure member to allow said drive plug to rotate relative to the first closure member without damaging the exterior surface of the first closure member once the latch mechanism is fully assembled and installed to the first closure member.

13. The latch mechanism according to claim 10, wherein said motion control tab engages a first one of said pair of axial projections of said guide washer to stop rotation of said pawl at said latched position, and said motion control tab engages a second one of said pair of axial projections of said guide washer to stop rotation of said pawl at said unlatched position.

14. A latching system comprising the latch mechanism according to claim 10, wherein said drive plug is a socket, said socket having a main cavity having a wall having at least one lateral cavity therein, the latching system further comprising:

a latch actuator adapted for rotationally moving said socket to operate the latch mechanism, said latch actuator comprising:

a sleeve having a bore extending along a longitudinal axis of said sleeve;

a pair of lateral arms provided at a first end portion of said sleeve, said lateral arms extending in opposite directions from said first end portion of said sleeve so as to form a T-shaped configuration with said sleeve to thereby define a T-handle, wherein said sleeve has a hole at said first end portion thereof that communicates with said bore, said hole being located intermediate said lateral arms;

a plunger supported for rectilinear motion in said bore, said plunger being rectilinearly movable between an extended position and a retracted position, said plunger having a button portion that projects from said hole when said plunger is in said extended position so as to define a pushbutton that is movable between an extended position corresponding to said extended position of said plunger and a retracted position corresponding to said retracted position of said plunger, wherein a user can move said plunger to said retracted position by pushing said pushbutton inward relative to said bore, said plunger having at least one portion of a first diameter and at least one portion of a second diameter, said first diameter being larger than said second diameter;

a spring biasing said plunger toward said extended position; and at least one ball bearing received at least in part within said bore, said sleeve having a second end portion distal from said lateral arms that is dimensioned for insertion into said main cavity of said socket, said sleeve having at least one lateral opening in said second end portion of said sleeve, said sleeve having an exterior surface, said lateral opening extending between said bore and said exterior surface, said ball bearing being in registry with said lateral opening, said ball bearing being movable between an extended position and a retracted position, said ball bearing projecting in part from said exterior surface when said ball bearing is in its extended position, said ball bearing being in its extended position when said plunger and consequently said pushbutton are in their extended positions, said portion of said plunger having said first diameter being in registry with said ball bearing to thereby maintain said ball bearing in its extended position when said plunger and said pushbutton are in their extended positions, said portion of said plunger having said second diameter being in registry with said ball bearing to thereby allow movement of said ball bearing to its retracted position when said plunger and consequently said pushbutton are in their retracted positions, wherein when said second end portion of said sleeve is inserted into said socket with said lateral opening in registry with said lateral cavity in said socket and said plunger and said pushbutton are in their extended positions, said ball bearing will be in its extended position and projecting in part into said lateral cavity of said socket such that a user can turn said sleeve by turning said T-handle to thereby turn said socket and thus operate the latch mechanism, and wherein when said second end portion of said sleeve is inserted into said socket with said lateral opening in registry with said lateral cavity in said socket and said plunger and said pushbutton are in their extended positions, a user can push in said pushbutton to its retracted position to allow movement of said ball bearing to its retracted position and thereby allow the latch actuator to be removed from said socket.

15. The latching system according to claim 14, wherein said spring is a coil spring and said plunger extends through said coil spring, wherein said plunger has an annular step and said sleeve has an annular step, said annular step of said plunger is positioned intermediate said button portion and said annular step of said sleeve, and said coil spring extends between said annular step of said plunger and said annular step of said sleeve to thereby bias said plunger and said pushbutton to their extended positions.

16. The latching system according to claim 14, wherein said second diameter is selected such that said ball bearing extends in part into said lateral opening of said sleeve even when said ball bearing is in its retracted position such that said ball bearing will remain in substantial alignment with said lateral opening of said sleeve to allow said ball bearing to return to its extended position when said plunger returns to its extended position.

17. The latching system according to claim 14, wherein said lateral arms are in the form of U-shaped bars having a bend portion extending between two lateral bar portions, and each of said lateral bar portions has a distal end portion distal from said bend portion, and wherein said distal end portions of said lateral bar portions are attached to said first end portion of said sleeve.

18. The latching system according to claim 14, wherein said main cavity of said socket has an inner lateral wall surface, wherein said at least one lateral cavity of said socket is one of a plurality of lateral cavities of a predetermined number distributed in a predetermined pattern of locations over said inner lateral wall surface of said socket, wherein said at least one lateral opening of said second end portion of said sleeve is one of a plurality of lateral openings provided in said second end portion of said sleeve at least in a number and pattern of locations matching said number and pattern of locations of said plurality of lateral cavities of said socket, wherein said at least one ball bearing is one of a plurality of ball bearings provided in said bore of said sleeve in a number matching said number of said plurality of lateral cavities of said socket, wherein each of said plurality of ball bearings is in substantial alignment with a corresponding one of said plurality of lateral openings of said sleeve, and wherein those lateral openings of said plurality of lateral openings having one of said plurality of ball bearings in substantial alignment therewith are provided in a number and pattern of locations matching said number and pattern of locations of said plurality of lateral cavities of said socket.

19. The latching system according to claim 18, wherein said plurality of lateral cavities of said socket includes a first plurality of lateral cavities and a second plurality of lateral cavities provided at spaced separation from said first plurality of lateral cavities along a longitudinal axis of said main cavity of said socket, wherein said plurality of lateral openings provided in said second end portion of said sleeve at least includes a first plurality of lateral openings at least corresponding in number and pattern to said first plurality of lateral cavities and a second plurality of lateral openings at least corresponding in number and pattern to said second plurality of lateral cavities, wherein said second plurality of lateral openings is provided at spaced separation from said first plurality of lateral openings along a longitudinal axis of said sleeve, wherein said plurality of ball bearings includes a first plurality of ball bearings and a second plurality of ball bearings, each of said first plurality of ball bearings is in substantial registry with a corresponding one of said first plurality of lateral openings of said sleeve, each of said second plurality of ball bearings is in substantial registry with a corresponding one of said second plurality of lateral openings of said sleeve, wherein said plunger has a first portion of said first diameter, a second portion of said first diameter, a first portion of said second diameter and a second portion of said second diameter, wherein said first portion of said second diameter is intermediate said first portion of said first diameter and said second portion of said first diameter along said longitudinal axis of said plunger, wherein said second portion of said first diameter is intermediate said first portion of said second diameter and said second portion of said second diameter along said longitudinal axis of said plunger, wherein each of said first plurality of ball bearings is movable between an extended position and a retracted position, wherein each of said second plurality of ball bearings is movable between an extended position and a retracted position, wherein each of said first plurality of ball bearings projects in part from said exterior surface when each of said first plurality of ball bearings is in its extended position, wherein each of said second plurality of ball bearings projects in part from said exterior surface when each of said second plurality of ball bearings is in its extended position, wherein each of said first plurality of ball bearings and said second plurality of ball bearings is in its extended position when said plunger and said pushbutton are in their extended positions, wherein said first portion of said plunger having said first diameter is in registry with said first plurality of ball bearings to thereby maintain said first plurality of ball bearings in their extended positions when said plunger and said pushbutton are in their extended positions, wherein said second portion of said plunger having said first diameter is in registry with said second plurality of ball bearings to thereby maintain said second plurality of ball bearings in their extended positions when said plunger and said pushbutton are in their extended positions, wherein said first portion of said plunger having said second diameter is in registry with said first plurality of ball bearings to thereby allow movement of each of said first plurality of ball bearings to its retracted position when said plunger and said pushbutton are in their retracted positions, and wherein said second portion of said plunger having said second diameter is in registry with said second plurality of ball bearings to thereby allow movement of each of said second plurality of ball bearings to its retracted position when said plunger and said pushbutton are in their retracted positions.

20. The latching system according to claim 14, further comprising a pin passing through a wall of said sleeve and engaging a groove in said plunger in order to limit outward movement of said plunger relative to said sleeve and to prevent said plunger from moving past its extended position in a direction that is the same as a direction of movement defined by movement of said plunger from said its retracted position to its extended position.

21. A latching system comprising the latch mechanism according to claim 10, wherein said drive plug is a socket having a main cavity having a wall having at least one lateral cavity therein, the latching system further comprising:

a latch actuator for rotationally moving said socket to operate the latch mechanism, the latch actuator comprising:

a T-shaped handle portion for grasping by a user;

a distal end portion distal from said handle portion and being adapted for insertion into said socket, said distal end portion having an exterior surface;

a pushbutton supported by said handle portion for movement between an extended position and a retracted position; and at least one ball bearing movably supported by said distal end portion, said ball bearing being movable between an extended position and a retracted position, said ball bearing projecting from said exterior surface of said distal end when said ball bearing is in said extended position, said ball bearing not projecting from said exterior surface of said distal end when said ball bearing is in said retracted position, said ball bearing being maintained in its extended position when said push button is in its extended position, said ball bearing being free to move to its retracted position when said pushbutton is in its retracted position, wherein said ball bearing is capable of engaging said lateral cavity of said socket in order to turn said socket with said handle portion when said ball bearing is in its extended position.

22. The latching system according to claim 21, wherein said main cavity of said socket has an inner lateral wall surface, wherein said at least one lateral cavity of said socket is one of a plurality of lateral cavities of a predetermined number distributed in a predetermined pattern of locations over said inner lateral wall surface of said socket, wherein said at least one ball bearing is one of a plurality of ball bearings provided in said distal end portion in a number matching said number of said plurality of lateral cavities of said socket, and wherein each of said plurality of ball bearings can be placed in substantial alignment with a corresponding one of said plurality of lateral cavities of said socket.

23. The latch actuator according to claim 1, wherein the main cavity of the socket has an inner lateral wall surface, wherein the at least three lateral cavities are of a predetermined number distributed in a predetermined pattern of locations over the inner lateral wall surface of the socket, at least some of said at least three lateral openings are provided in a number and pattern of locations matching a number and pattern of locations of at least some of the at least three lateral cavities of the socket, wherein each of said at least three ball bearings is in substantial alignment with a corresponding lateral opening selected from said at least three lateral openings of said sleeve, and wherein those lateral openings of said at least three lateral openings having one of said at least three ball bearings in substantial alignment therewith are provided in a pattern of locations matching in pattern of locations an equal number of lateral cavities selected from the at least three lateral cavities of the socket such that each of said at least three ball bearings can be engaged with its corresponding one of the at least three lateral cavities at the same time as all others of said at least three ball bearings are each engaged to a corresponding one of the at least three lateral cavities.

24. The latch actuator according to claim 23, wherein the at least three lateral cavities of the socket includes a first plurality of lateral cavities and a second plurality of lateral cavities provided at spaced separation from said first plurality of lateral cavities along a longitudinal axis of the main cavity of the socket, wherein said at least three lateral openings provided in said second end portion of said sleeve at least includes a first plurality of lateral openings and a second plurality of lateral openings, wherein said second plurality of lateral openings is provided at spaced separation from said first plurality of lateral openings along a longitudinal axis of said sleeve, wherein said at least three ball bearings includes a first plurality of ball bearings and a second plurality of ball bearings, each of said first plurality of ball bearings is in substantial registry with a corresponding lateral opening selected from said first plurality of lateral openings of said sleeve, each of said second plurality of ball bearings is in substantial registry with a corresponding lateral opening selected from said second plurality of lateral openings of said sleeve, wherein said plunger has a first portion of said first diameter, a second portion of said first diameter, a first portion of said second diameter and a second portion of said second diameter, wherein said first portion of said second diameter is intermediate said first portion of said first diameter and said second portion of said first diameter along said longitudinal axis of said plunger, wherein said second portion of said first diameter is intermediate said first portion of said second diameter and said second portion of said second diameter along said longitudinal axis of said plunger, wherein each of said first plurality of ball bearings is movable between an extended position and a retracted position, wherein each of said second plurality of ball bearings is movable between an extended position and a retracted position, wherein each of said first plurality of ball bearings projects in part from said exterior surface when each of said first plurality of ball bearings is in its extended position, wherein each of said second plurality of ball bearings projects in part from said exterior surface when each of said second plurality of ball bearings is in its extended position, wherein each of said first plurality of ball bearings and said second plurality of ball bearings is in its extended position when said plunger and said pushbutton are in their extended positions, wherein said first portion of said plunger having said first diameter is in registry with said first plurality of ball bearings to thereby maintain said first plurality of ball bearings in their extended positions when said plunger and said pushbutton are in their extended positions, wherein said second portion of said plunger having said first diameter is in registry with said second plurality of ball bearings to thereby maintain said second plurality of ball bearings in their extended positions when said plunger and said pushbutton are in their extended positions, wherein said first portion of said plunger having said second diameter is in registry with said first plurality of ball bearings to thereby allow movement of each of said first plurality of ball bearings to its retracted position when said plunger and said pushbutton are in their retracted positions, and wherein said second portion of said plunger having said second diameter is in registry with said second plurality of ball bearings to thereby allow movement of each of said second plurality of ball bearings to its retracted position when said plunger and said pushbutton are in their retracted positions.

25. A latching system comprising:

a latch mechanism for selectively securing a first member in a closed position relative to a second member, said latch mechanism comprising:

a socket that is moved rotationally to operate said latch mechanism, said socket having a main cavity having a wall having at least one lateral cavity therein;

a shaft operably connected to said socket such that said shaft moves responsive to a movement of said socket; and a pawl operably connected to said shaft such that said pawl moves between a latched position and an unlatched position responsive to a movement of said socket, wherein said latch mechanism is adapted for mounting to the first member and wherein said pawl engages the second member so as to secure the first member in the closed position relative to the second member when the first member is in the closed position relative to the second member, said latch mechanism is mounted to the first member, and said pawl is in said latched position; and a latch actuator for use with said latch mechanism, said latch actuator comprising:

a sleeve having a bore extending along a longitudinal axis of said sleeve;

a pair of lateral arms provided at a first end portion of said sleeve, said lateral arms extending in opposite directions from said first end portion of said sleeve so as to form a T-shaped configuration with said sleeve to thereby define a T-handle, wherein said sleeve has a hole at said first end portion thereof that communicates with said bore, said hole being located intermediate said lateral arms;

a plunger supported for rectilinear motion in said bore, said plunger being rectilinearly movable between an extended position and a retracted position, said plunger having a button portion that projects from said hole when said plunger is in said extended position so as to define a pushbutton that is movable between an extended position corresponding to said extended position of said plunger and a retracted position corresponding to said retracted position of said plunger, wherein a user can move said plunger to said retracted position by pushing said pushbutton inward relative to said bore, said plunger having at least one portion of a first diameter and at least one portion of a second diameter, said first diameter being larger than said second diameter;

a spring biasing said plunger toward said extended position; and at least one ball bearing received at least in part within said bore, said sleeve having a cylindrical second end portion distal from said lateral arms that is dimensioned for insertion into said main cavity of said socket, said sleeve having at least one lateral opening in said second end portion of said sleeve, said sleeve having an exterior surface, said lateral opening extending between said bore and said exterior surface, said ball bearing being in registry with said lateral opening, said ball bearing being movable between an extended position and a retracted position, said ball bearing projecting in part from said exterior surface when said ball bearing is in its extended position, said ball bearing being in its extended position when said plunger and consequently said pushbutton are in their extended positions, said portion of said plunger having said first diameter being in registry with said ball bearing to thereby maintain said ball bearing in its extended position when said plunger and said pushbutton are in their extended positions, said portion of said plunger having said second diameter being in registry with said ball bearing to thereby allow movement of said ball bearing to its retracted position when said plunger and consequently said pushbutton are in their retracted positions, wherein when said second end portion of said sleeve is inserted into said socket with said lateral opening in registry with said lateral cavity in said socket and said plunger and said pushbutton are in their extended positions, said ball bearing will be in its extended position and projecting in part into said lateral cavity of said socket such that a user can turn said sleeve by turning said T-handle to thereby turn said socket and thus operate said latch mechanism, and wherein when said second end portion of said sleeve is inserted into said socket with said lateral opening in registry with said lateral cavity in said socket and said plunger and said pushbutton are in their extended positions, a user can push in said pushbutton to its retracted position to allow movement of said ball bearing to its retracted position and thereby allow said latch actuator to be removed from said socket.

26. The latching system according to claim 25, wherein said spring is a coil spring and said plunger extends through said coil spring, wherein said plunger has an annular step and said sleeve has an annular step, said annular step of said plunger is positioned intermediate said button portion and said annular step of said sleeve, and said coil spring extends between said annular step of said plunger and said annular step of said sleeve to thereby bias said plunger and said pushbutton to their extended positions.

27. The latching system according to claim 25, wherein said second diameter is selected such that said ball bearing extends in part into said lateral opening of said sleeve even when said ball bearing is in its retracted position such that said ball bearing will remain in substantial alignment with said lateral opening of said sleeve to allow said ball bearing to return to its extended position when said plunger returns to its extended position.

28. The latching system according to claim 25, wherein said lateral arms are in the form of U-shaped bars having a bend portion extending between two lateral bar portions, and each of said lateral bar portions has a distal end portion distal from said bend portion, and wherein said distal end portions of said lateral bar portions are attached to said first end portion of said sleeve.

29. The latching system according to claim 25, wherein said main cavity of said socket has an inner lateral wall surface, wherein said at least one lateral cavity of said socket is one of a plurality of lateral cavities of a predetermined number distributed in a predetermined pattern of locations over said inner lateral wall surface of said socket, wherein said at least one lateral opening of said second end portion of said sleeve is one of a plurality of lateral openings provided in said second end portion of said sleeve, at least some of said plurality of lateral openings are provided in a number and pattern of locations matching in number and pattern of locations at least some of said plurality of lateral cavities of said socket, wherein said at least one ball bearing is one of a plurality of ball bearings provided in said bore of said sleeve, wherein each of said plurality of ball bearings is in substantial alignment with a corresponding lateral opening selected from said plurality of lateral openings of said sleeve, and wherein those lateral openings of said plurality of lateral openings having one of said plurality of ball bearings in substantial alignment therewith are provided in a pattern of locations matching a pattern of locations of an equal number of lateral cavities selected from said plurality of lateral cavities of said socket such that each of said plurality of ball bearings can be engaged with its corresponding one of said plurality of lateral cavities at the same time as all others of said plurality of ball bearings are each engaged to their corresponding one of said plurality of lateral cavities.

30. The latching system according to claim 29, wherein said plurality of lateral cavities of said socket includes a first plurality of lateral cavities and a second plurality of lateral cavities provided at spaced separation from said first plurality of lateral cavities along a longitudinal axis of said main cavity of said socket, wherein said plurality of lateral openings provided in said second end portion of said sleeve at least includes a first plurality of lateral openings and a second plurality of lateral openings, wherein said second plurality of lateral openings is provided at spaced separation from said first plurality of lateral openings along a longitudinal axis of said sleeve, wherein said plurality of ball bearings includes a first plurality of ball bearings and a second plurality of ball bearings, each of said first plurality of ball bearings is in substantial registry with a corresponding lateral opening selected from said first plurality of lateral openings of said sleeve, each of said second plurality of ball bearings is in substantial registry with a corresponding lateral opening selected from said second plurality of lateral openings of said sleeve, wherein said plunger has a first portion of said first diameter, a second portion of said first diameter, a first portion of said second diameter and a second portion of said second diameter, wherein said first portion of said second diameter is intermediate said first portion of said first diameter and said second portion of said first diameter along said longitudinal axis of said plunger, wherein said second portion of said first diameter is intermediate said first portion of said second diameter and said second portion of said second diameter along said longitudinal axis of said plunger, wherein each of said first plurality of ball bearings is movable between an extended position and a retracted position, wherein each of said second plurality of ball bearings is movable between an extended position and a retracted position, wherein each of said first plurality of ball bearings projects in part from said exterior surface when each of said first plurality of ball bearings is in its extended position, wherein each of said second plurality of ball bearings projects in part from said exterior surface when each of said second plurality of ball bearings is in its extended position, wherein each of said first plurality of ball bearings and said second plurality of ball bearings is in its extended position when said plunger and said pushbutton are in their extended positions, wherein said first portion of said plunger having said first diameter is in registry with said first plurality of ball bearings to thereby maintain said first plurality of ball bearings in their extended positions when said plunger and said pushbutton are in their extended positions, wherein said second portion of said plunger having said first diameter is in registry with said second plurality of ball bearings to thereby maintain said second plurality of ball bearings in their extended positions when said plunger and said pushbutton are in their extended positions, wherein said first portion of said plunger having said second diameter is in registry with said first plurality of ball bearings to thereby allow movement of each of said first plurality of ball bearings to its retracted position when said plunger and said pushbutton are in their retracted positions, and wherein said second portion of said plunger having said second diameter is in registry with said second plurality of ball bearings to thereby allow movement of each of said second plurality of ball bearings to its retracted position when said plunger and said pushbutton are in their retracted positions.

31. The latching system according to claim 25, further comprising a pin passing through a wall of said sleeve and engaging a groove in said plunger in order to limit outward movement of said plunger relative to said sleeve and to prevent said plunger from moving past its extended position in a direction that is the same as a direction of movement defined by movement of said plunger from its retracted position to its extended position.

32. A latching system comprising:

a latch mechanism for selectively securing a first member in a closed position relative to a second member, said latch mechanism comprising:

a socket that is moved rotationally to operate said latch mechanism, said socket having a main cavity having a wall having at least one lateral cavity therein;

a shaft operably connected to said socket such that said shaft moves responsive to a movement of said socket; and a pawl operably connected to said shaft such that said pawl moves between a latched position and an unlatched position responsive to a movement of said socket, wherein said latch mechanism is adapted for mounting to the first member and wherein said pawl engages the second member so as to secure the first member in the closed position relative to the second member when the first member is in the closed position relative to the second member, said latch mechanism is mounted to the first member, and said pawl is in said latched position; and a latch actuator for use with said latch mechanism, said latch actuator comprising:

a T-shaped handle portion for grasping by a user;

a distal end portion distal from said handle portion and being adapted for insertion into said socket, said distal end portion having a cylindrical exterior surface;

a pushbutton supported by said handle portion for movement between an extended position and a retracted position; and at least one ball bearing movably supported by said distal end portion, said ball bearing being movable between an extended position and a retracted position, said ball bearing projecting from said exterior surface of said distal end portion when said ball bearing is in said extended position, said ball bearing not projecting from said exterior surface of said distal end portion when said ball bearing is in said retracted position, said ball bearing being maintained in its extended position when said pushbutton is in its extended position, said ball bearing being free to move to its retracted position when said pushbutton is in its retracted position, wherein said ball bearing is capable of engaging said lateral cavity of said socket in order to turn said socket with said handle portion when said distal end portion is inserted into said socket and said ball bearing is in its extended position, and wherein a user can push in said pushbutton to its retracted position to allow movement of said ball bearing to its retracted position and thereby allow said latch actuator to be removed from said socket.

33. The latching system according to claim 32, wherein said main cavity of said socket has an inner lateral wall surface, wherein said at least one lateral cavity of said socket is one of a plurality of lateral cavities of a predetermined number distributed in a predetermined pattern of locations over said inner lateral wall surface of said socket, wherein said at least one ball bearing is one of a plurality of ball bearings provided in said distal end portion, and wherein each of said plurality of ball bearings can be placed in substantial alignment with a corresponding one of said plurality of lateral cavities of said socket simultaneously with all others of said plurality of ball bearings.

34. The latch actuator according to claim 1, wherein the main cavity of the socket has an inner lateral wall surface, wherein the at least three lateral cavities of the socket are of a predetermined number distributed in a predetermined pattern of locations over the inner lateral wall surface of the socket, and wherein each of said at least three ball bearings can be placed in substantial alignment with a corresponding one of the at least three lateral cavities of the socket simultaneously with all others of said at least three ball bearings.

* * * * *